US008016329B2

(12) United States Patent
Johansson et al.

(10) Patent No.: US 8,016,329 B2
(45) Date of Patent: Sep. 13, 2011

(54) LATCH

(75) Inventors: Henrik Olov Johansson, Husby-Rekarne (SE); Stephen M. Kozachyn, Clayton, NJ (US); Joseph W. Jackson, Wilmington, DE (US); Daniel James Kelly, III, Mullica Hill, NJ (US); Fall Lars Erik Johan Ohlsson, Eskilstuna (SE); Daniel Andersson, Eskilstuna (SE)

(73) Assignee: Southco, Inc., Concordville, PA (US)

( * ) Notice: Subject to any disclaimer, the term of this patent is extended or adjusted under 35 U.S.C. 154(b) by 280 days.

(21) Appl. No.: 11/932,828

(22) Filed: Oct. 31, 2007

(65) Prior Publication Data

US 2008/0136194 A1 Jun. 12, 2008

Related U.S. Application Data

(60) Provisional application No. 60/863,795, filed on Oct. 31, 2006.

(51) Int. Cl.
*E05C 3/06* (2006.01)
*E05C 19/12* (2006.01)

(52) U.S. Cl. ..... 292/199; 292/108; 292/200; 292/280; 292/336.3; 292/DIG. 31

(58) Field of Classification Search ..... 292/194, 292/22, 39, 63–65, 66, 67, 69, 100, 108, 292/126, 200, DIG. 31, DIG. 60, DIG. 61, 292/DIG. 63, 336.3, 199, 280; 70/137, 208, 70/215, 224
See application file for complete search history.

(56) References Cited

U.S. PATENT DOCUMENTS

| | | | | |
|---|---|---|---|---|
| 328,231 | A | 10/1885 | Lambeth | |
| 429,141 | A | 6/1890 | Mansfield | |
| 1,526,968 | A * | 2/1925 | Elwell | 292/181 |
| 1,785,914 | A * | 12/1930 | Riel | 292/280 |
| 4,639,021 | A | 1/1987 | Hope | |
| 4,898,408 | A * | 2/1990 | Hauber | 292/7 |
| 4,969,916 | A | 11/1990 | Weinerman et al. | |
| D324,636 | S | 3/1992 | Schlack et al. | |
| 5,234,238 | A | 8/1993 | Takimoto | |
| 5,439,260 | A * | 8/1995 | Weinerman et al. | 292/48 |
| D370,620 | S | 6/1996 | Ziemer | |
| 5,556,145 | A * | 9/1996 | Takasaki | 292/336.3 |
| 5,586,458 | A * | 12/1996 | Weinerman et al. | 70/208 |
| 5,595,409 | A * | 1/1997 | Fier et al. | 292/112 |
| 5,984,383 | A * | 11/1999 | Parikh et al. | 292/121 |

(Continued)

FOREIGN PATENT DOCUMENTS

WO W02008055246 A3 5/2008

OTHER PUBLICATIONS

Southco Handbook 2002, pp. 44-52, and 110 and 111.

(Continued)

*Primary Examiner* — Carlos Lugo
*Assistant Examiner* — Alyson M Merlino
(74) *Attorney, Agent, or Firm* — Paul & Paul

(57) ABSTRACT

A latch is disclosed that can releasably secure a door or panel in a closed position. The latch includes a rotary pawl, a pawl catch, an actuating member, a pivotally movable handle, and a gear train for moving the pawl to provide compression in response to the movement of the handle to the closed position.

20 Claims, 94 Drawing Sheets

U.S. PATENT DOCUMENTS

| | | | | |
|---|---|---|---|---|
| 6,095,573 | A * | 8/2000 | Rozema | 292/51 |
| 6,109,669 | A | 8/2000 | Pinkow | |
| D452,808 | S | 1/2002 | Kyle | |
| D459,192 | S | 6/2002 | Weinerman et al. | |
| 6,460,902 | B1 | 10/2002 | Kyle | |
| D475,602 | S | 6/2003 | McCloskey | |
| D489,958 | S | 5/2004 | Jackson et al. | |
| D489,959 | S | 5/2004 | Jackson et al. | |
| 6,817,636 | B1 | 11/2004 | Evans et al. | |
| 6,840,552 | B2 * | 1/2005 | Ramsauer | 292/336.3 |
| D506,120 | S | 6/2005 | Straka, Jr. et al. | |
| 6,953,209 | B2 | 10/2005 | Jackson, Jr. et al. | |
| D530,181 | S | 10/2006 | Straka, Jr. et al. | |
| D536,949 | S | 2/2007 | Weinerman et al. | |
| D541,129 | S | 4/2007 | Helton et al. | |
| D545,667 | S | 7/2007 | Weinerman et al. | |
| 7,313,937 | B2 | 1/2008 | Straka, Jr. | |
| 2005/0183478 | A1 | 8/2005 | Straka, Jr. | |

OTHER PUBLICATIONS

Gemlux Catalog, New Products for 2002, pp. 3, 30 and 31.

Perko Catalog No. 290 (2000-2001), pp. 166-171 and 181-183, 2000.

Detailed photographs of Gemlux Model 1263 Latch—listed in the Gemlux 2002 Catalog.

* cited by examiner

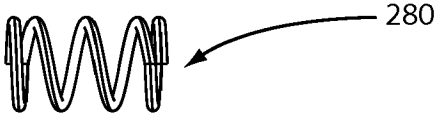
Fig. 85
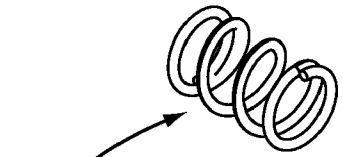
Fig. 86
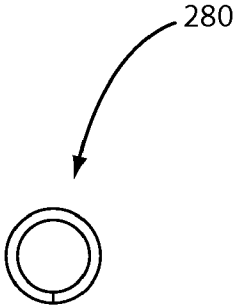
Fig. 87
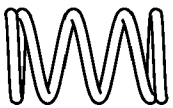
Fig. 88
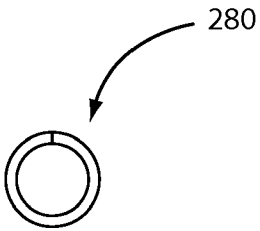
Fig. 89
Fig. 90
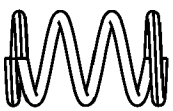
Fig. 91

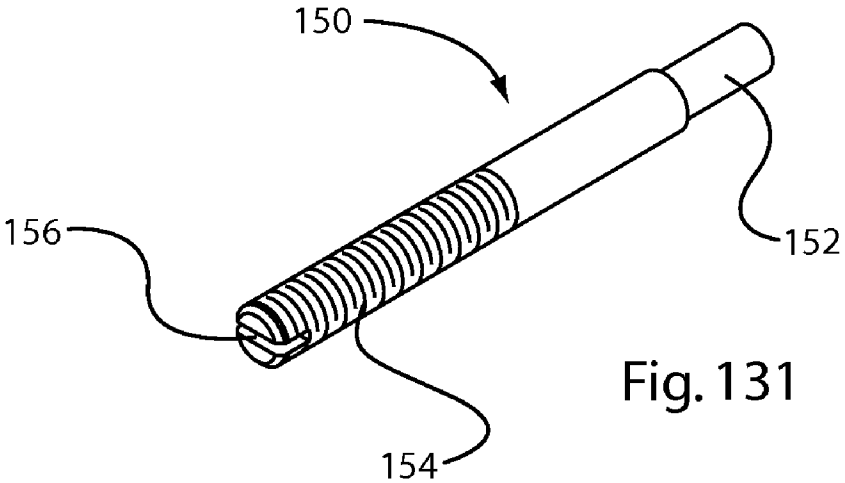
Fig. 131
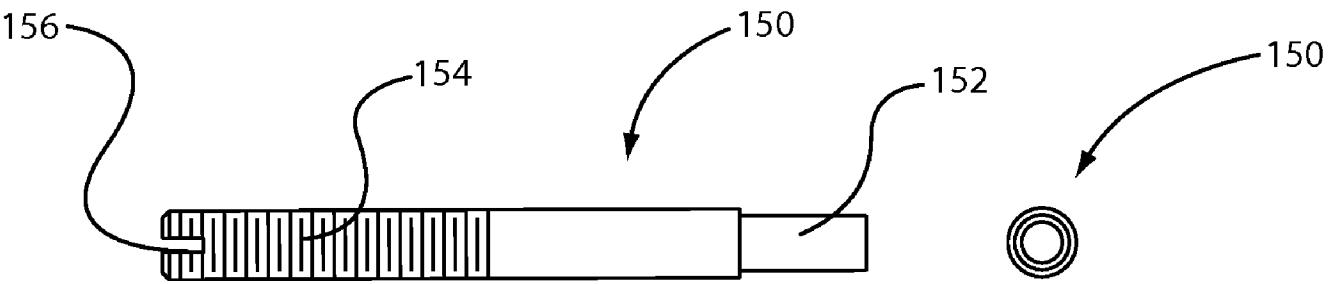
Fig. 132
Fig. 133

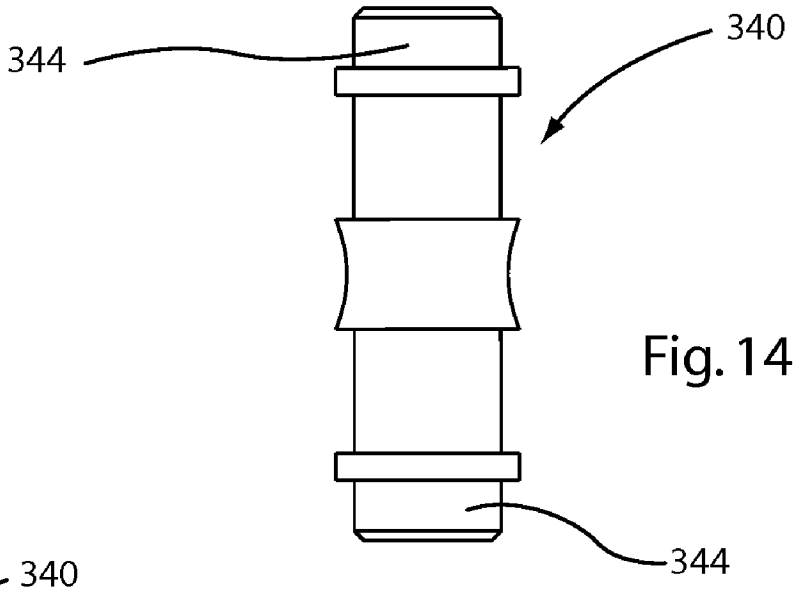
Fig. 141
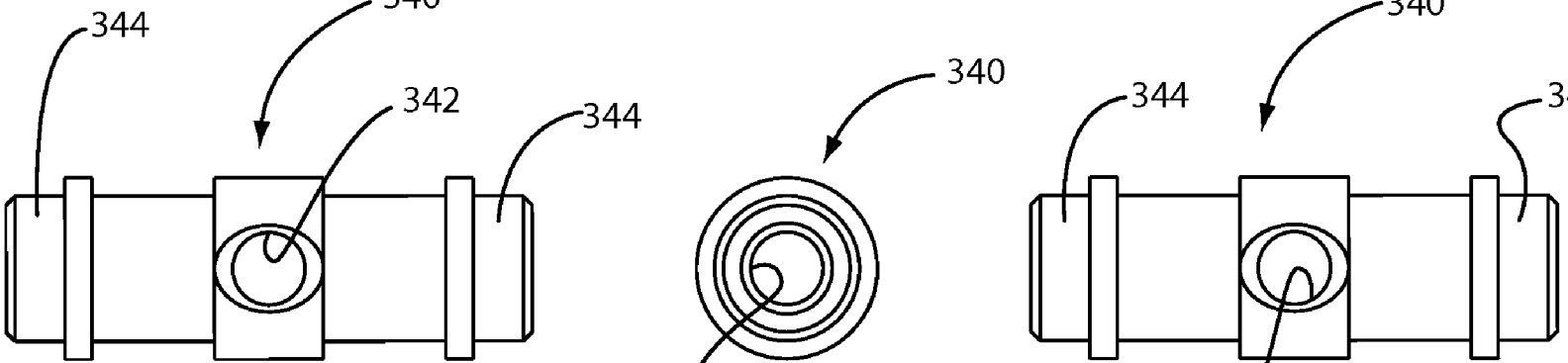
Fig. 142
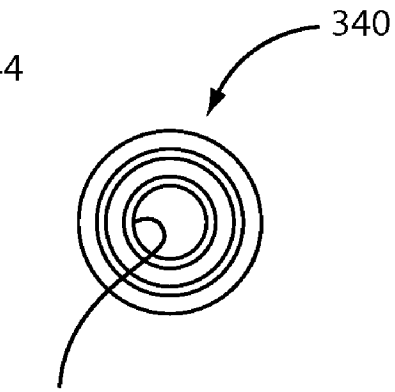
Fig. 143
Fig. 144

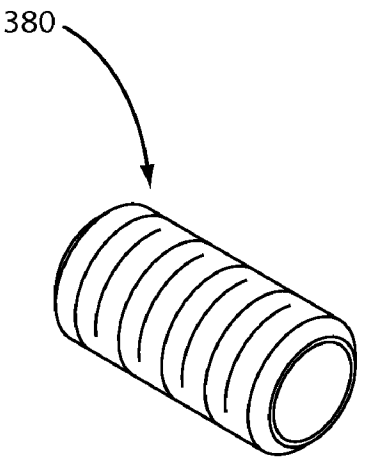
Fig. 146
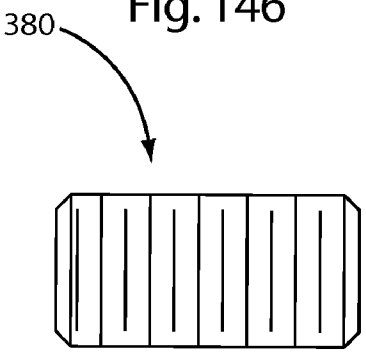
Fig. 150
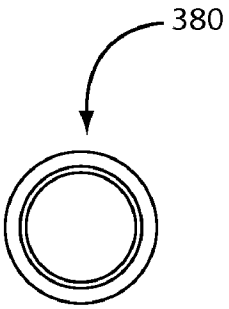
Fig. 149
Fig. 145
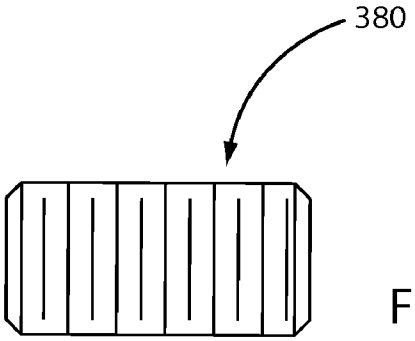
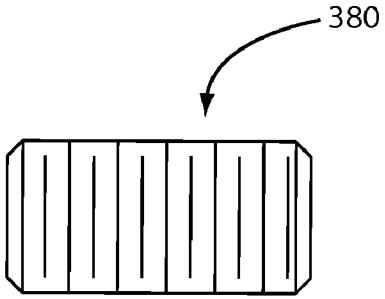
Fig. 148
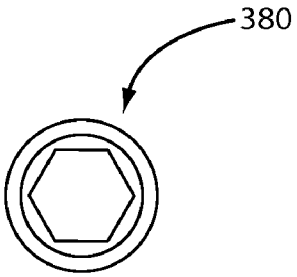
Fig. 147

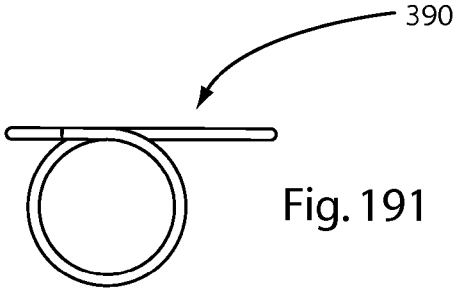
Fig. 191
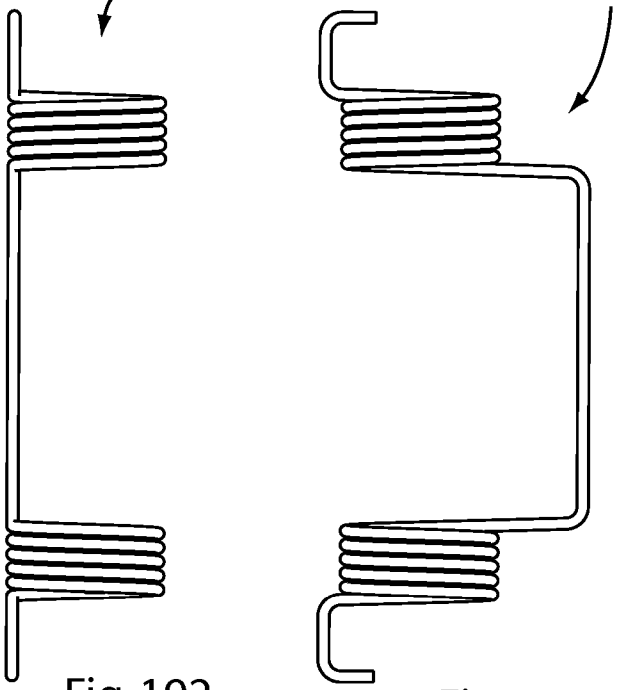
Fig. 192
Fig. 193
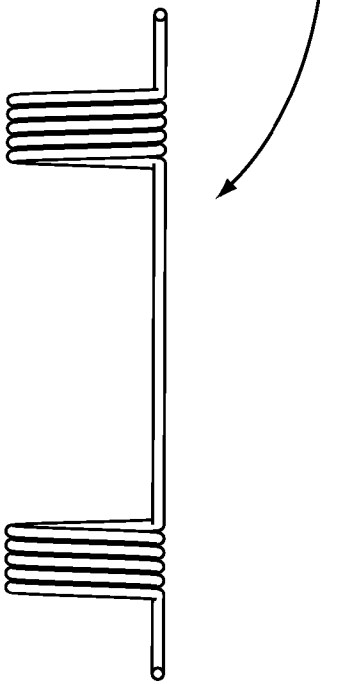
Fig. 194

LATCH

CROSS REFERENCE TO RELATED APPLICATIONS

This application claims the benefit of the priority of U.S. Provisional Patent Application No. 60/863,795, filed Oct. 31, 2006, which is incorporated herein by reference in its entirety.

BACKGROUND OF THE INVENTION

1. Field of the Invention

The present invention relates to a latch for releasably securing a first member, such as a door, panel or the like, relative to a second member.

2. Description of the Prior Art

Latches are used to releasably secure panels, covers, doors, electronic modules, and the like to other structures such as compartments, cabinets, containers, doorframes, other panels, frames, racks, etc. Although many latch designs are known in the art, none offers the advantages of the present invention. The advantages of the present invention will be apparent from the attached detailed description and drawings.

SUMMARY OF THE INVENTION

The present invention is directed to improvements in latch design. The illustrated embodiment exemplifying the several inventive concepts of the present invention is a rotary pawl latch with the capability to provide a compressive force between the first member and the second member as the latch handle is pushed to the closed or lowered position. The illustrated embodiment has a rotary pawl, a pawl catch, an actuating member, a pivotally movable handle, and a gear train for moving the pawl to provide compression in response to the movement of the handle to the closed position. The rotary pawl is biased toward the unlatched position. The pawl catch is biased toward engagement with the rotary pawl. The catch member can catch and hold the pawl in the latched position and in an intermediate position as will be described. The pawl catch must be disengaged from the pawl to allow the pawl to rotate to the unlatched position. The actuating member is held in a position where it is disengaged from the pawl catch when the handle is secured in the folded-down position. A user can bring the actuating member into engagement with the catch member in order to disengage the catch member from the pawl by moving the handle to a fully raised position from an intermediate position. The handle has a cam that engages the actuating member and pulls the actuating member into engagement with the pawl catch. The pawl catch has one or more claws that are engaged by the actuating member to release the pawl, thereby allowing a member secured by the latch to be opened.

The handle is carried by a first housing, and the pawl, pawl catch and gear train are carried by a second housing. The first and second housings can be secured together and with the door or panel using available fasteners such as screws.

BRIEF DESCRIPTION OF THE DRAWINGS

FIGS. 85-91 are views of a coil spring for biasing the handle release actuator out of engagement with the bolts securing the handle in the folded-down position in a latch according to the present invention.

FIGS. 131-137 are views of the actuation rod of a latch according to the present invention.

FIGS. 138-144 are views of the adjustable pin of the latch according to the present invention.

FIGS. 145-150 are views of the set screw used for securing the adjustable pin of the latch according to the present invention in place.

FIGS. 188-194 are views of the pawl catch spring that biases the pawl catch into engagement with the pawl.

Similar reference characters denote corresponding features consistently throughout the attached drawings.

DETAILED DESCRIPTION OF THE PREFERRED EMBODIMENTS

Figure 1:
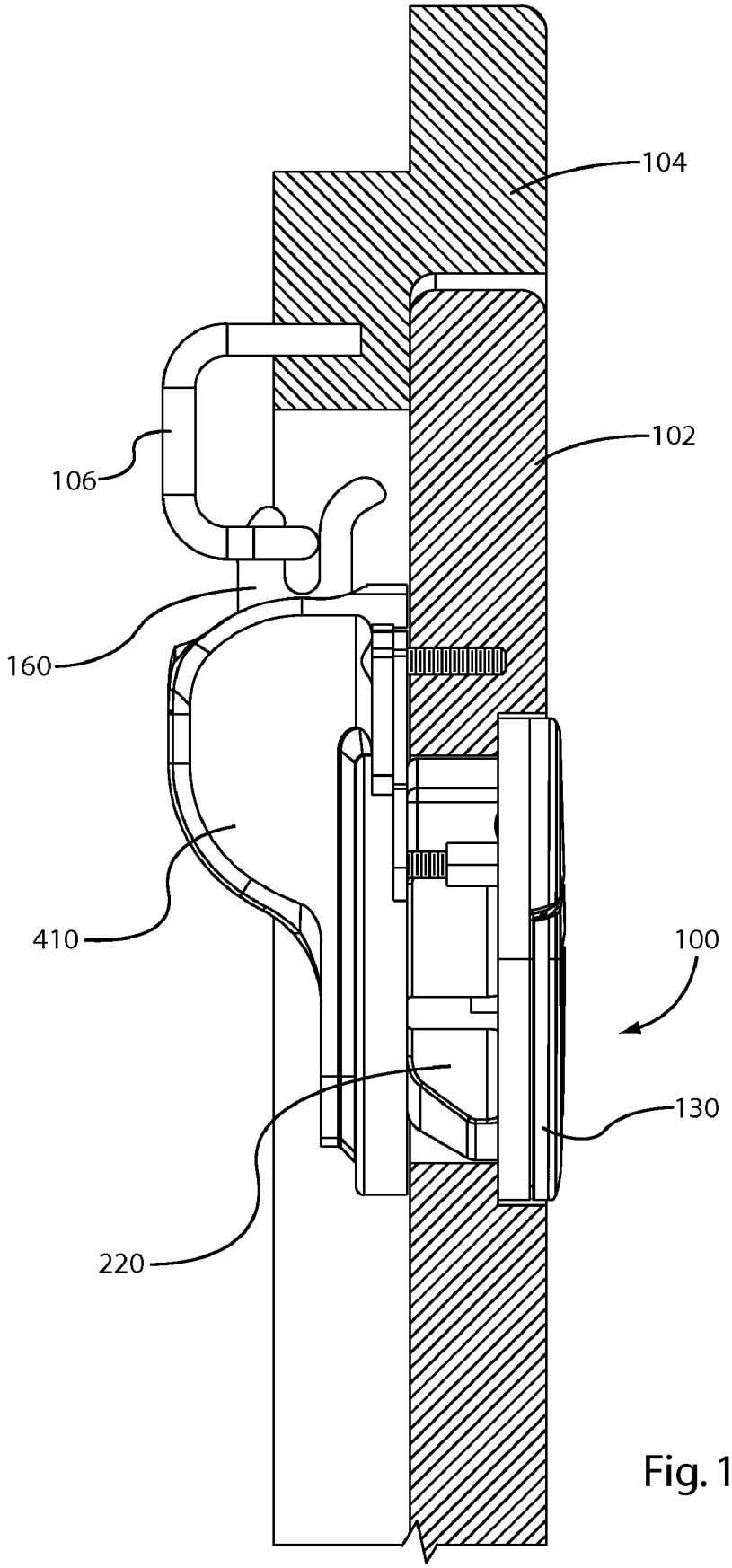
FIGS. 1-3 are environmental views of a latch according to the present invention shown with the handle folded-down and the pawl in the latched position.
Figure 250:
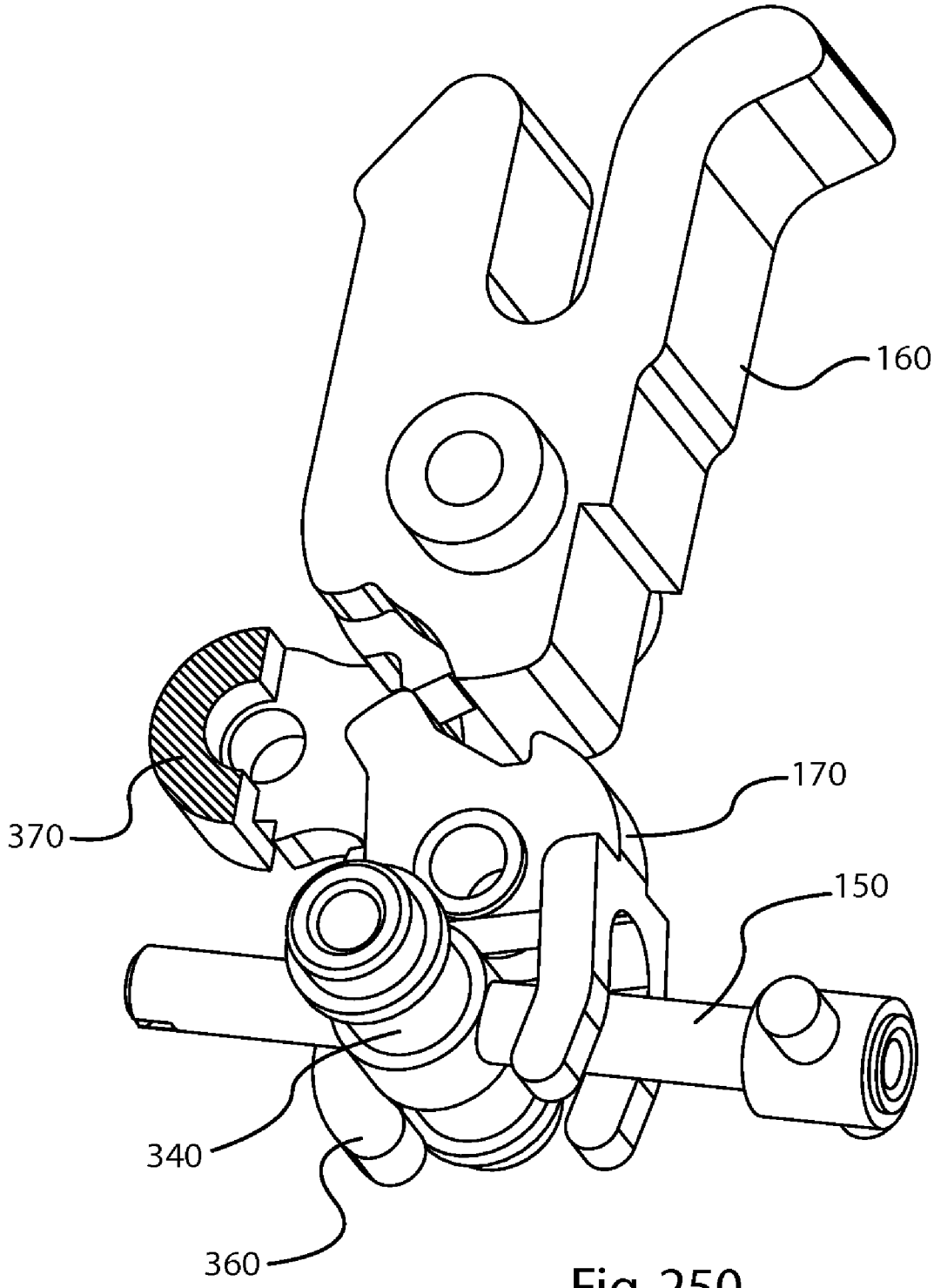

The Referring to FIGS. 1-250, the present invention is directed to a latch that is particularly suited for releasably securing a first member relative to a second member. For example, the latch of the present invention can be used to releasably secure a door or panel against a doorframe or other similar member. An illustrative embodiment 100 of the latch of the present invention is shown in the drawing figures.

In the illustrative embodiment, the latch 100 is used to secure the door 102 against a doorframe 104. However, the latch 100 could easily have been installed to the doorframe and made to engage a keeper attached to the door to securely hold the door in the closed position.

The latch 100 includes a first housing 110, also referred to herein as the handle housing, and a second housing 120, also referred to herein as the pawl housing. The handle housing 110 pivotally supports the handle 130. The handle housing 110 also supports a mechanism 140 for securing the handle 130 in the folded-down position illustrated in FIGS. 1-3. The handle housing also supports an actuation rod 150 for substantially rectilinear movement along the longitudinal axis of the actuation rod in response to the movement of the handle 130.

The pawl housing 120 houses the pawl 160, the pawl catch 170 and the gear train for providing the pull-up action on moving the handle 130 to the folded-down position. The latch 100 belongs to the class of latches known as pull-up or compression latches. When fully latched, these types of latches provide a compressive force through the mechanism of the latch to compress a sealing gasket or the like (not shown) between the door 102 and the door frame 104.

Figure 2:
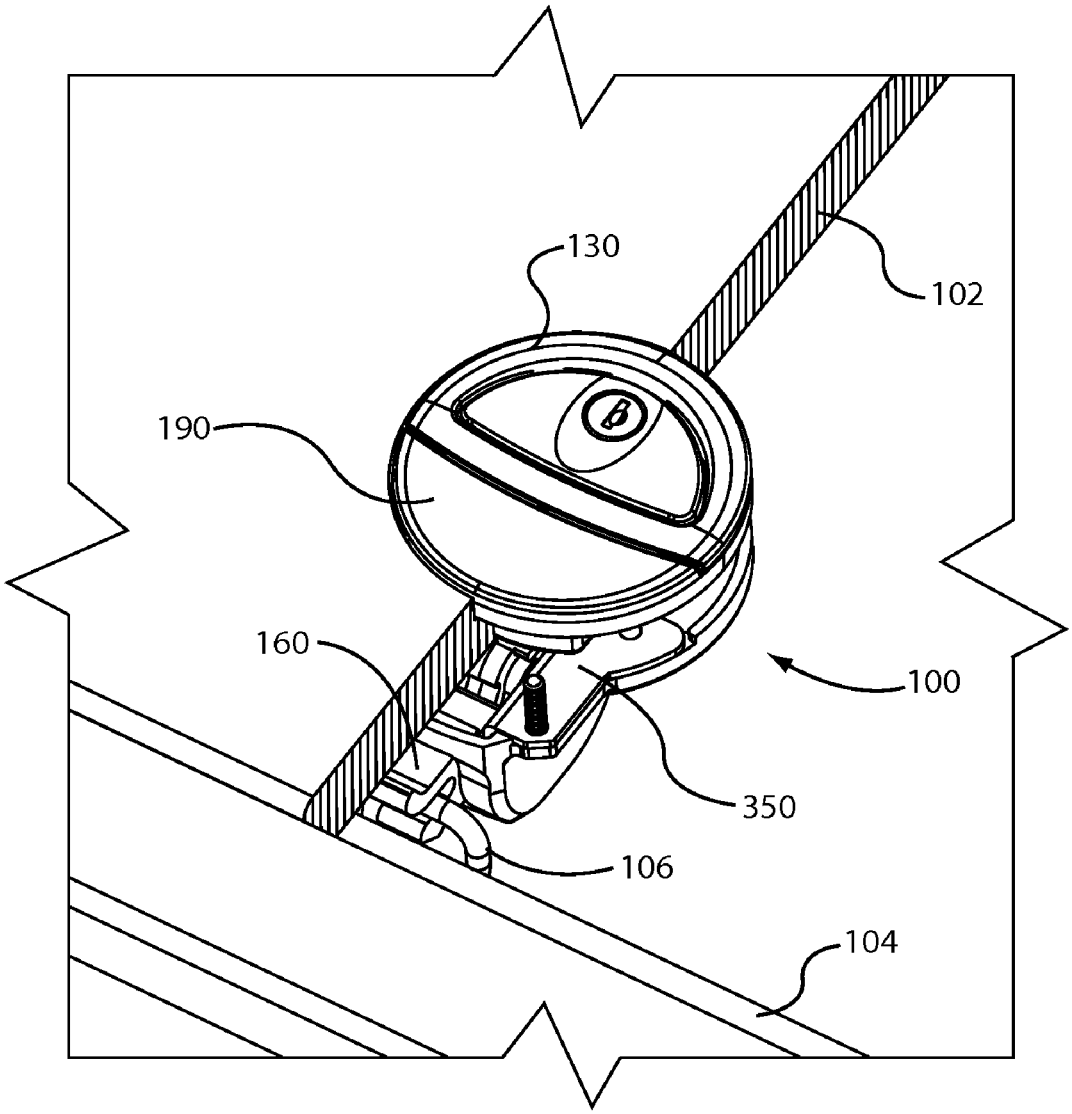
Figure 3:
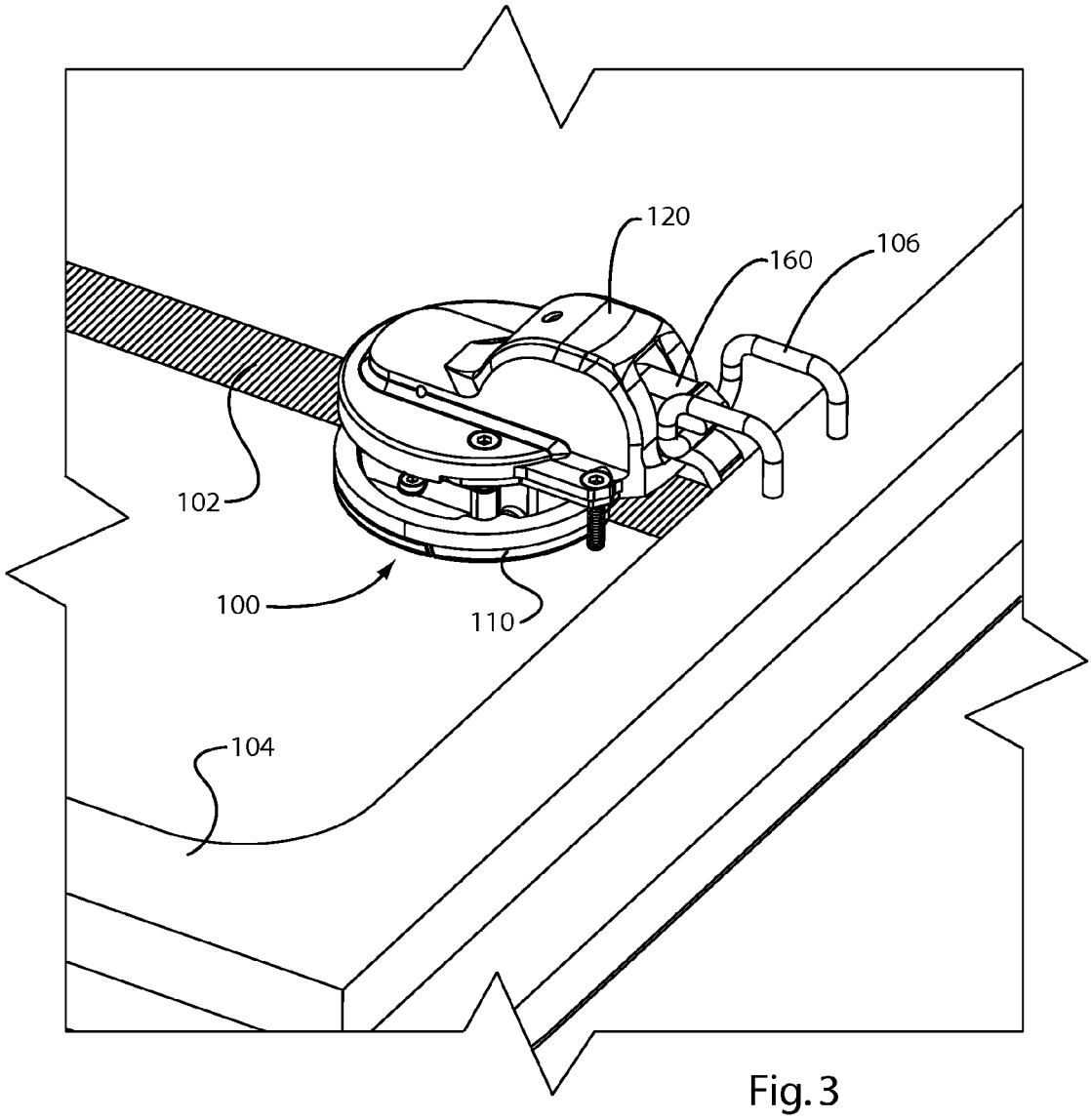

Referring to FIGS. 1-3, the latch 100 is shown in the fully latched condition, i.e. with the handle 130 folded down and the pawl 160 in the latched position. In this condition, the latch 100 is holding the door 102 closed against the door frame 104. The door 102 is held closed because the keeper 106, which is fixed to the doorframe 104, is captured in the pawl slot 162 and hence no relative movement is possible between the latch 100 and the keeper 106. Consequently, the door 102 is held in the closed position relative to the doorframe 104.

Figure 4:
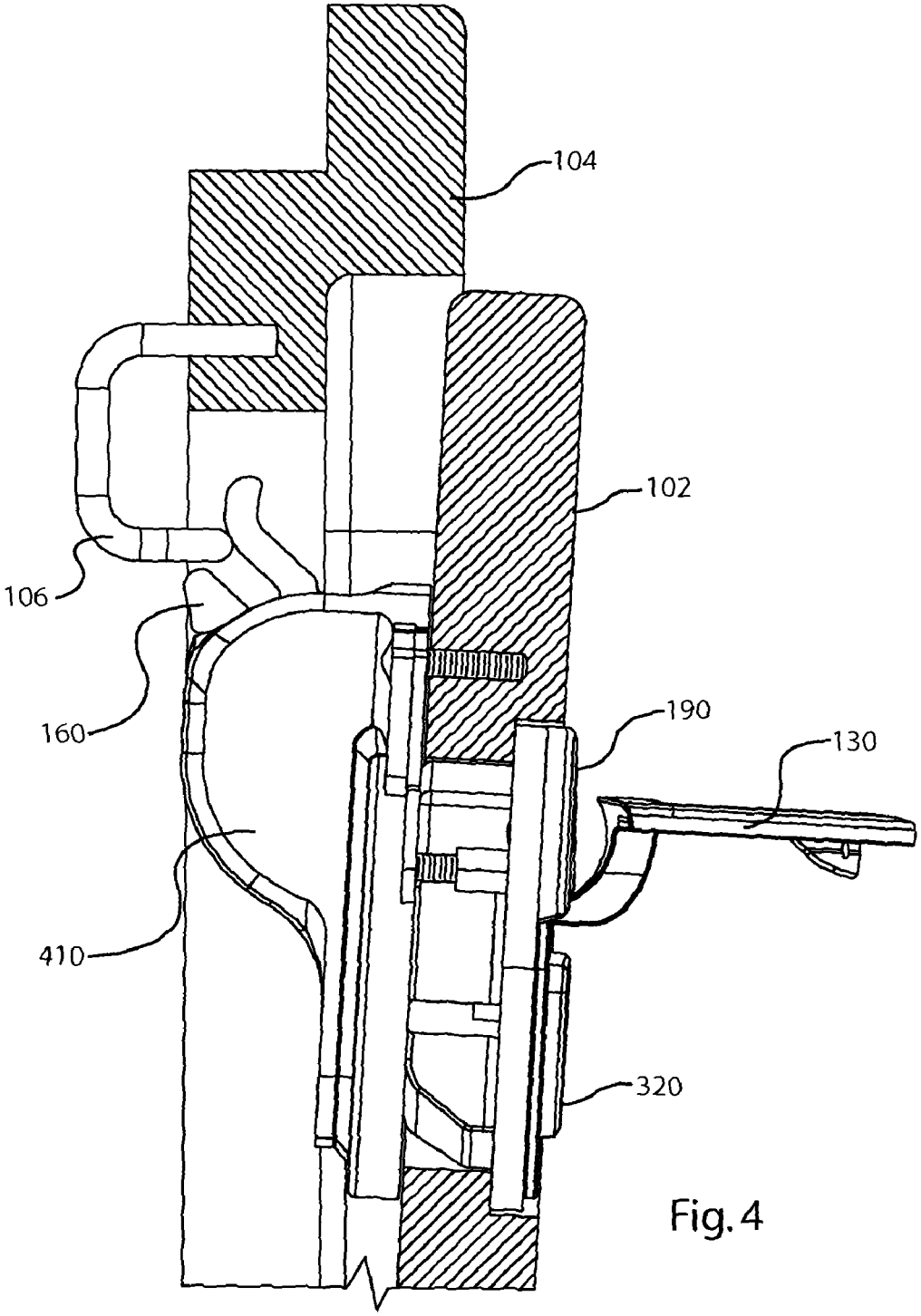
FIGS. 4-6 are environmental views of a latch according to the present invention shown with the handle raised and the pawl in the unlatched position.
Figure 5:
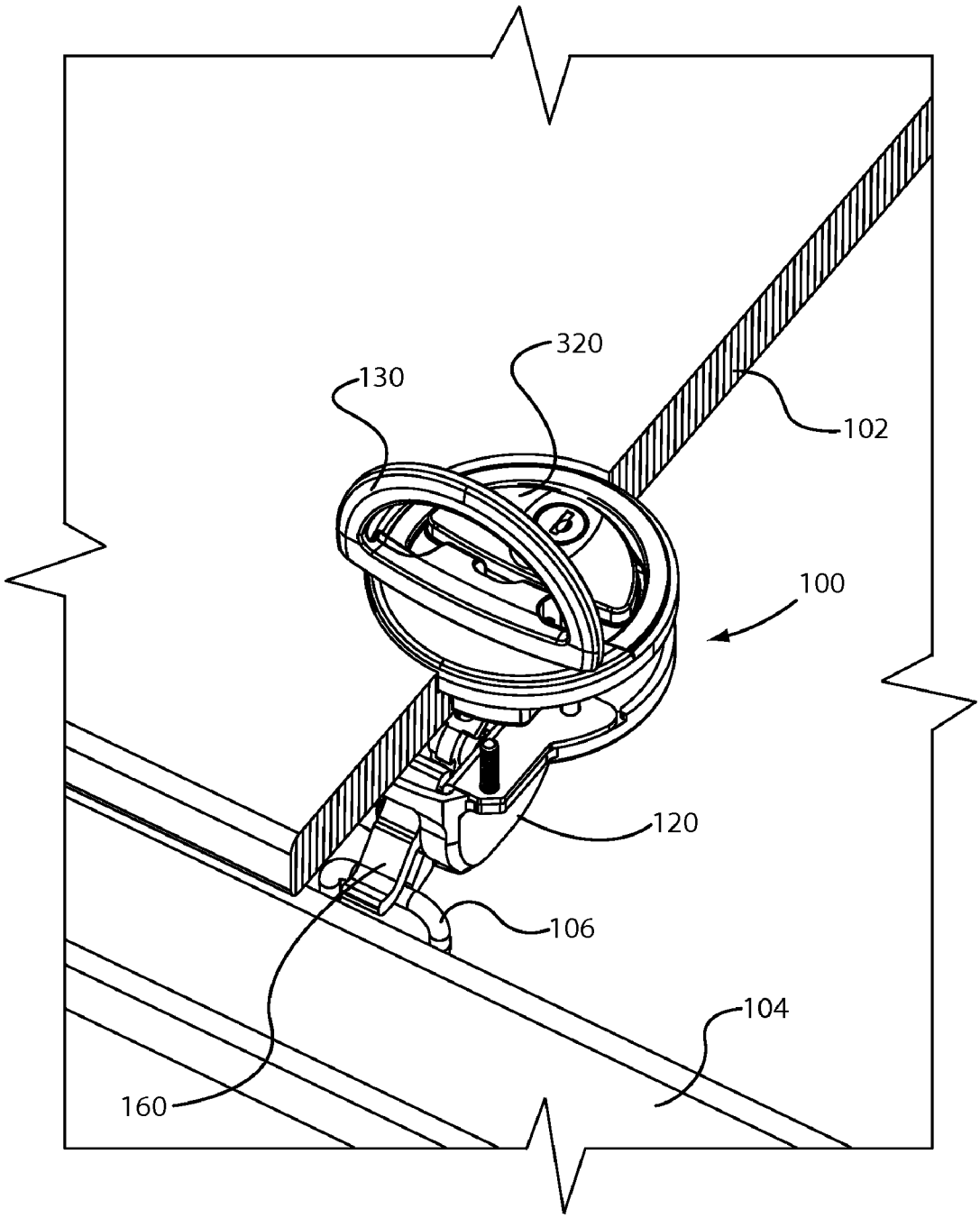
Figure 6:
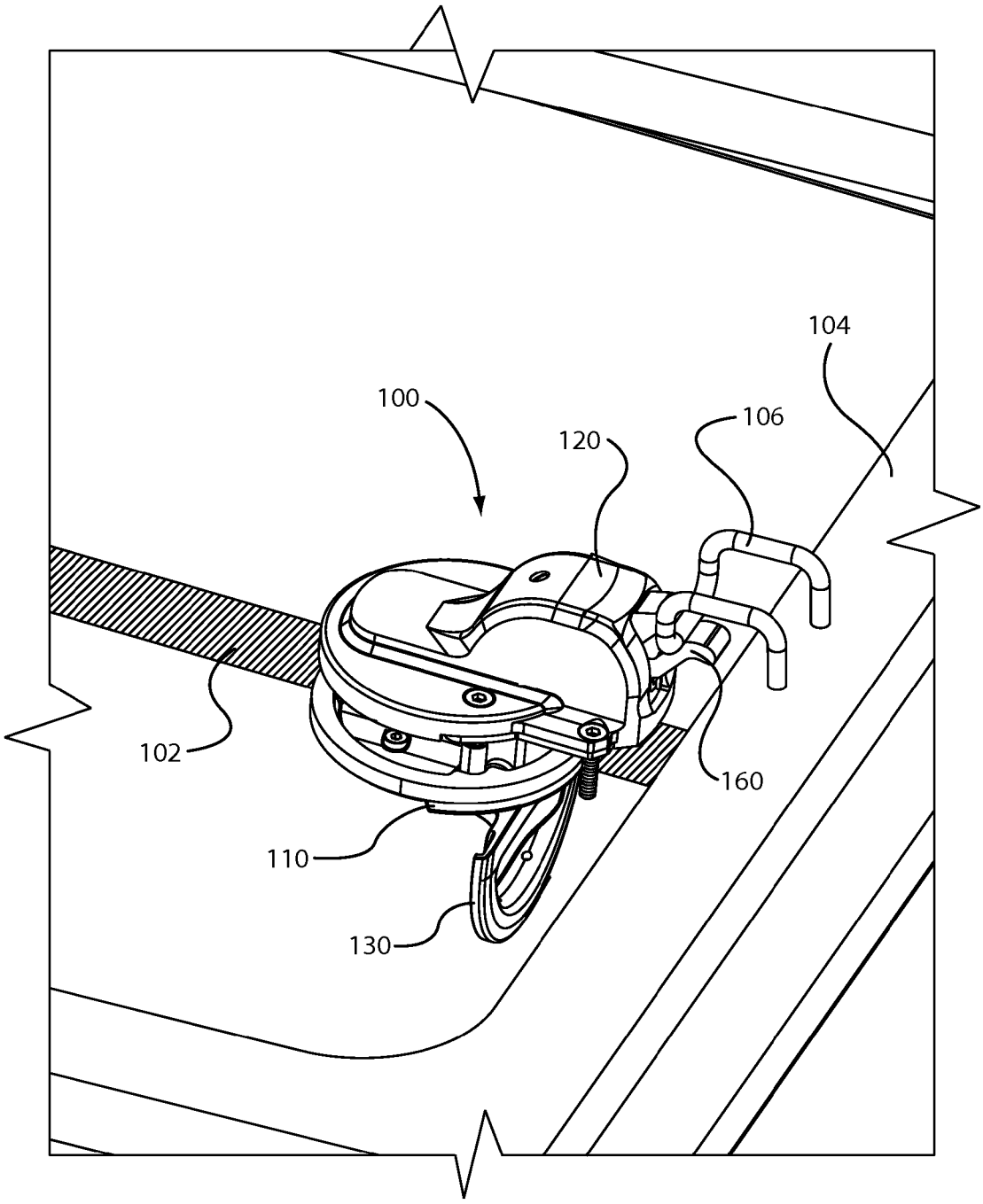
Figures 7, 8:
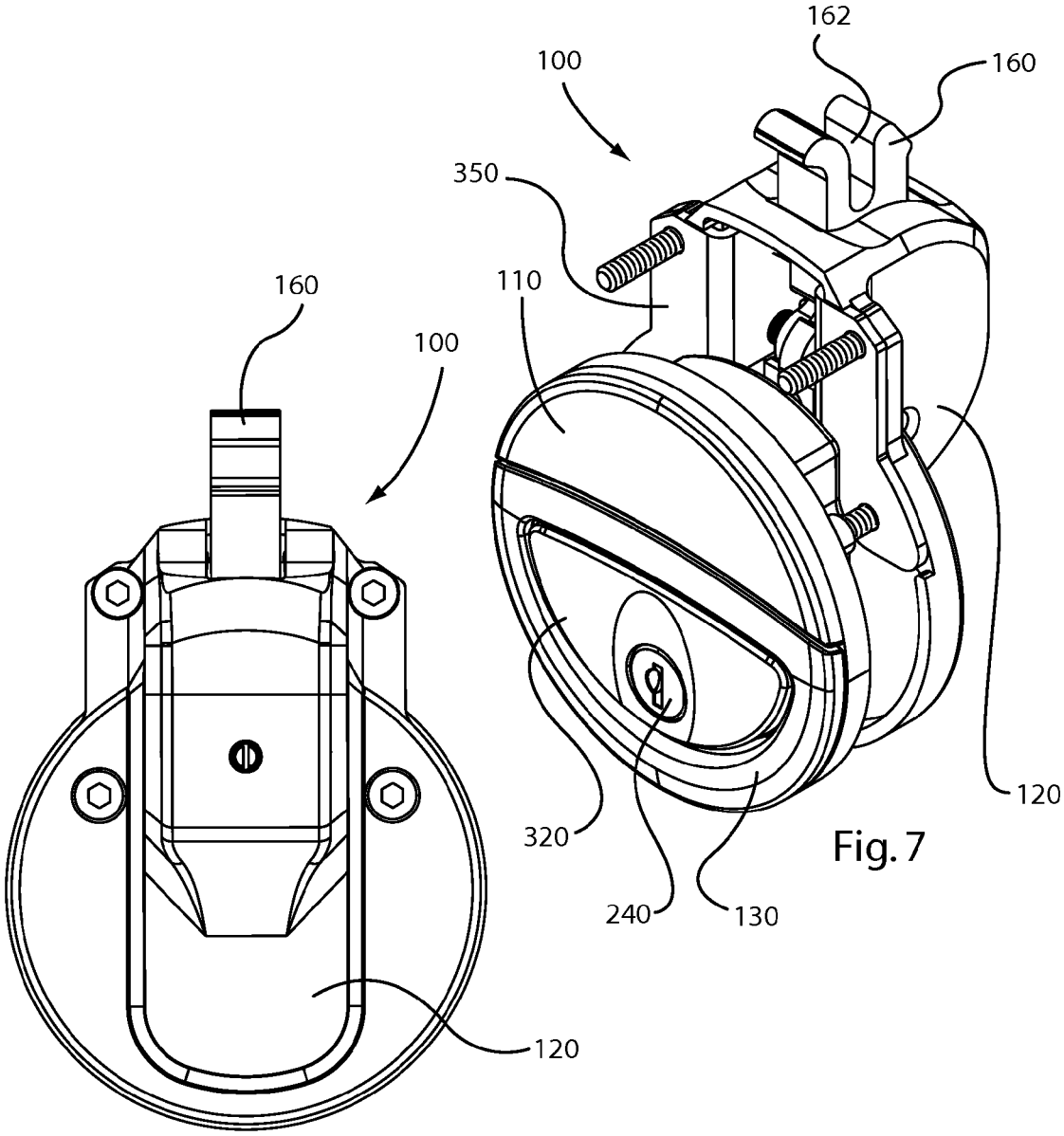
FIGS. 7-13 are views of a fully assembled latch according to the present invention shown with the handle folded down and the pawl in the latched position.
Figure 9:
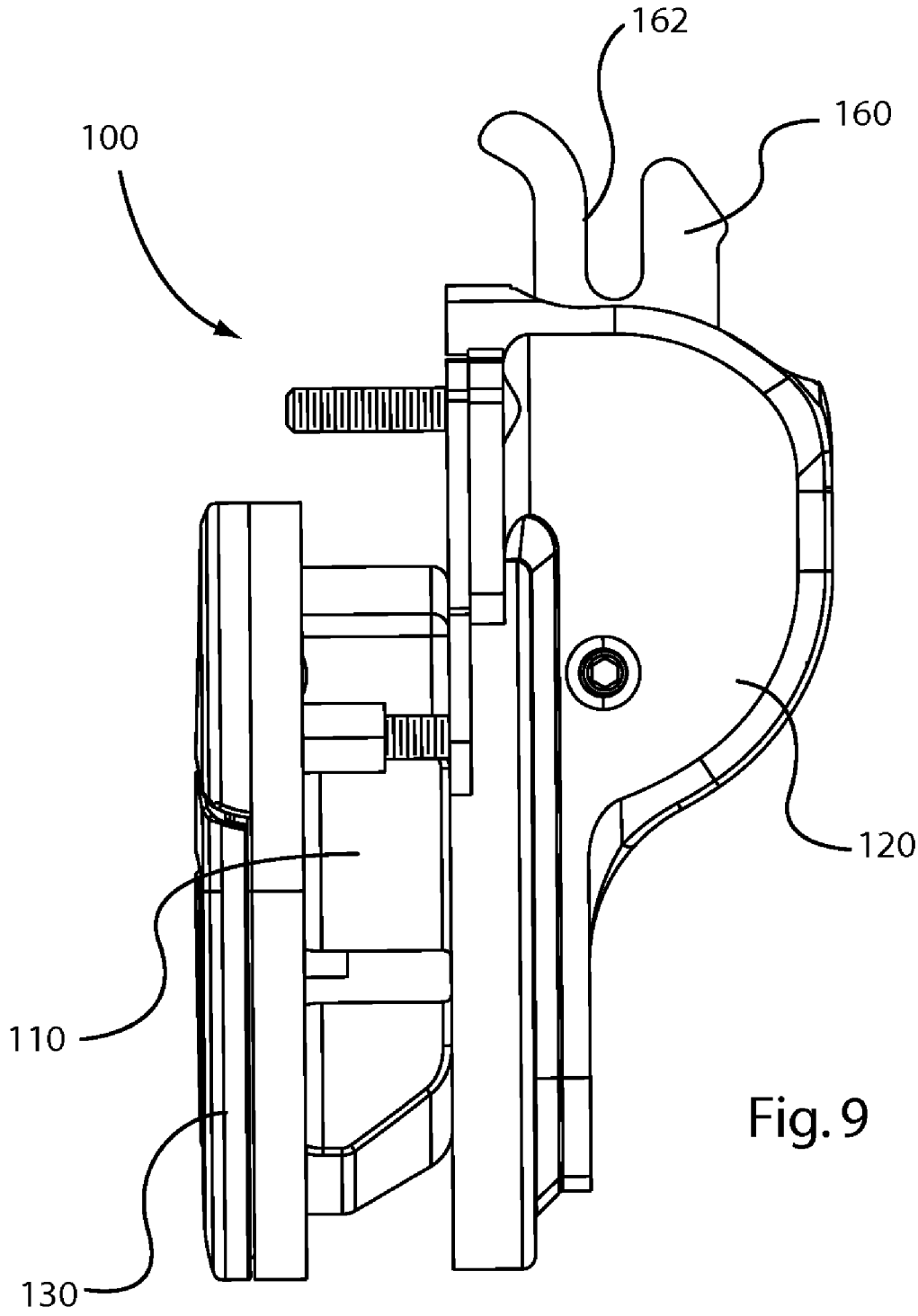
Figure 11:
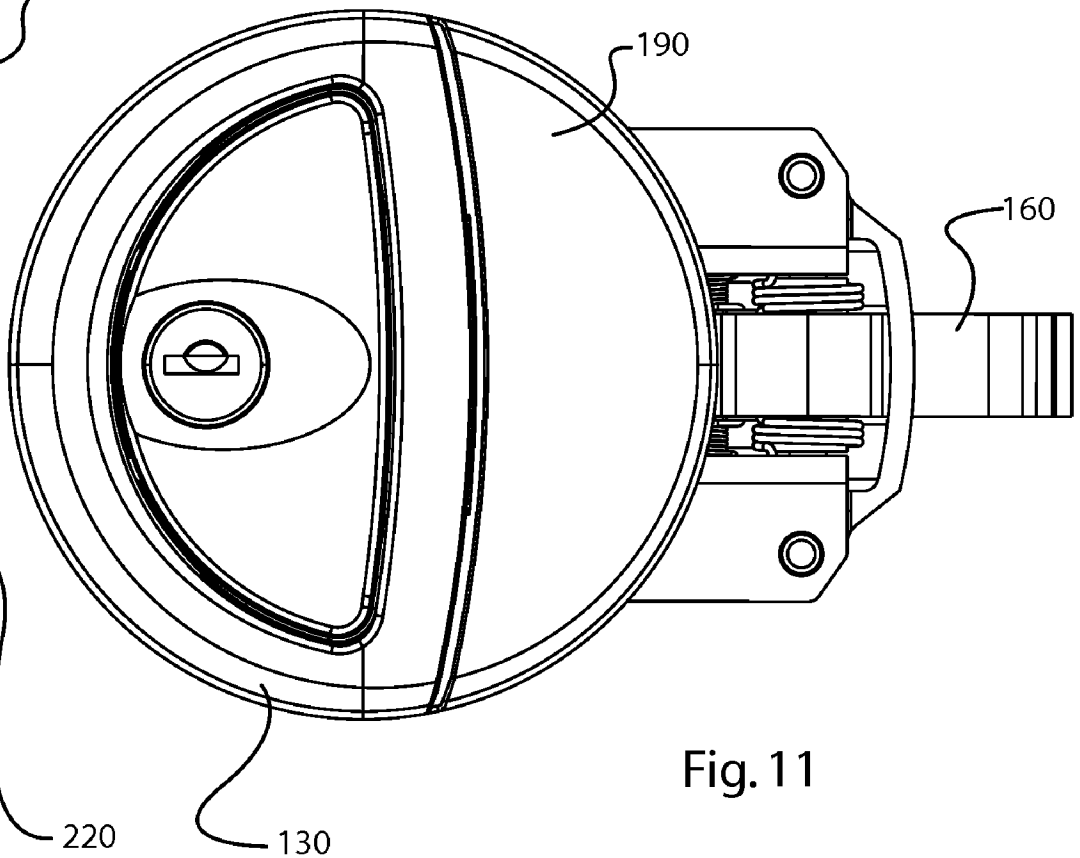
Figure 10:
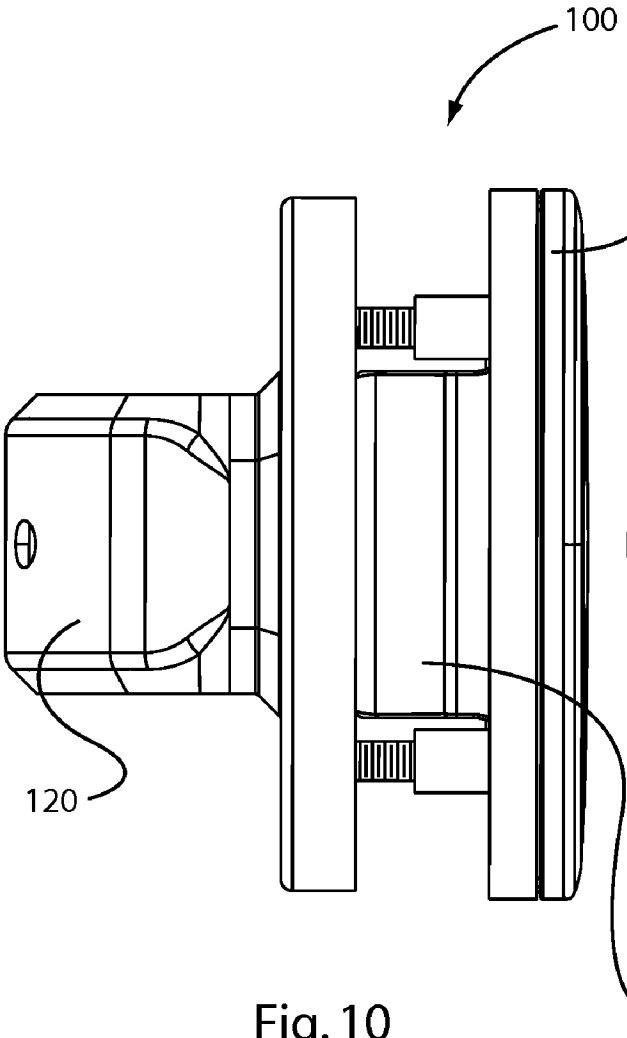
Figure 12:
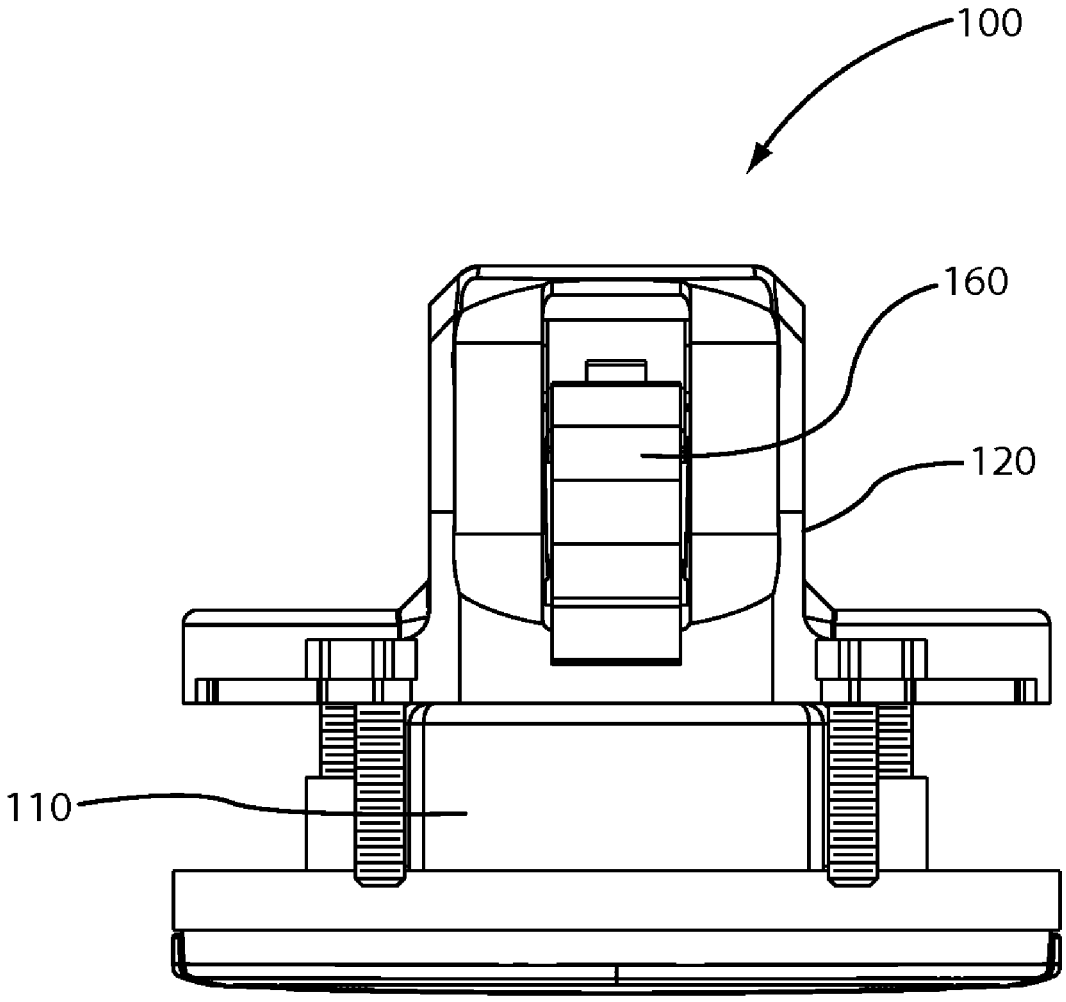
Figure 13:
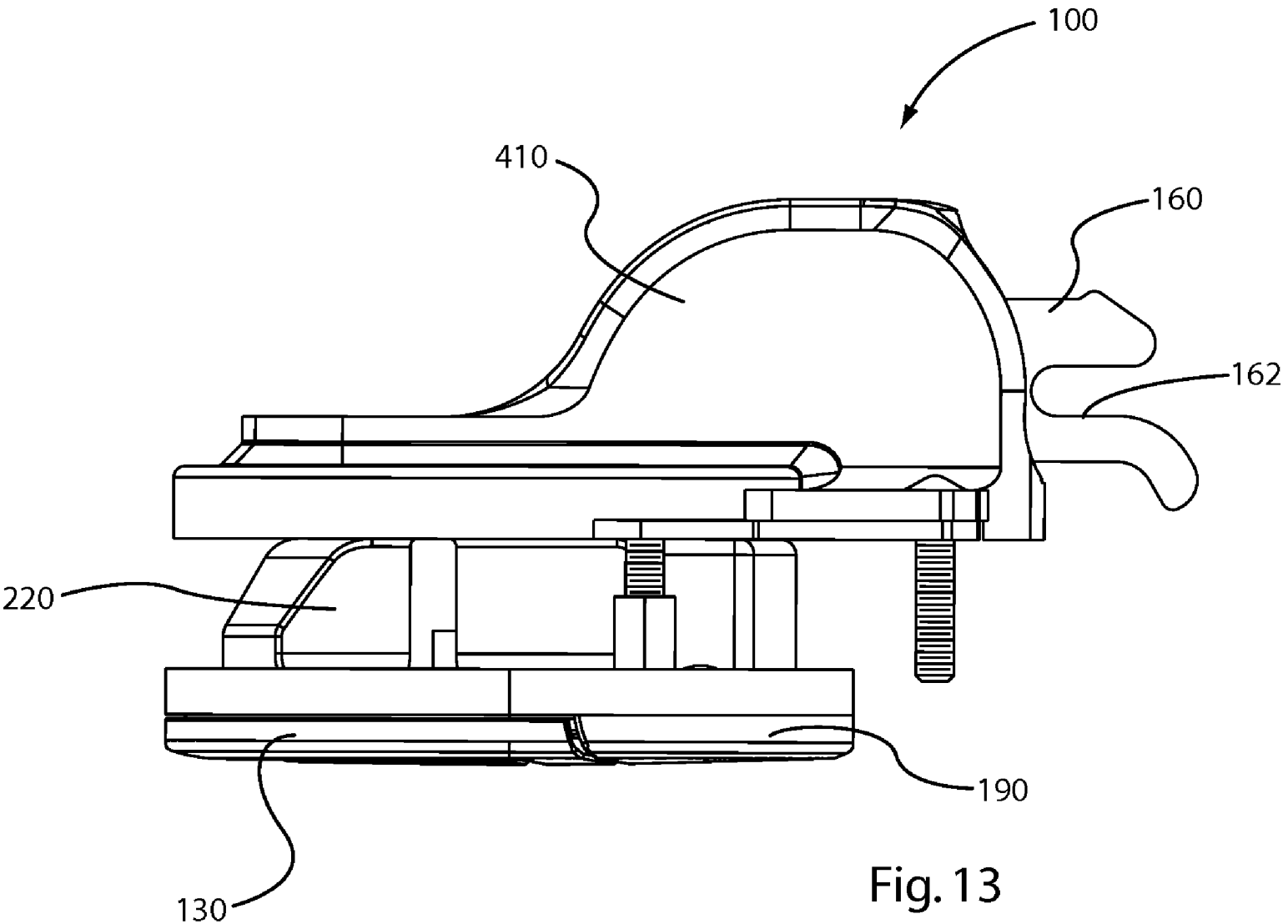
Figure 14:
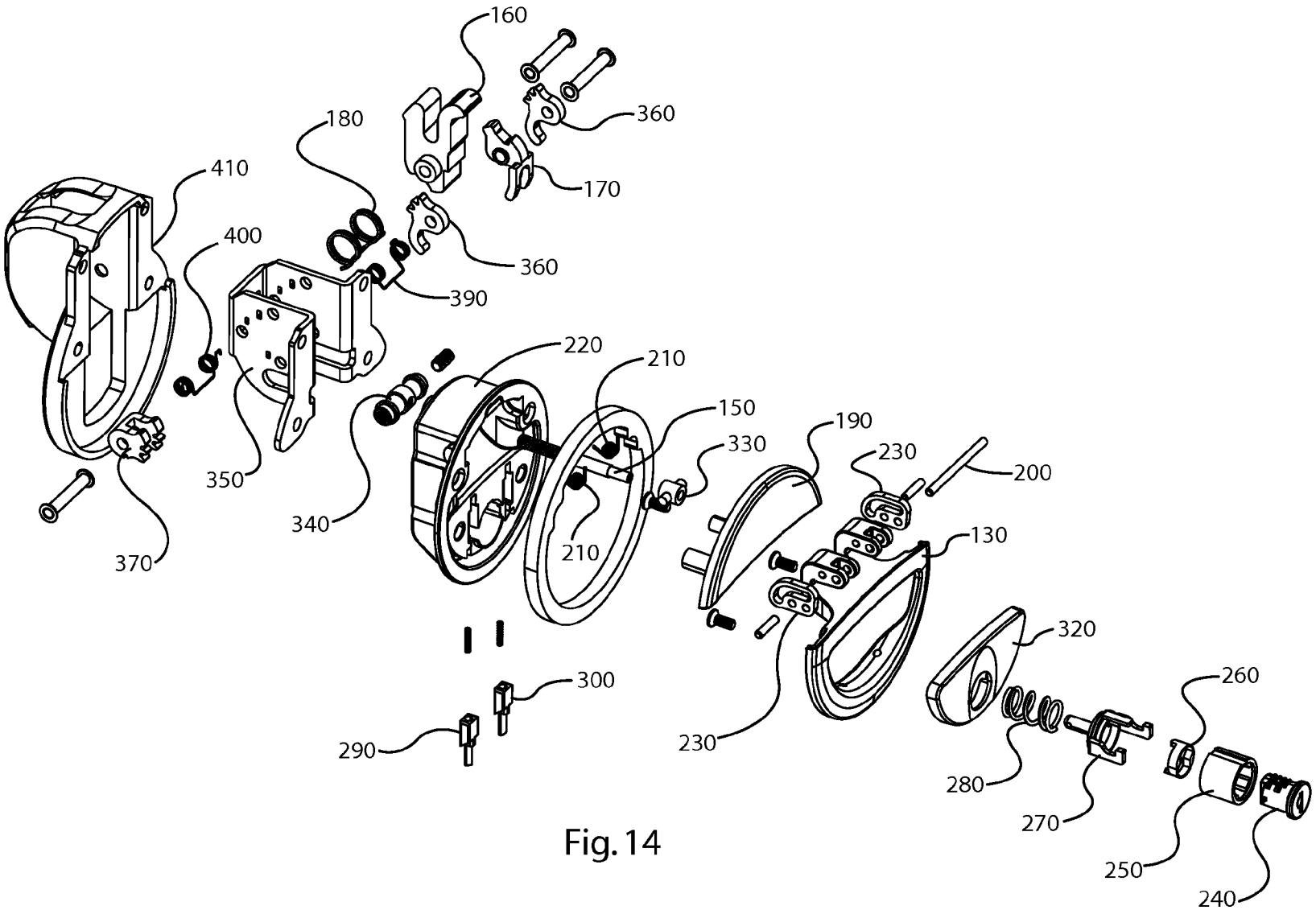
FIG. 14 is an exploded view of a latch according to the present invention.
Figure 15:
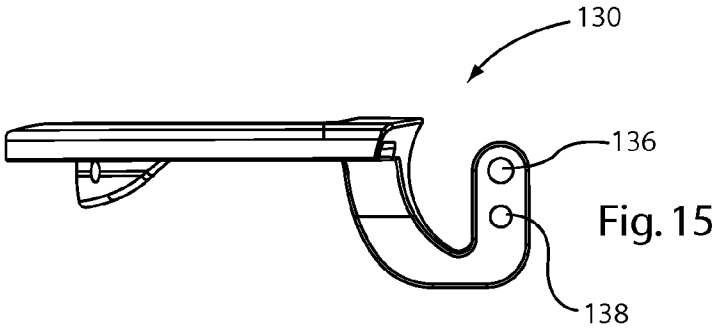
FIGS. 15-21 are views of the handle of a latch according to the present invention.
Figure 16:
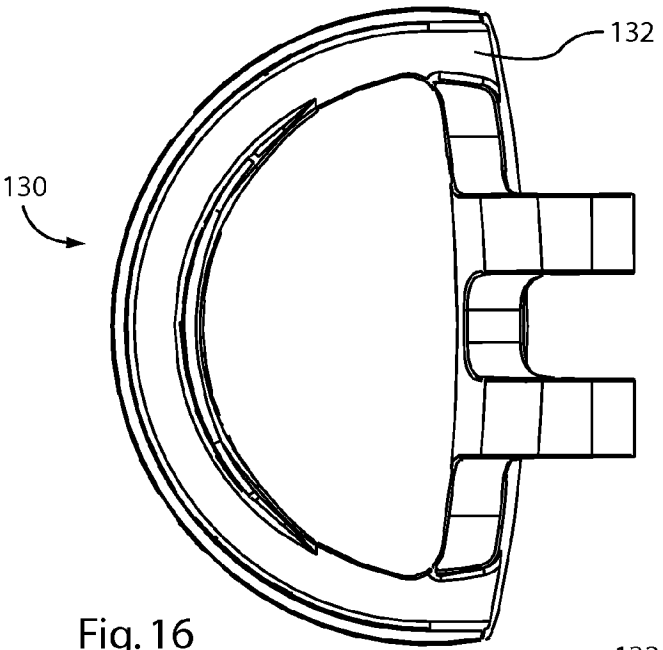
Figure 17:
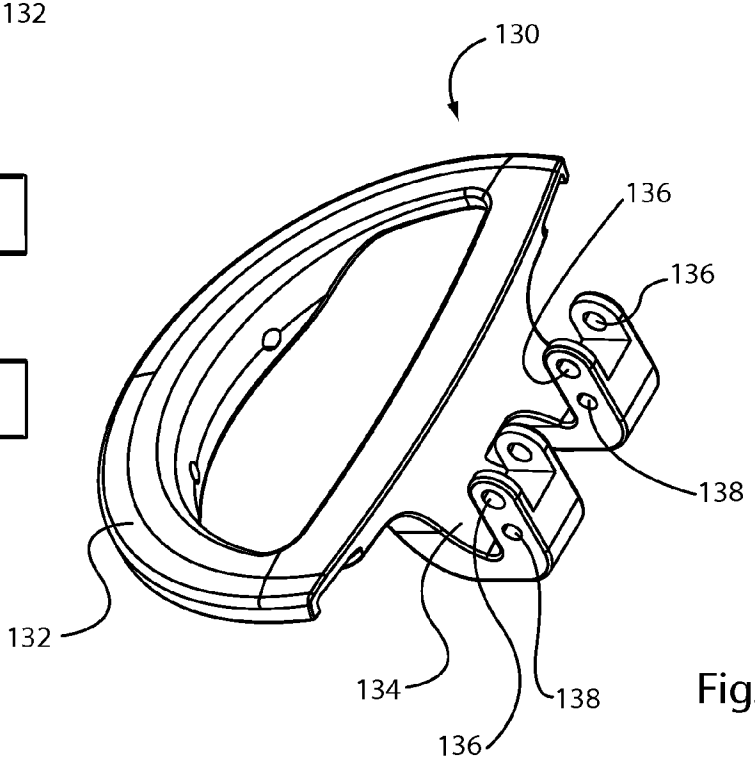
Figures 18, 19, 20, 21:
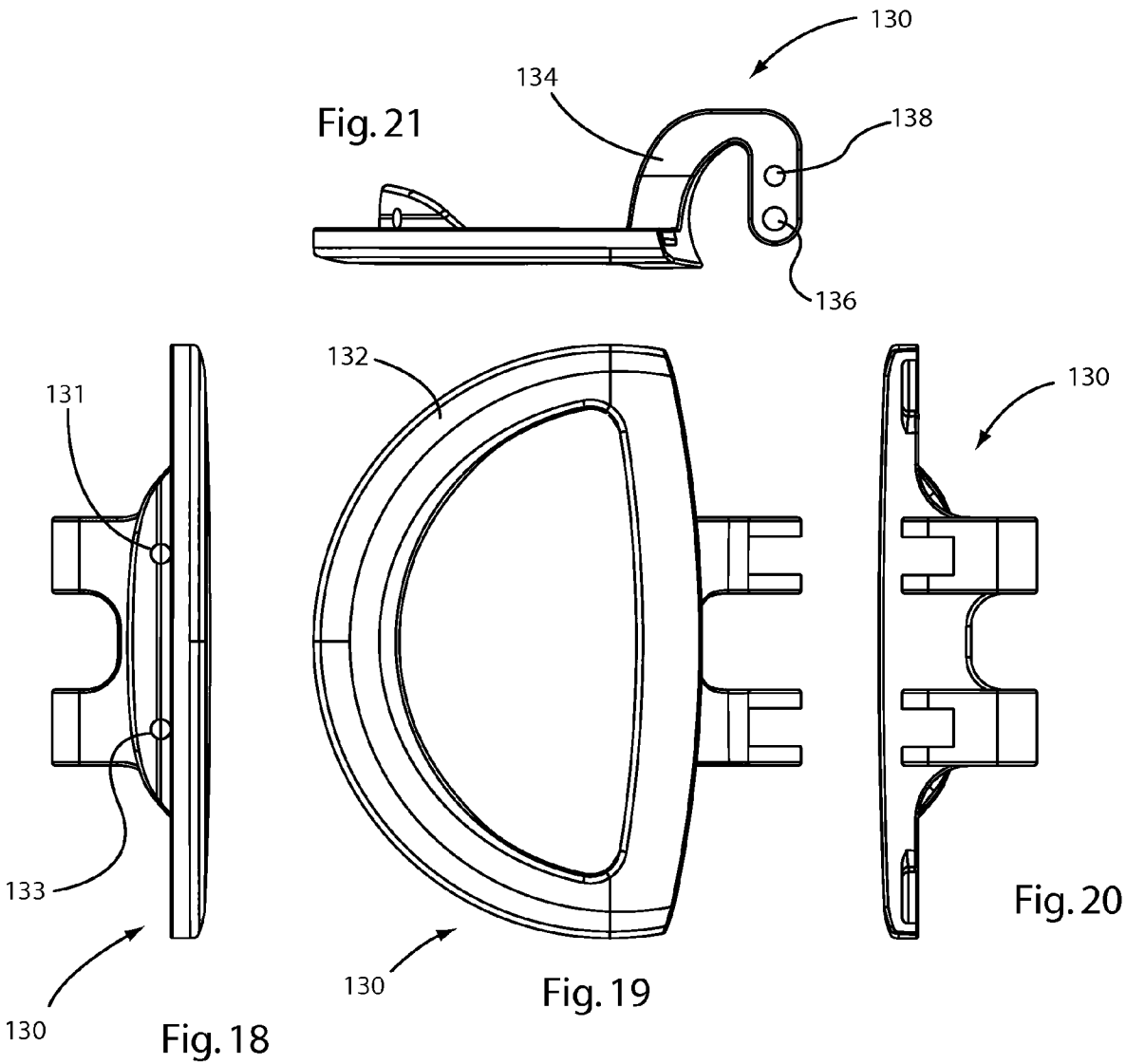
Figure 22:
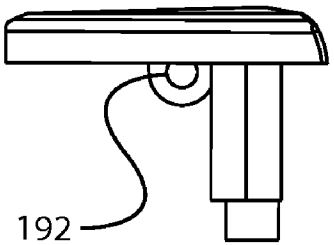
FIGS. 22-28 are views of the outer portion of the handle housing of a latch according to the present invention.
Figure 23:
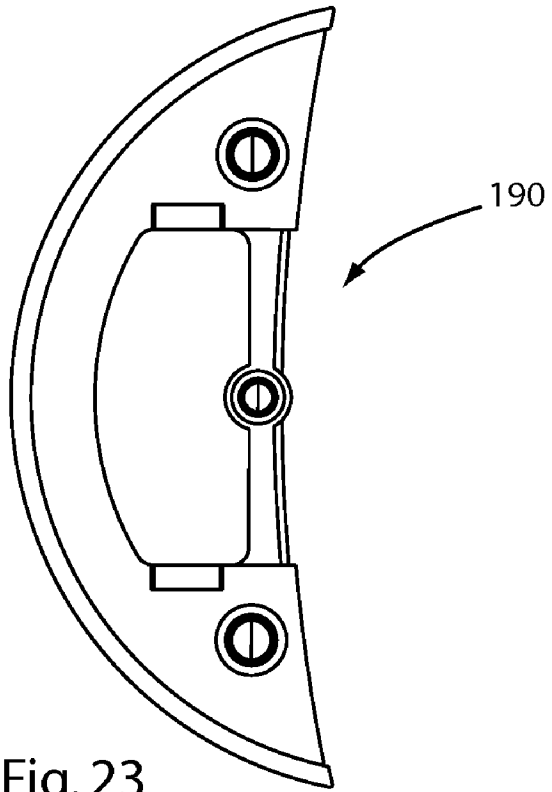
Figure 24:
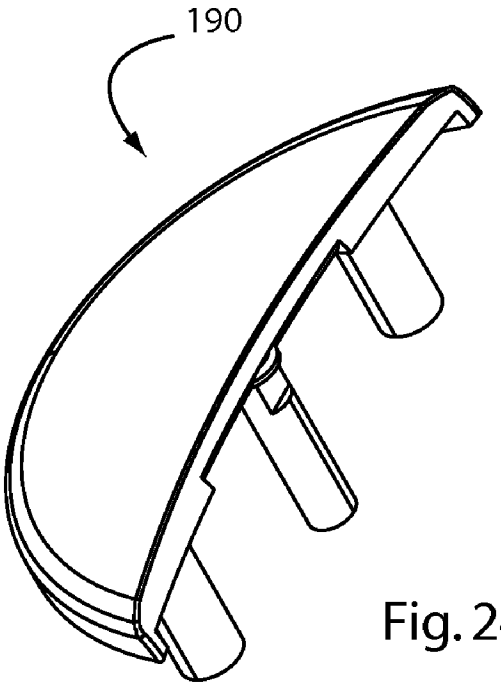
Figures 25, 26, 27, 28:
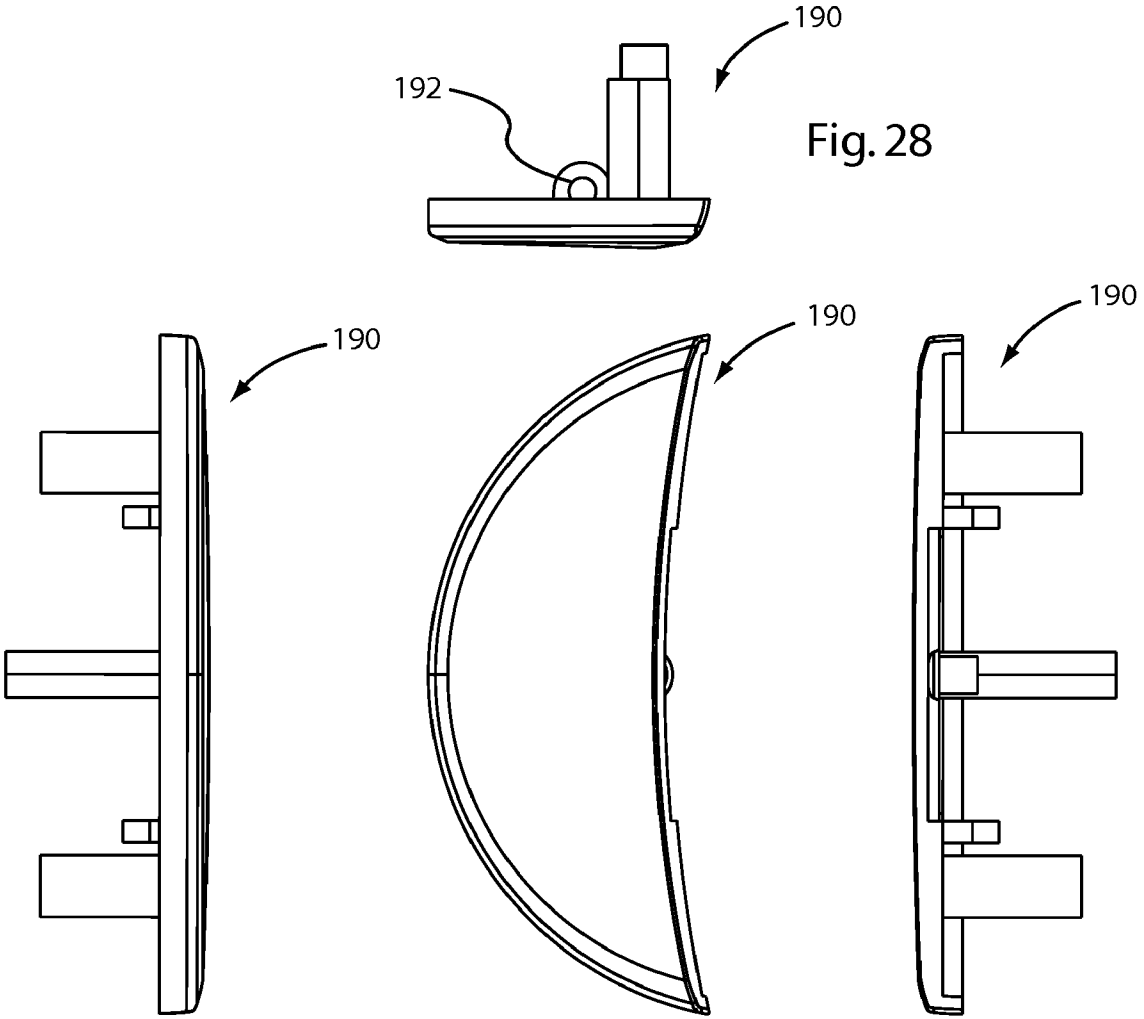
Figure 30:
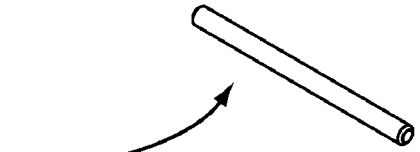
FIGS. 29-35 are views of the pivot pin that pivotally connects the handle to the handle housing of a latch according to the present invention.
Figure 34:
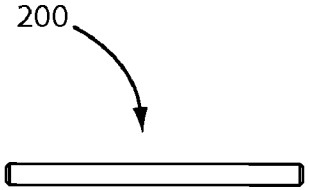
Figure 33:
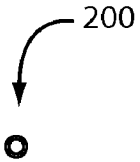
Figure 29:
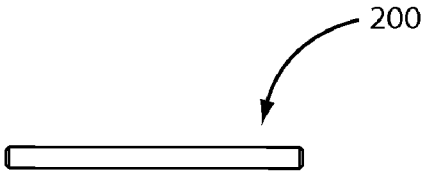
Figure 32:
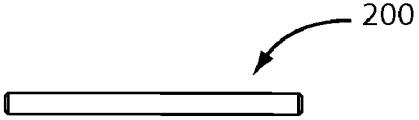
Figure 35:
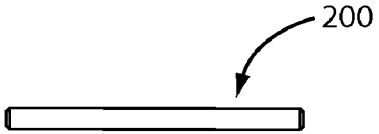
Figure 31:
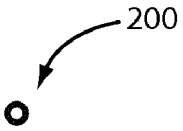
Figure 37:
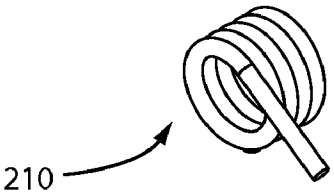
FIGS. 36-42 are views of a torsion spring used to bias the handle of a latch according to the present invention away from the folded-down position.
Figure 41:
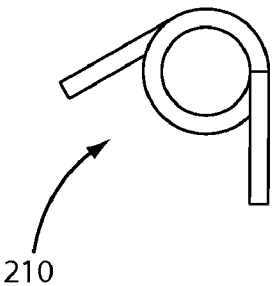
Figure 40:
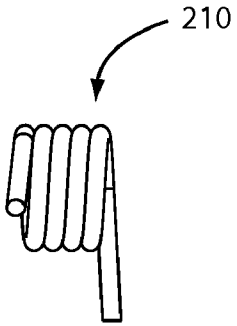
Figure 36:
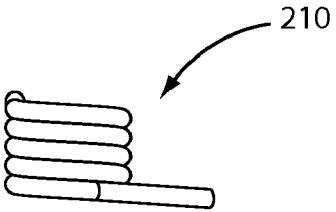
Figure 39:
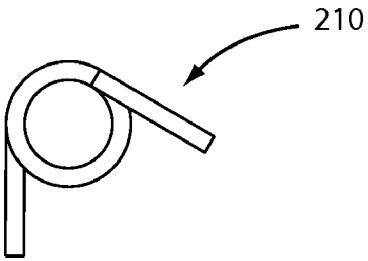
Figure 42:
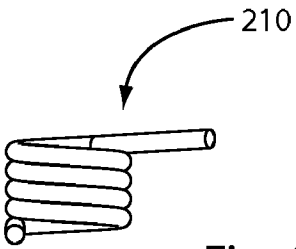
Figure 38:
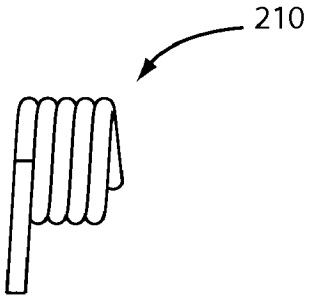
Figure 44:
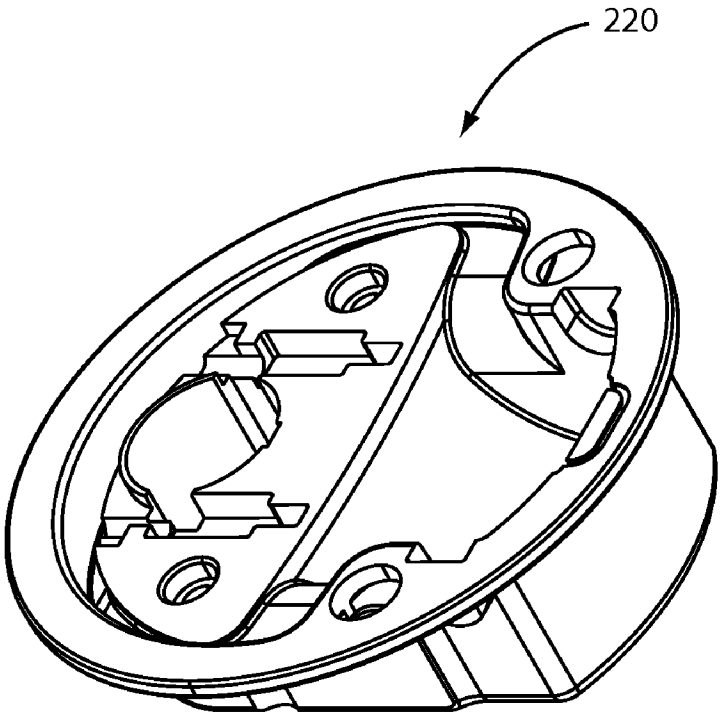
FIGS. 43-49 are views of the inner portion of the handle housing of a latch according to the present invention.
Figure 43:
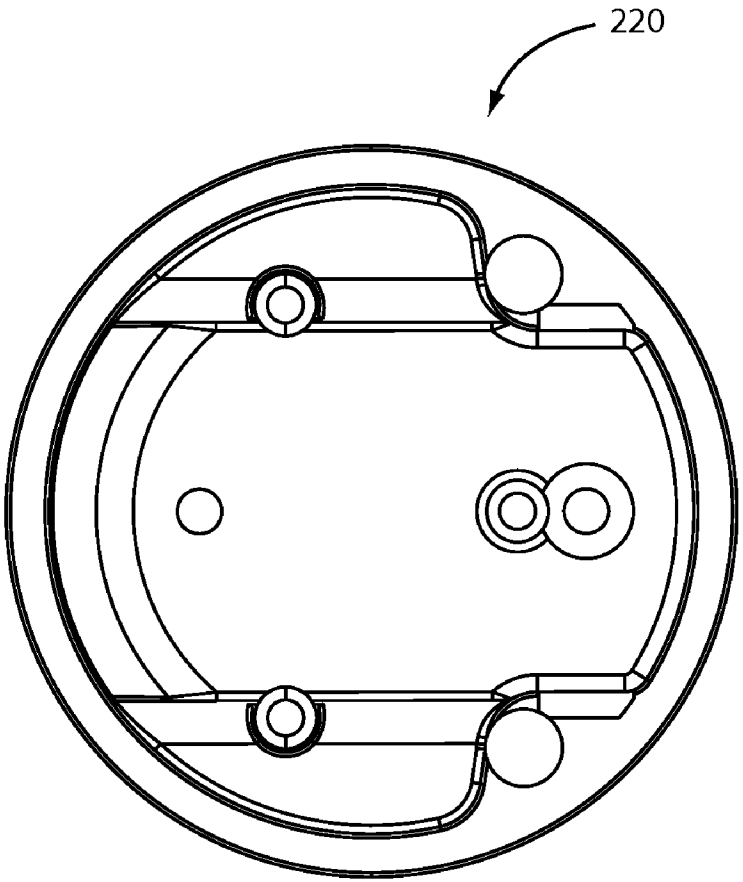
Figure 47:
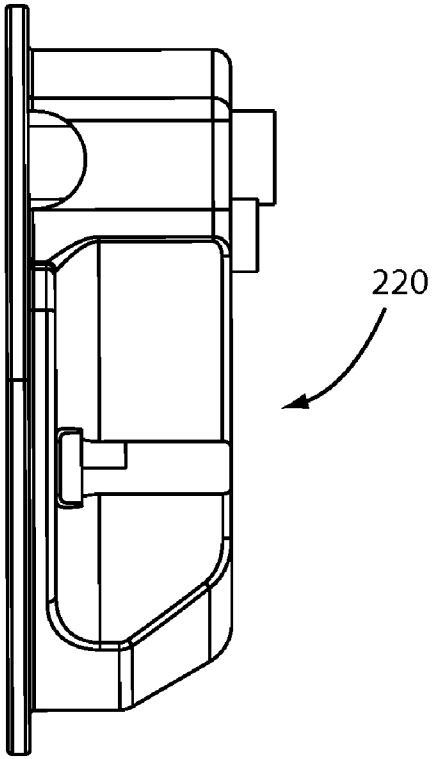
Figure 46:
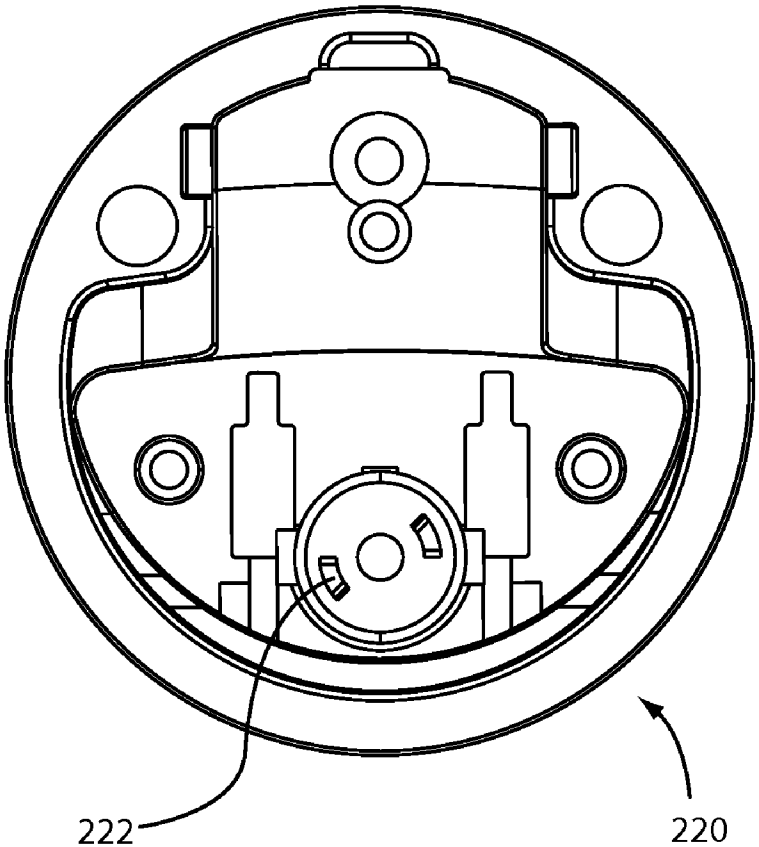
Figure 45:
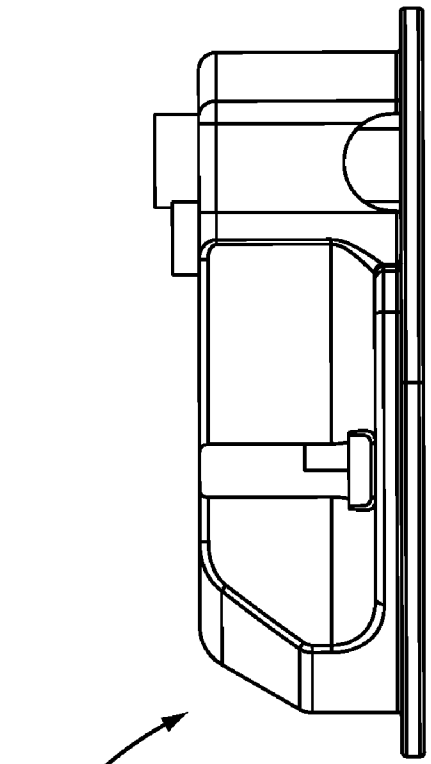
Figure 48:
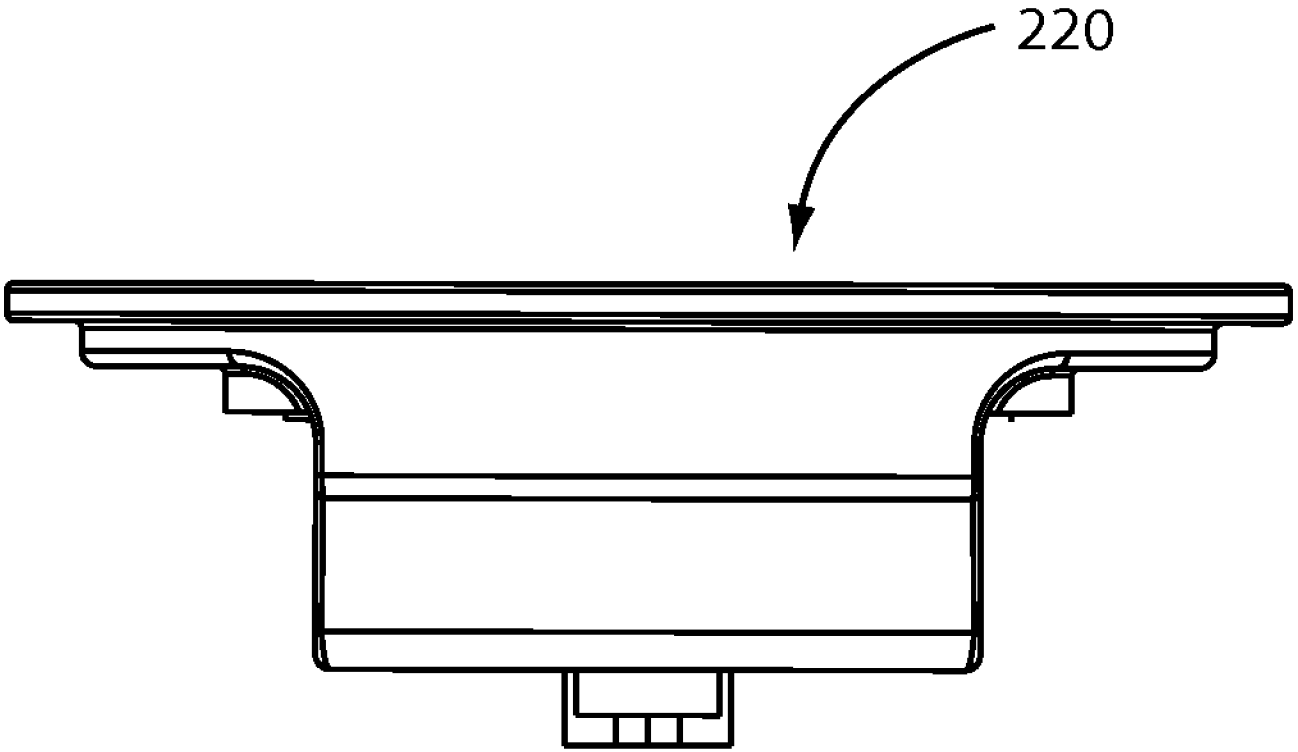
Figure 49:
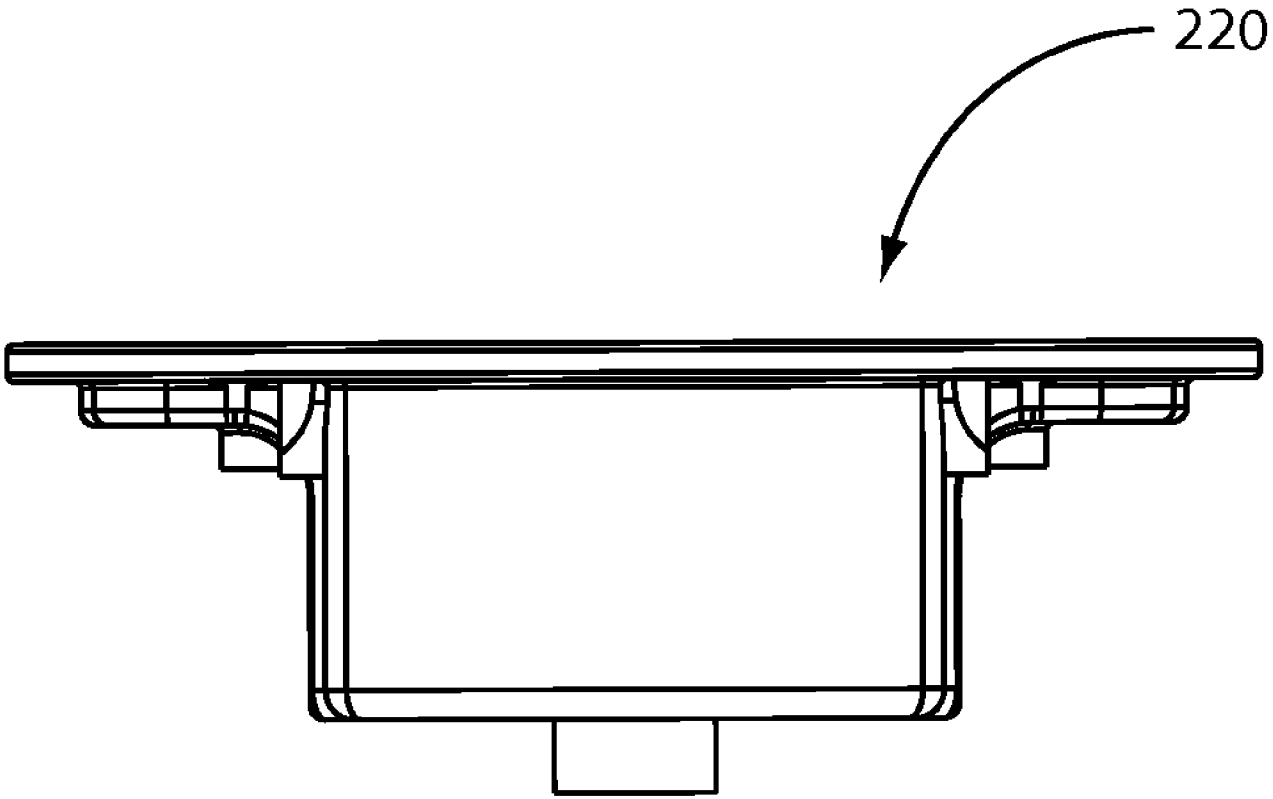
Figure 50:
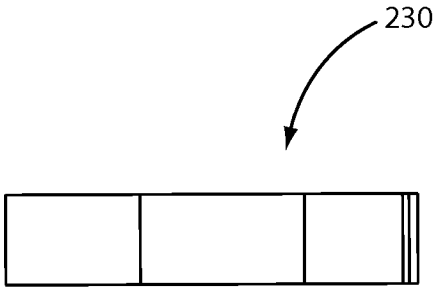
FIGS. 50-56 are views of the handle cam of a latch according to the present invention.
Figure 51:
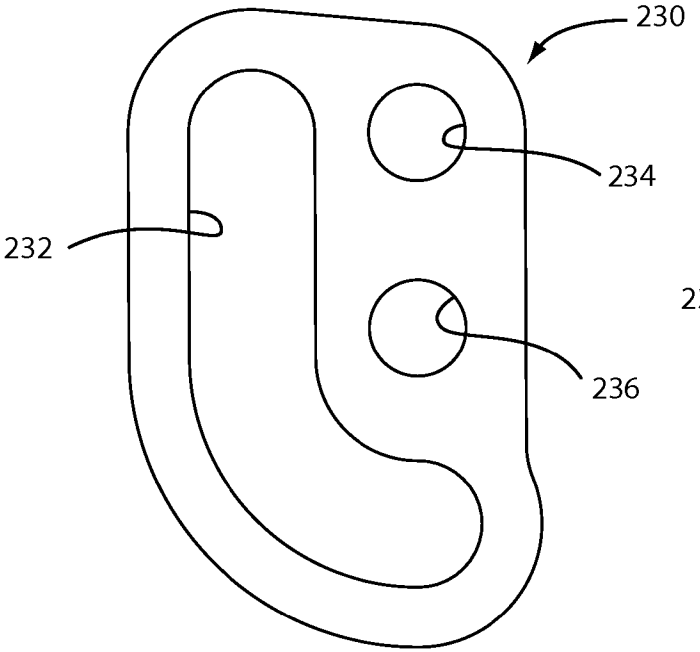
Figure 52:
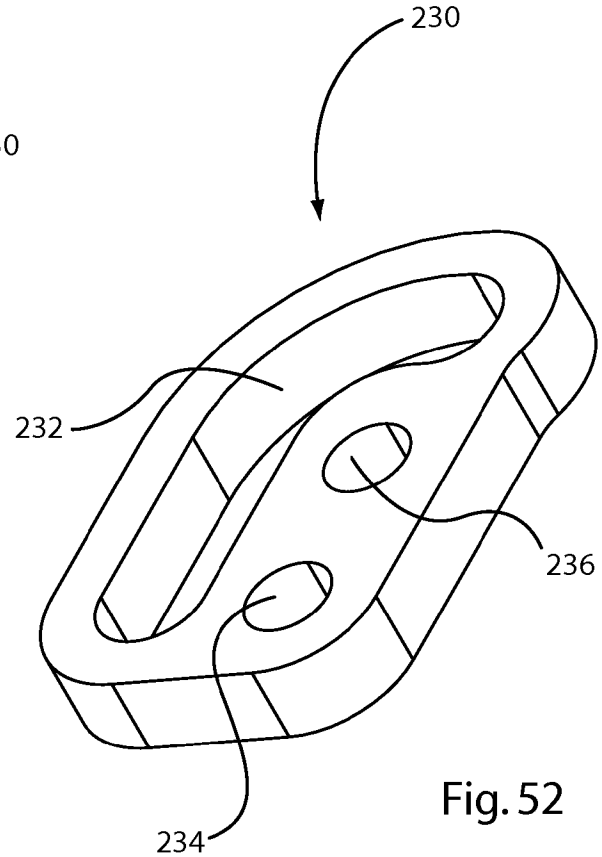
Figure 53:
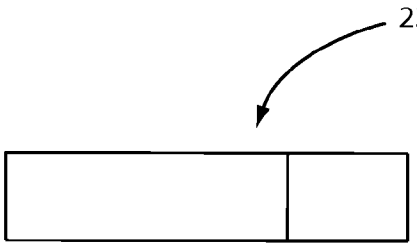
Figure 55:
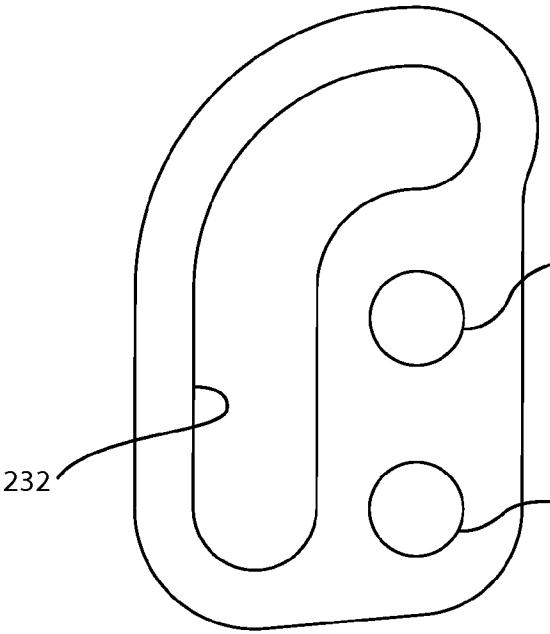
Figure 54:
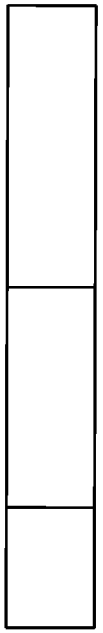
Figure 56:
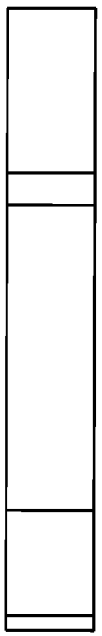
Figure 57:
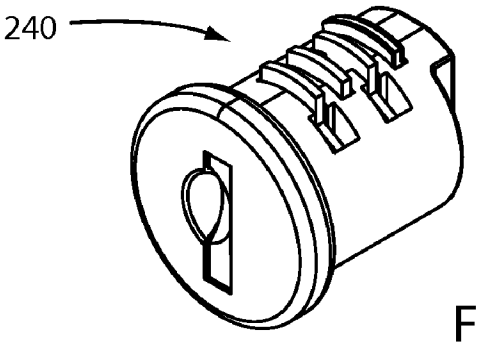
FIGS. 57-63 are views of the lock plug or cylinder lock of an embodiment of a latch according to the present invention.
Figure 59:
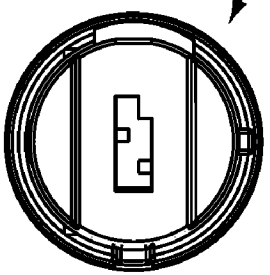
Figure 58:
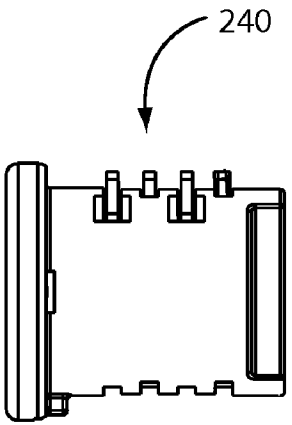
Figure 60:
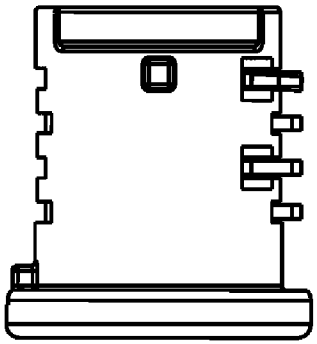
Figure 63:
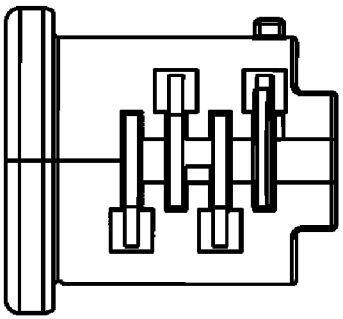
Figure 62:
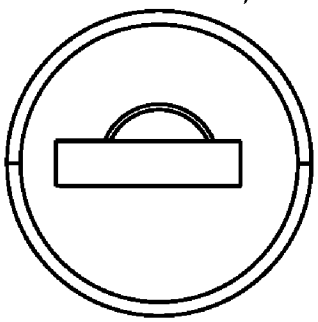
Figure 61:
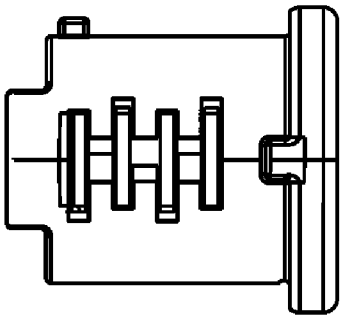
Figure 64:
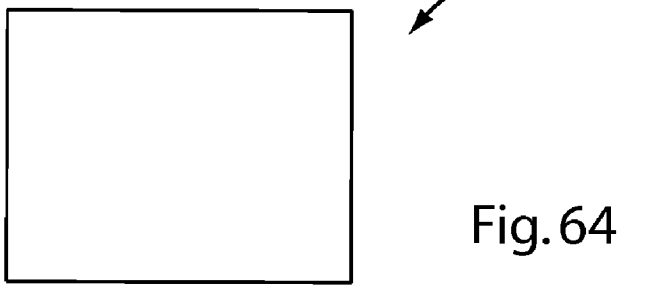
FIGS. 64-70 are views of the lock plug holder of a latch according to the present invention.
Figure 65:
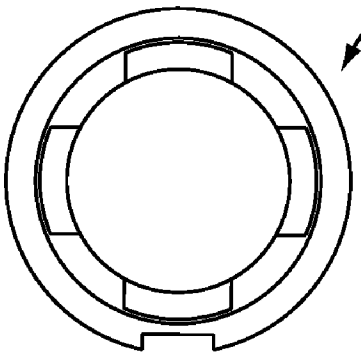
Figure 66:
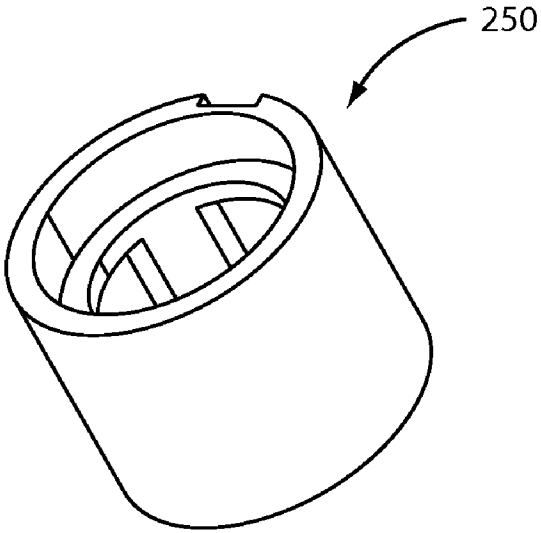
Figure 67:
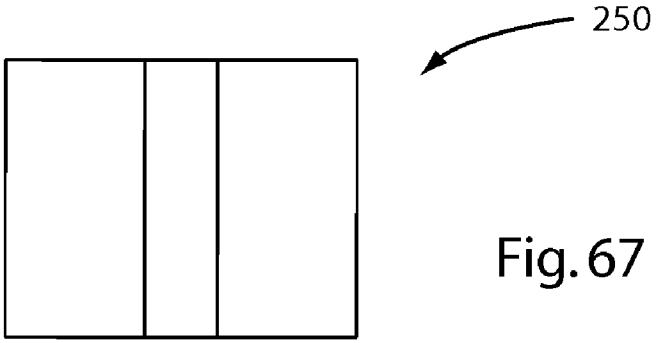
Figure 70:
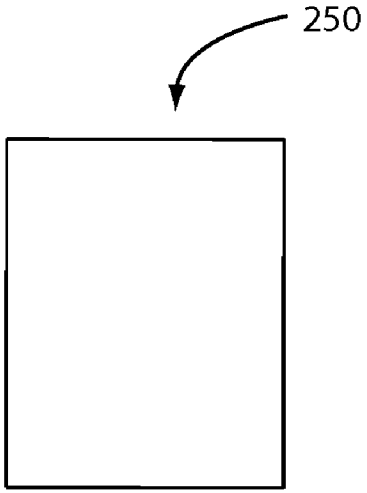
Figure 69:
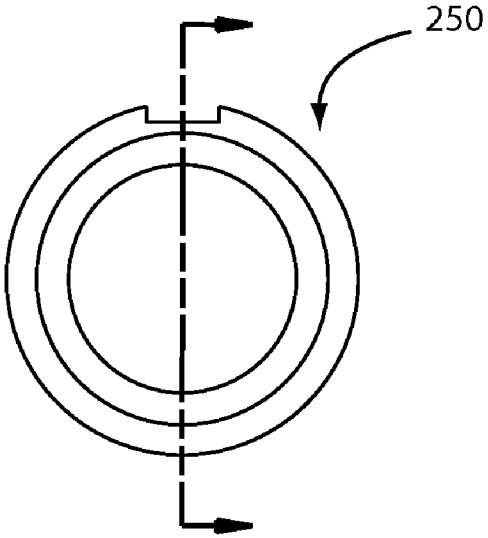
Figure 68:
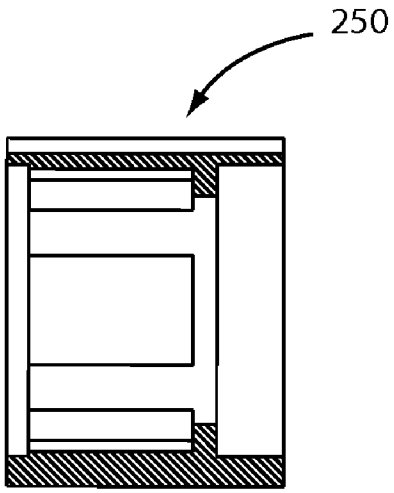
Figure 71:
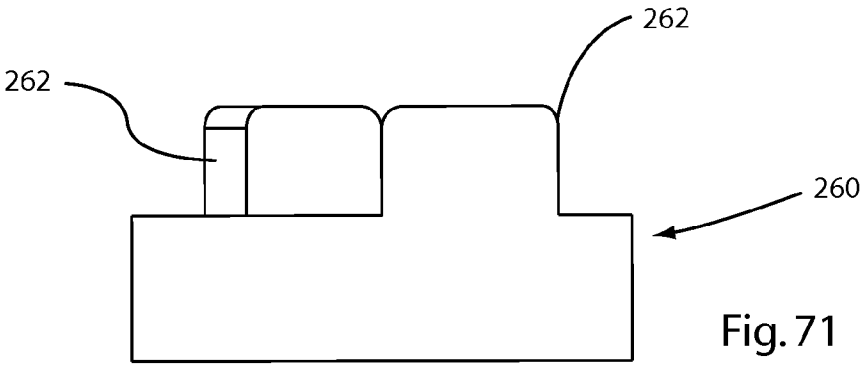
FIGS. 71-77 are views of a lock plug extension of a latch according to the present invention.
Figure 72:
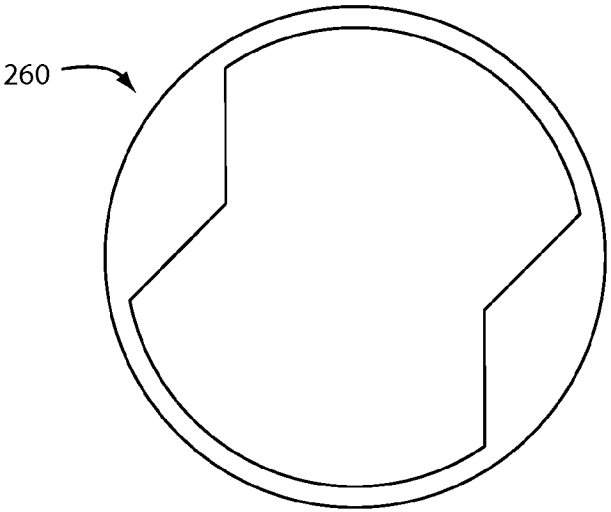
Figure 73:
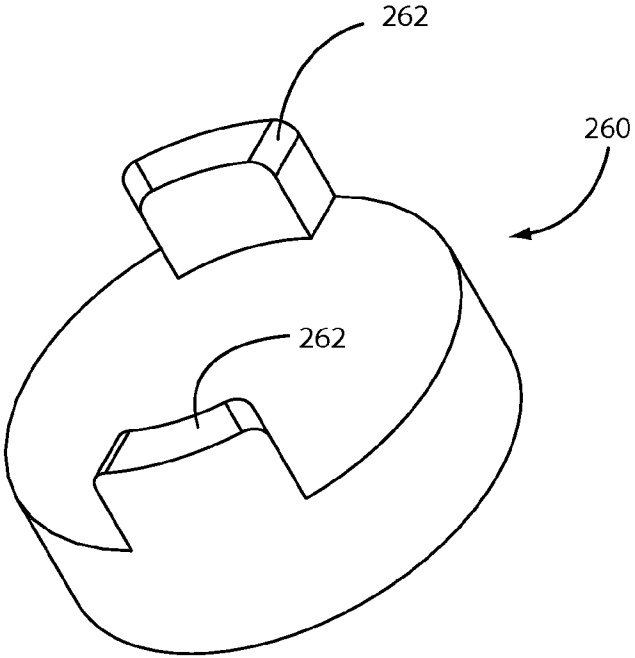
Figures 74, 75, 76, 77:
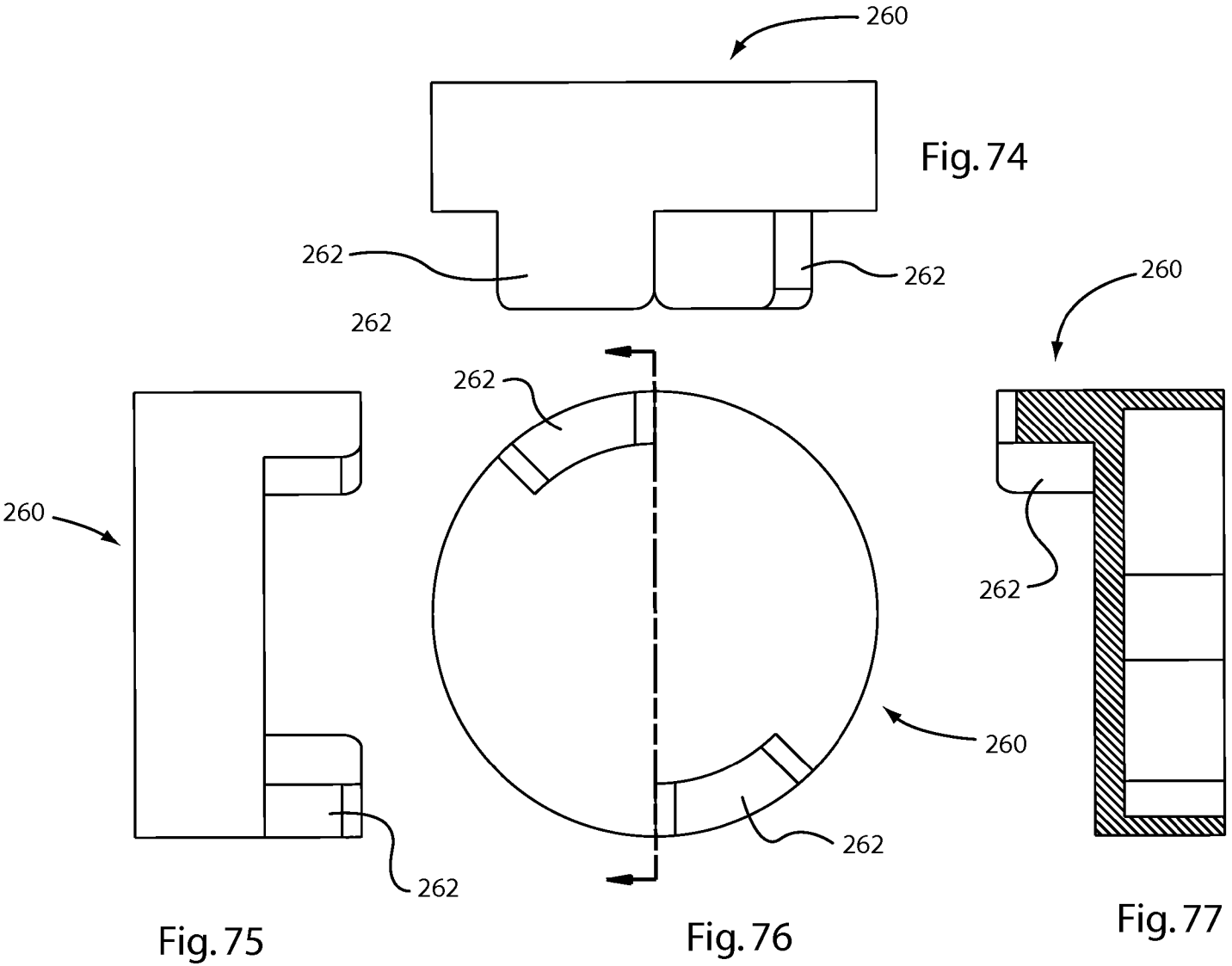
Figure 78:
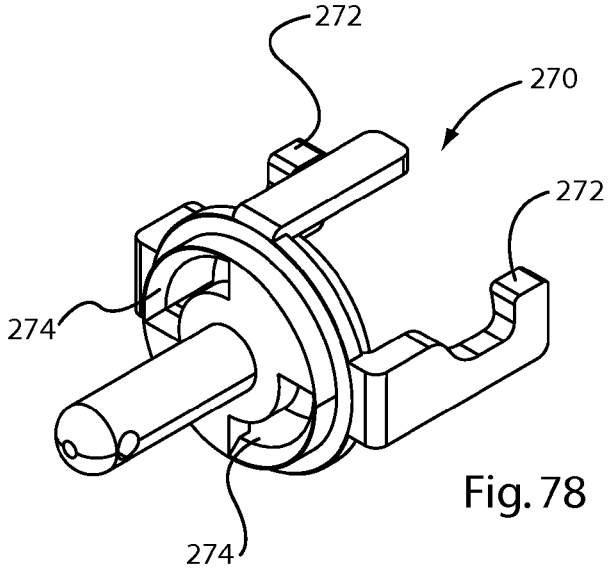
FIGS. 78-84 are views of a handle release actuator of a latch according to the present invention.
Figure 79:
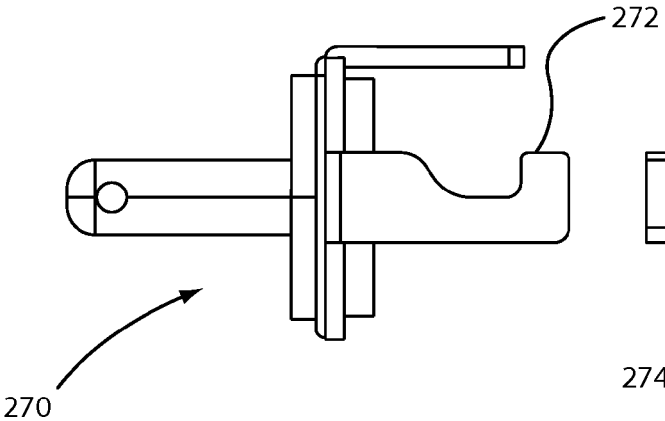
Figure 80:
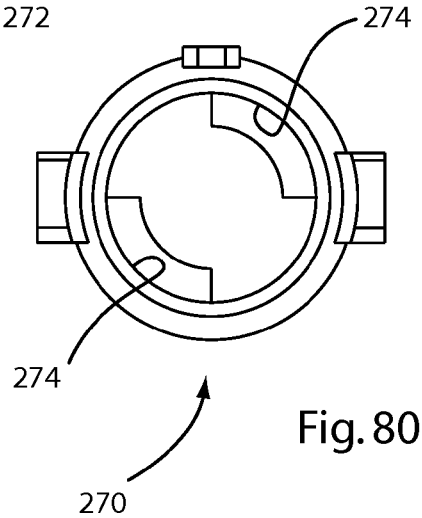
Figure 81:
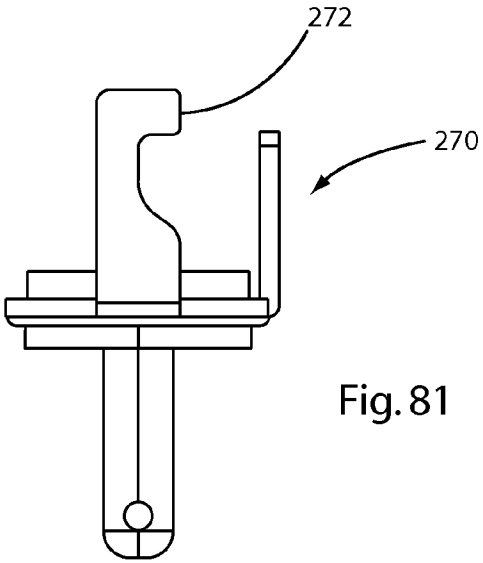
Figure 84:
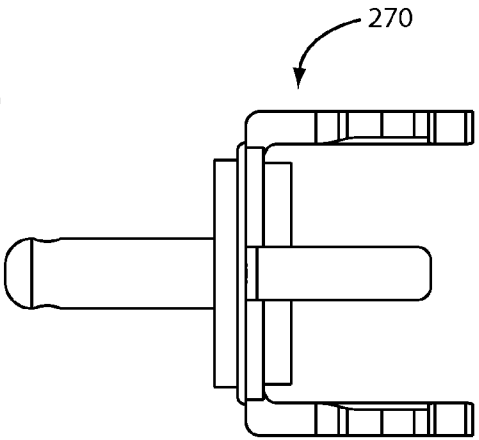
Figure 83:
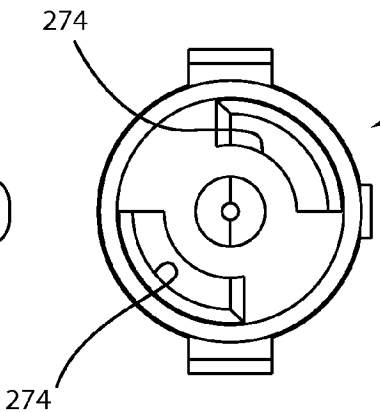
Figure 82:
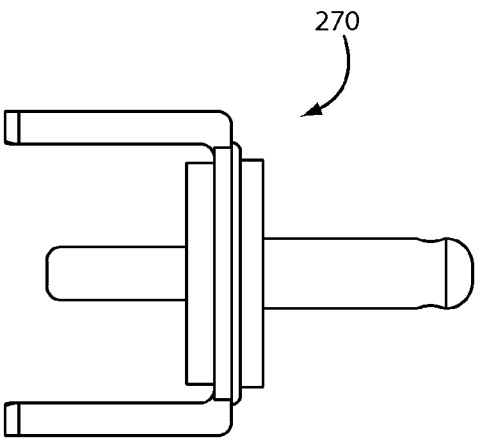
Figure 92:
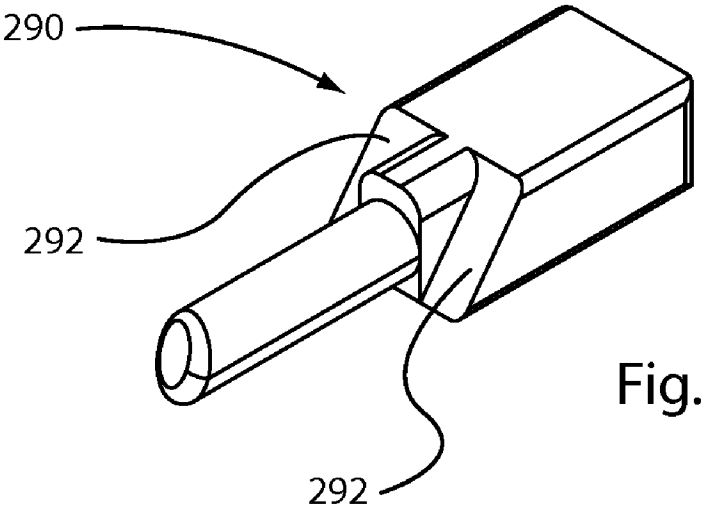
FIGS. 92-98 are views of one of the bolts (in this case the left-hand bolt) securing the handle in the folded-down position in a latch according to the present invention.
Figure 94:
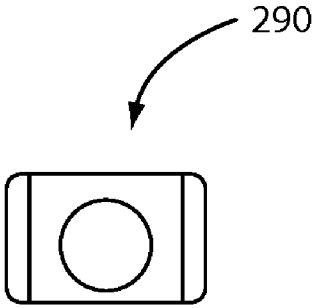
Figure 93:
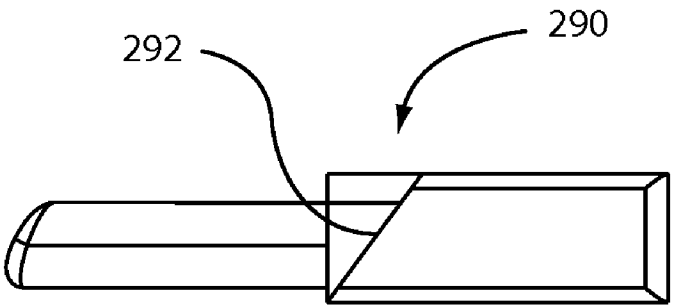
Figure 95:
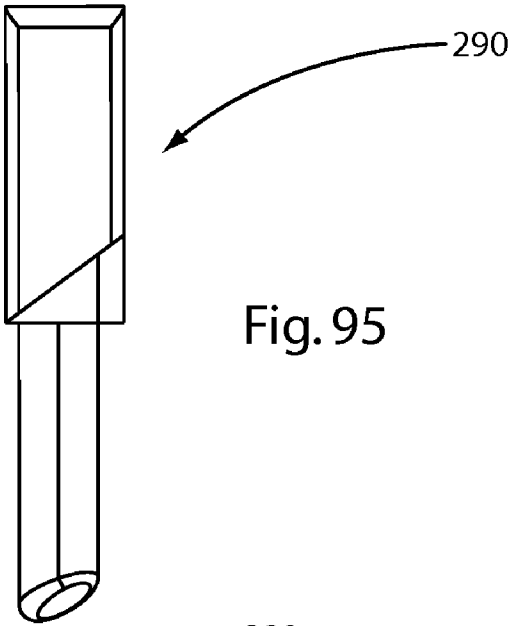
Figure 96:
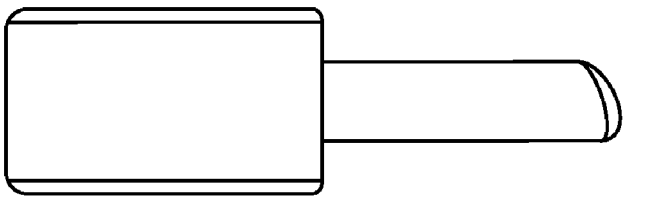
Figure 97:
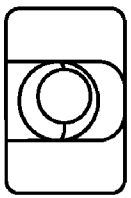
Figure 98:
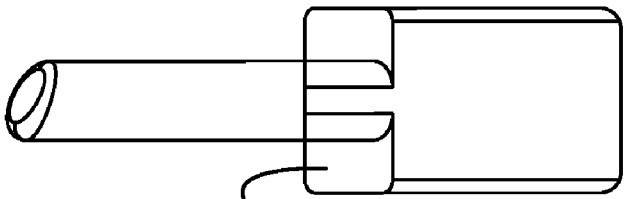
Figure 99:
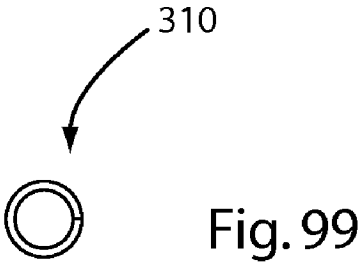
FIGS. 99-101 are views of the bolt spring used to bias a respective one of the bolts, used for securing the handle in the folded-down position, toward engagement with the handle in a latch according to the present invention.
Figure 100:
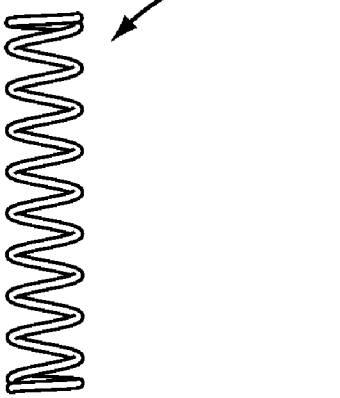
Figure 101:
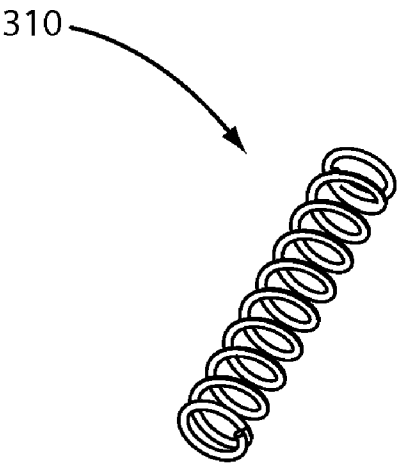
Figure 102:
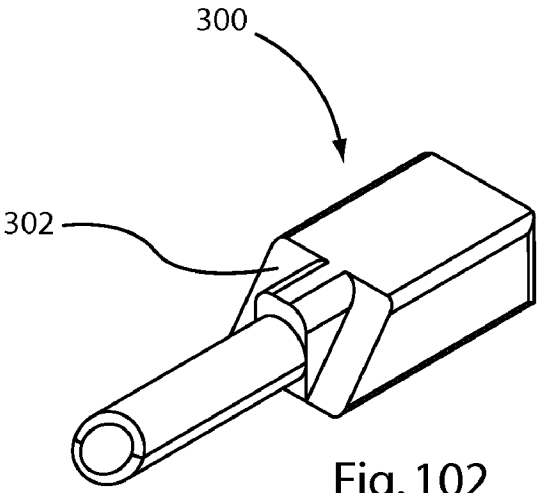
FIGS. 102-107 are views of one of the bolts (in this case the right-hand bolt) securing the handle in the folded-down position in a latch according to the present invention.
Figure 103A:
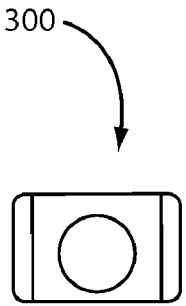
Figure 103:
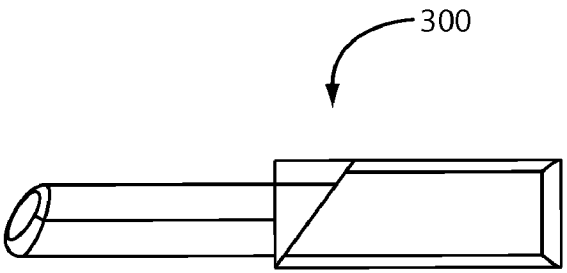
Figure 104:
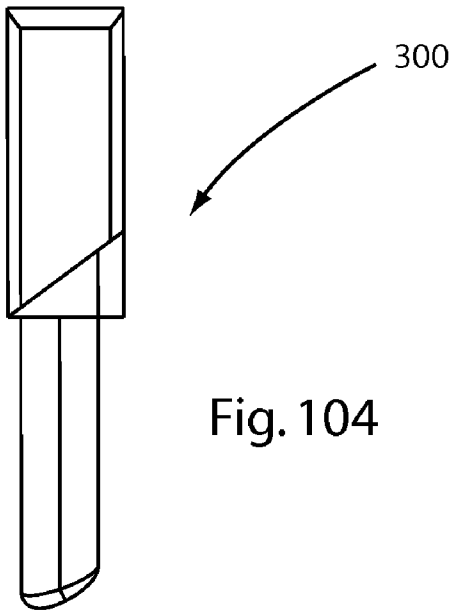
Figure 107:
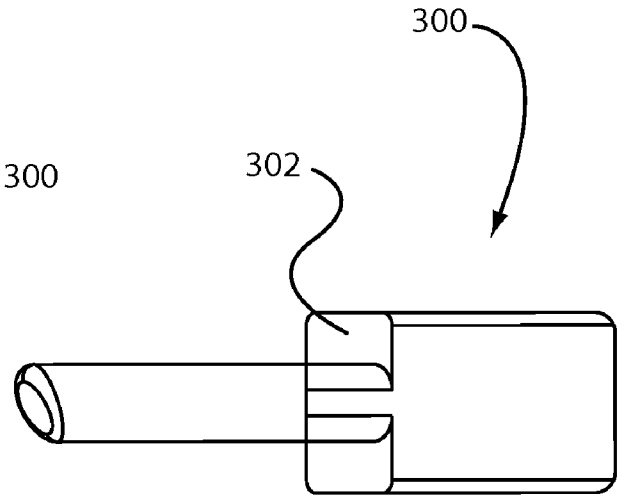
Figure 106:
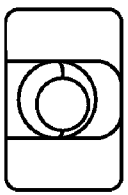
Figure 105:
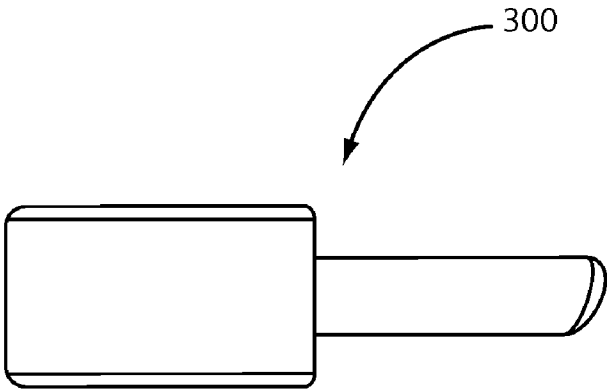
Figure 108:
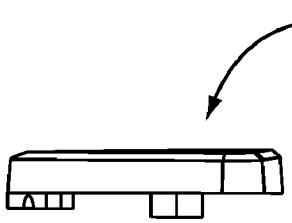
FIGS. 108-114 are views of the removable face plate of the handle housing of a latch according to the present invention, which allows stylistic changes to be made to the latch without having to retool completely to manufacture a stylistically different latch.
Figure 109:
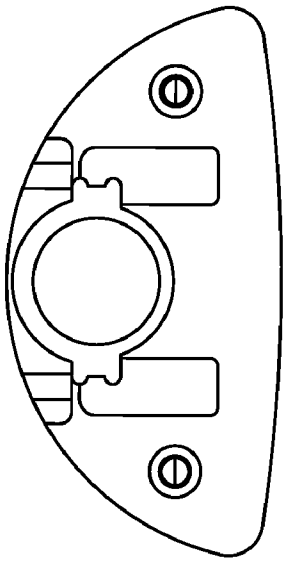
Figure 110:
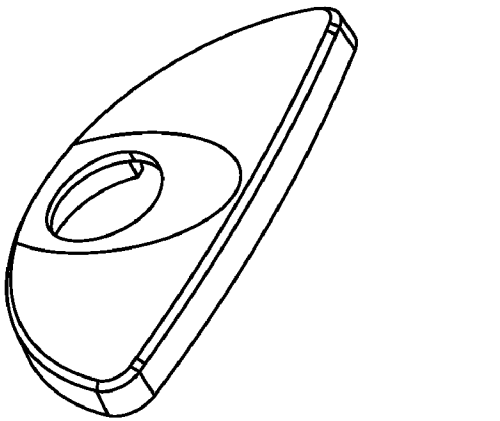
Figure 111:
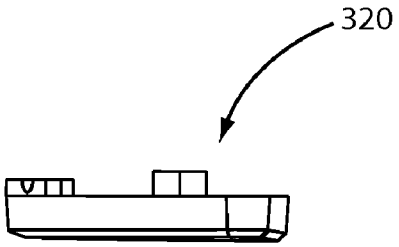
Figure 113:
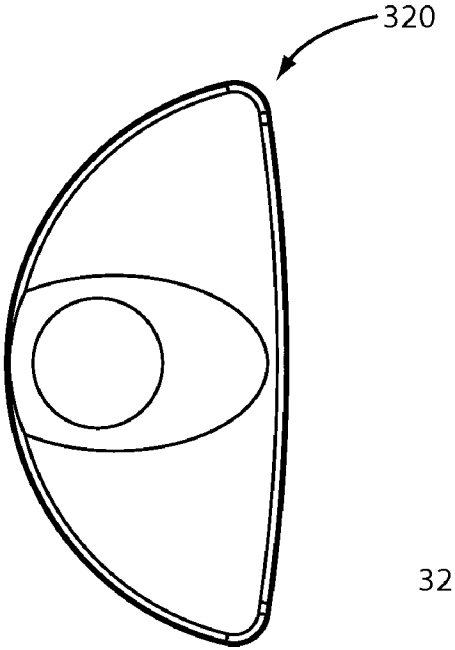
Figure 112:
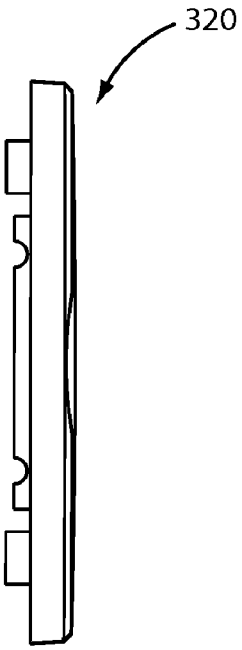
Figure 114:
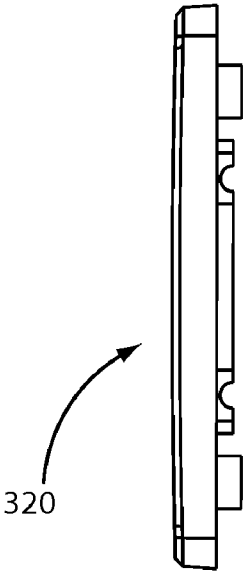
Figure 116:
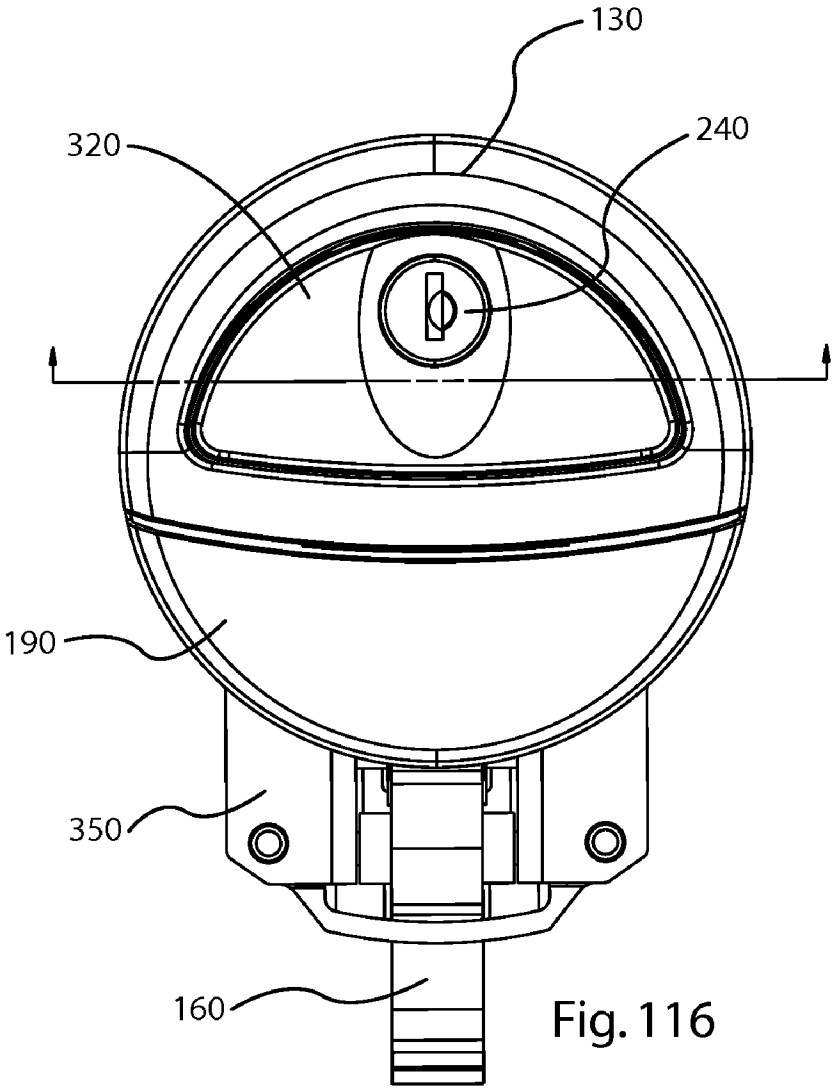
FIG. 116 is a top plan view of a latch according to the present invention showing the cut line along which the cross section of FIG. 115 was taken.
Figure 115:
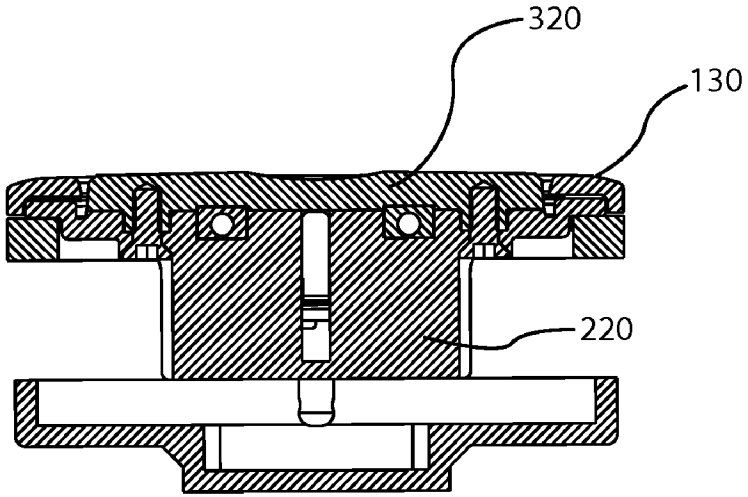
FIG. 115 is a cross sectional view of a latch according to the present invention along the cut line shown in FIG. 116 to illustrate the installation of the removable face plate of the latch.
Figure 118:
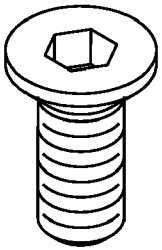
FIGS. 117-122 are views of a fastener for attaching the removable face plate of the latch according to the present invention.
Figure 121:
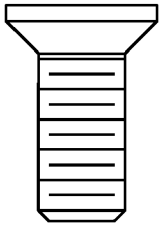
Figure 120:
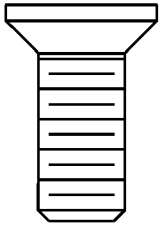
Figure 117:
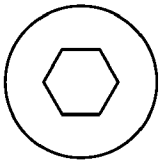
Figure 119:
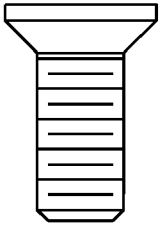
Figure 122:
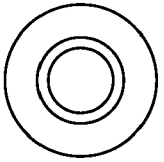
Figure 123:
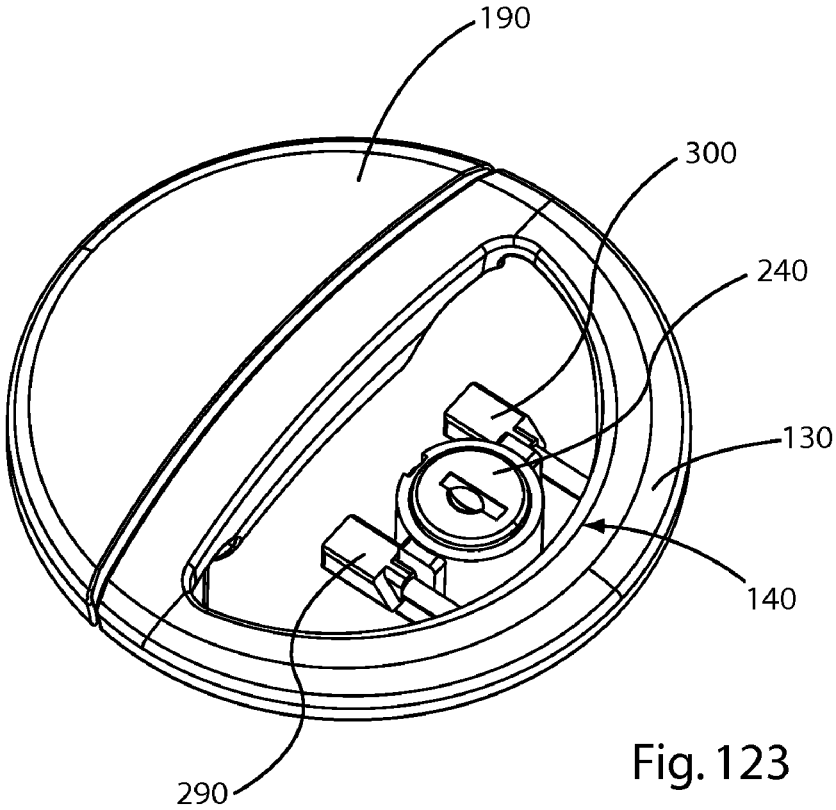
FIGS. 123-126 are fragmentary views showing the interaction of the lock plug, the handle release actuator and the bolts use to secure the handle in the folded-down position.
Figure 124:
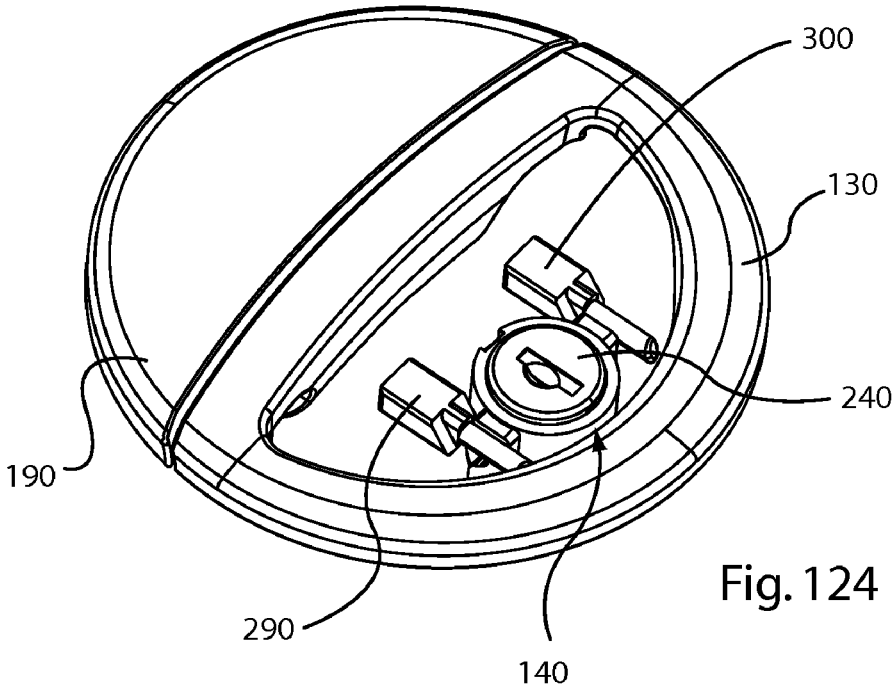
Figure 125:
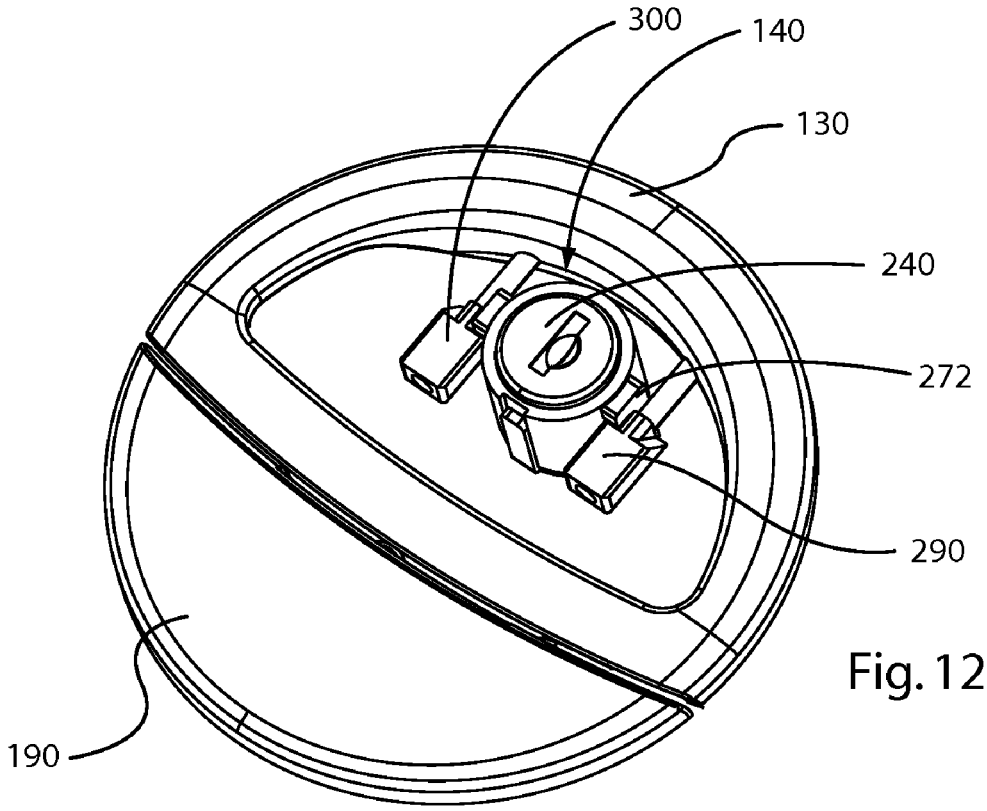
Figure 126:
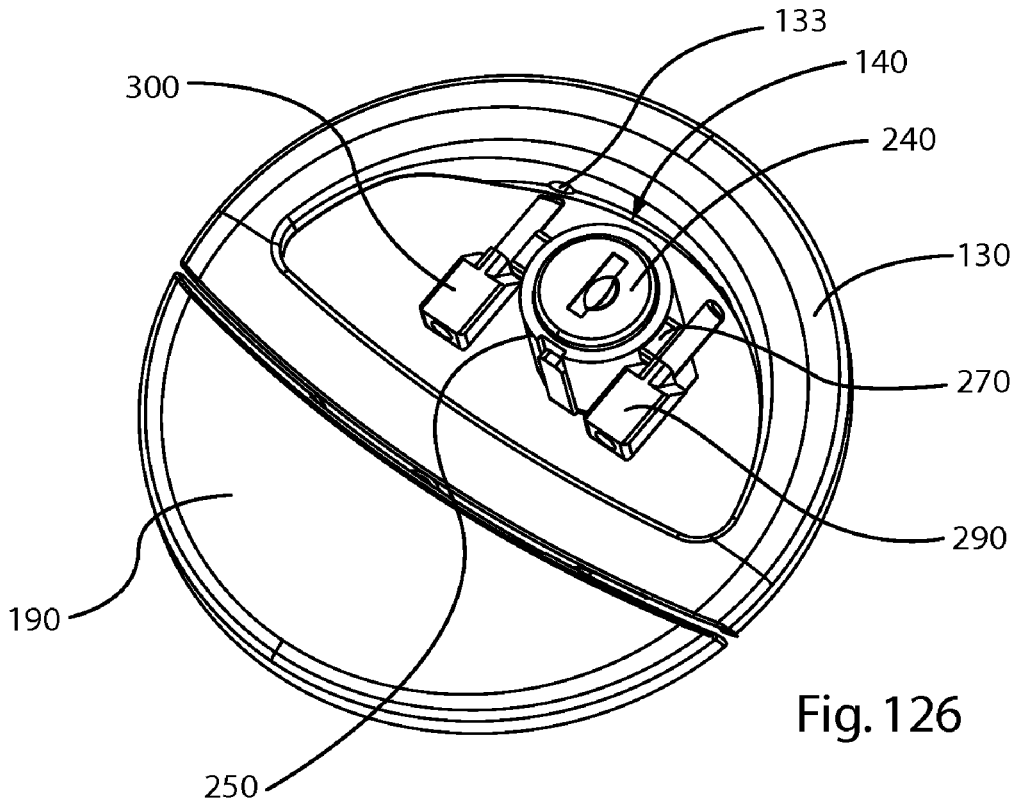
Figure 127:
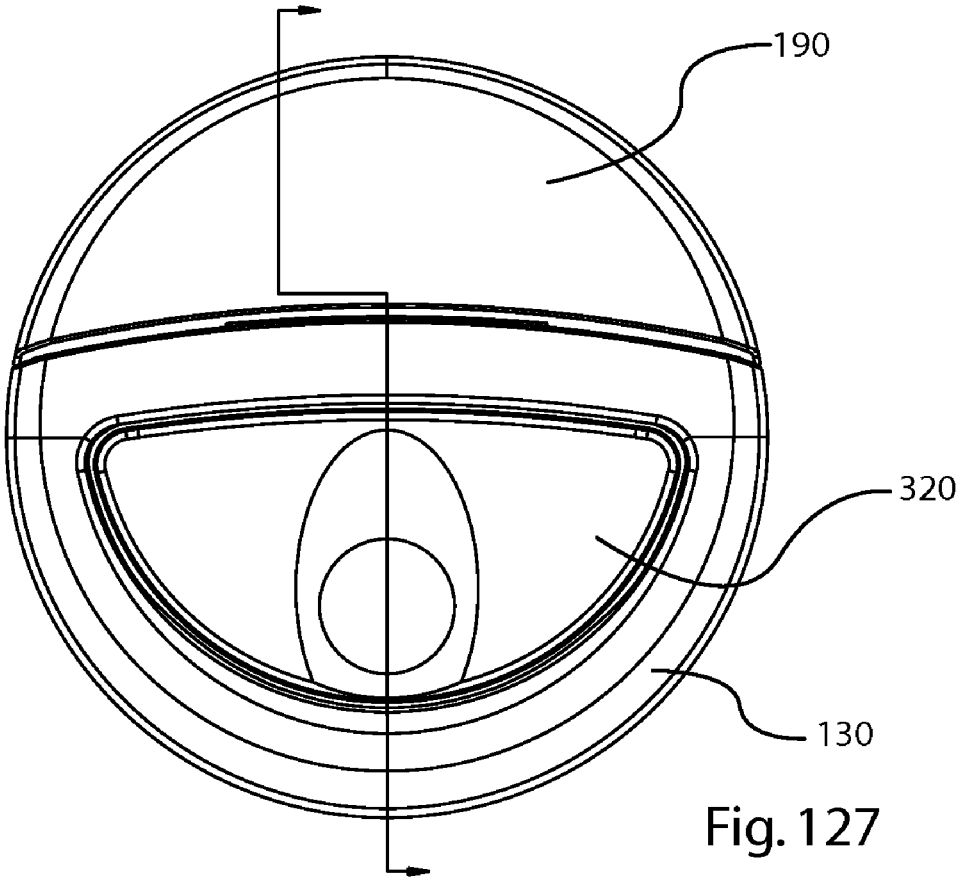
FIG. 127 is a top plan view of a portion of a latch according to the present invention shown with the handle folded down and showing the cut line along which the cross section of FIG. 129 was taken.
Figure 128:
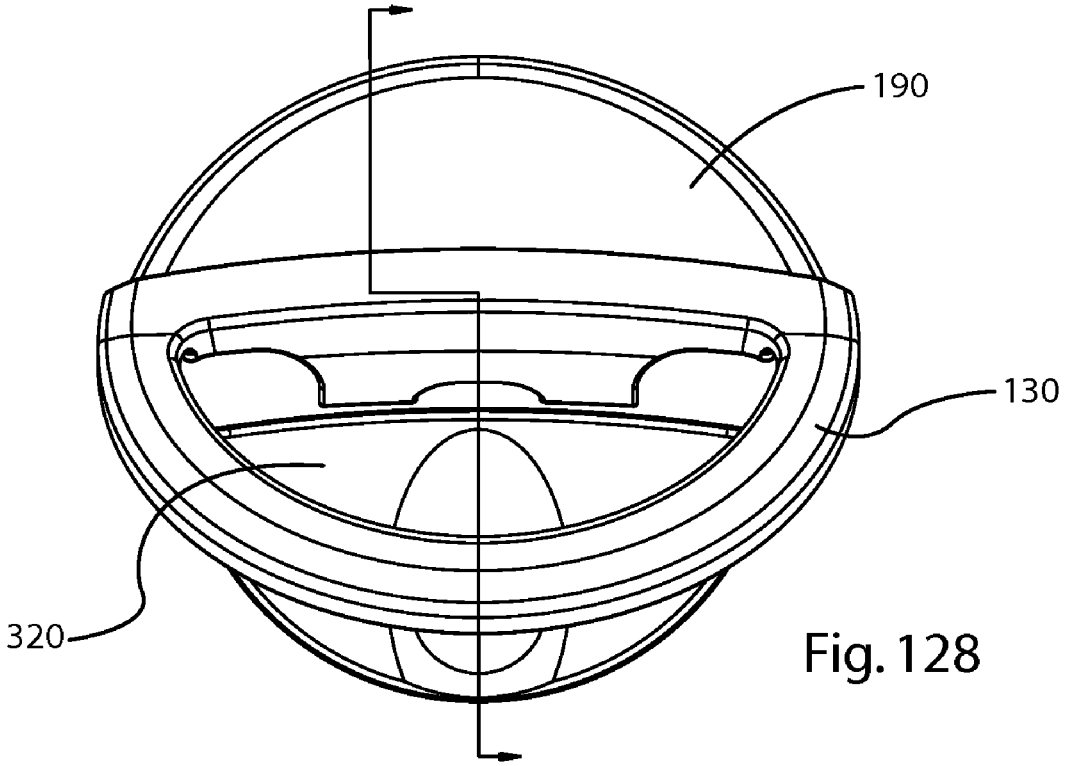
FIG. 128 is a top plan view of a portion of a latch according to the present invention shown with the handle in the intermediate position and showing the cut line along which the cross section of FIG. 130 was taken.

To open the door 102, the handle 130 is moved to the fully raised position illustrated in FIGS. 4-6. When the handle 130 is moved to the fully raised position by a user, the pawl 160 is released for rotational movement to the unlatched position also illustrated in FIGS. 4-6. Rotation of the pawl 160 to the unlatched position causes the pawl slot 162 to shift relative to the keeper 106 such that the opening of the pawl slot 162 is aligned with the path of relative movement of the keeper relative to the latch 100 as the door 102 is moved to the open position relative to the doorframe 104. Accordingly, with the pawl 160 in the unlatched position, the door 102 can be opened by pulling on the handle 130. Once the pawl 160 is released by the raising of the handle 130 to the fully raised position, the pawl 160 moves to the unlatched position under the bias of pawl spring 180.

Figure 130:
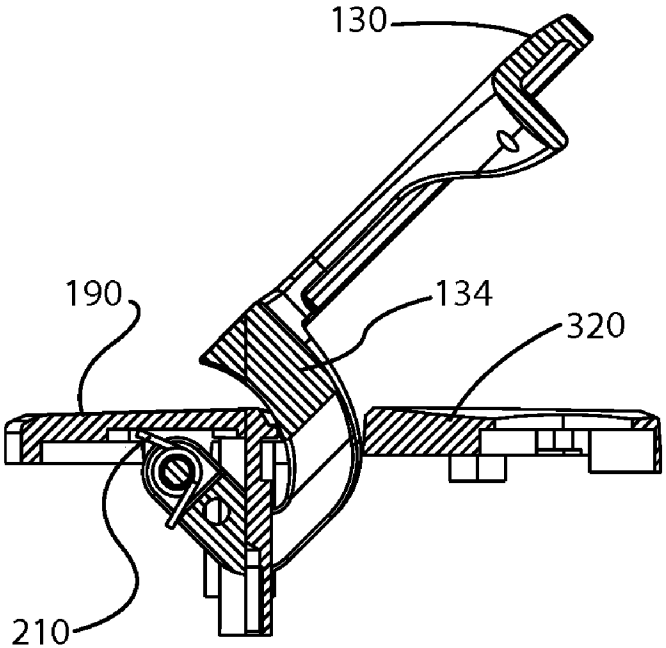
FIGS. 129-130 are cross sectional views that illustrate the movement of the handle from the folded-down position to the intermediate position under spring bias.
Figure 129:
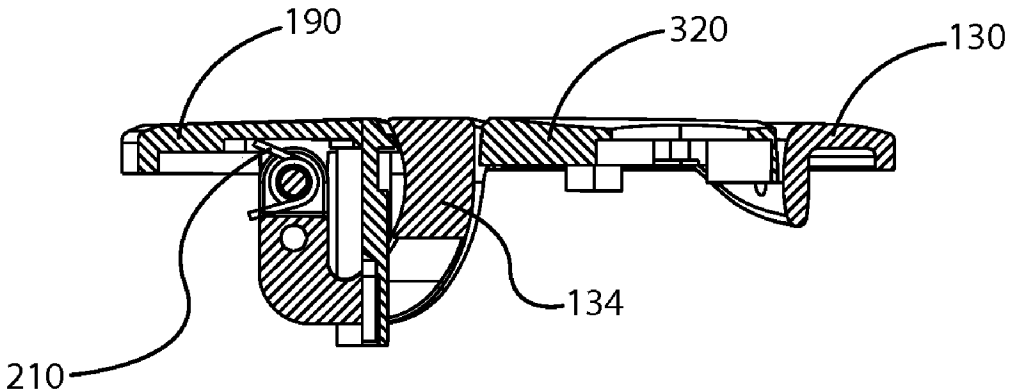
Figure 134:
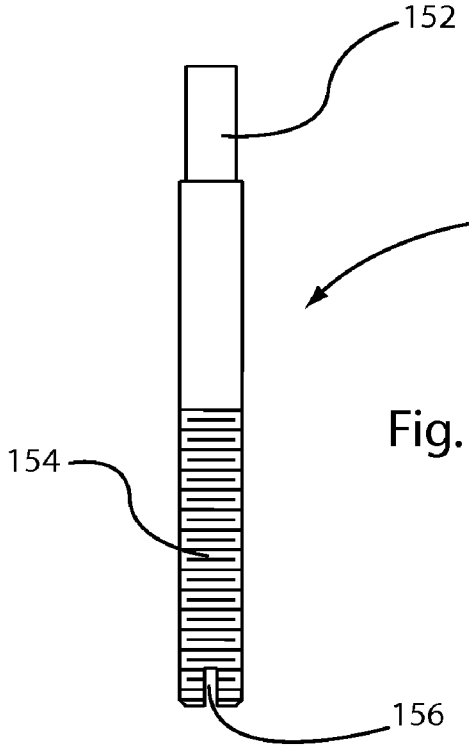
Figure 137:
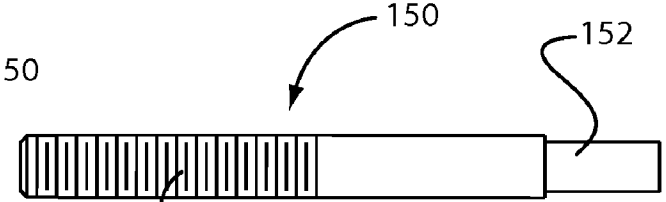
Figure 136:
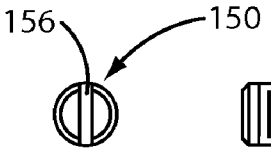
Figure 135:
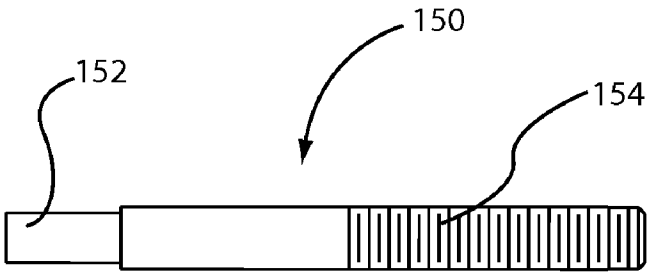
Figure 138:
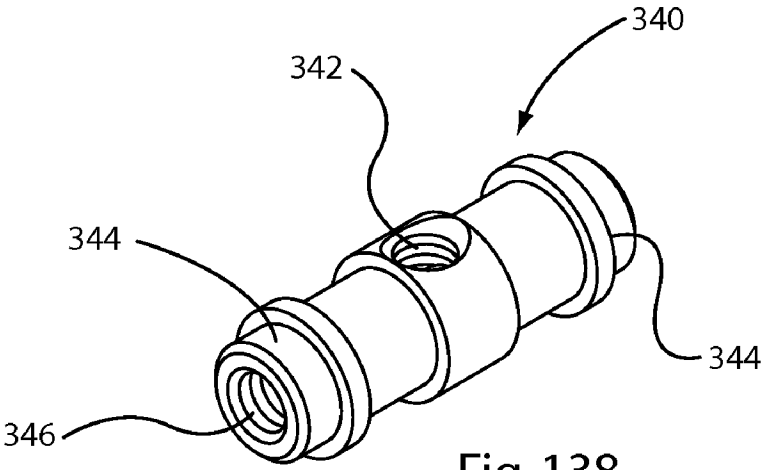
Figure 140:
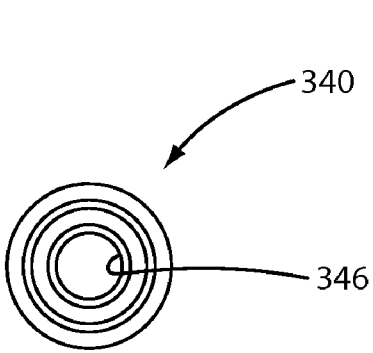
Figure 139:
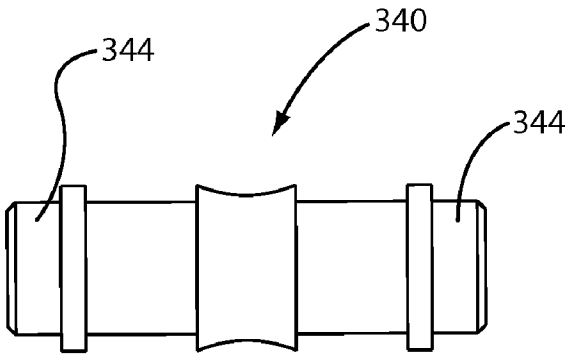
Figure 151:
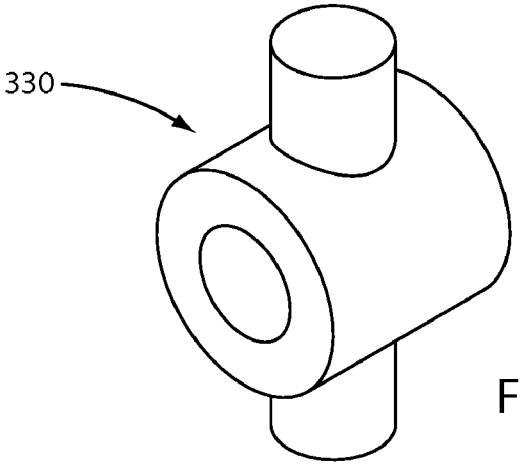
FIGS. 151-157 are views of the bushing that links the actuating rod to the one or more handle cams of the latch according to the present invention.
Figure 152:
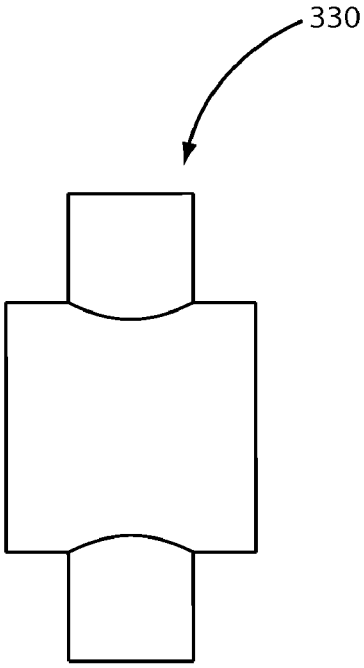
Figure 153:
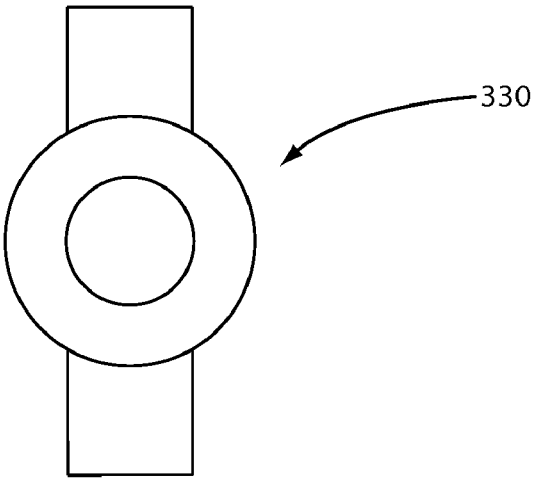
Figure 154:
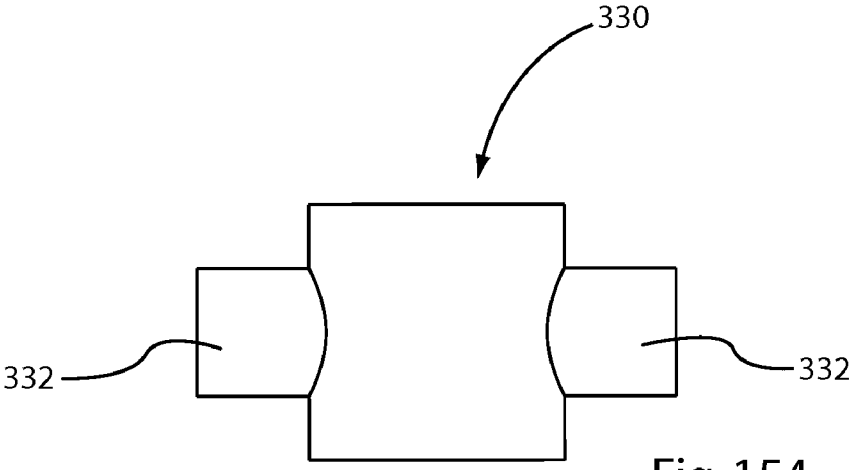
Figure 156:
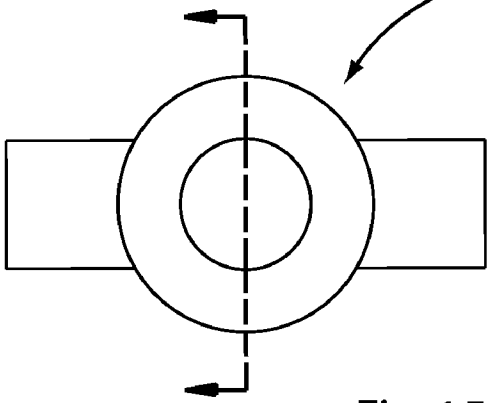
Figure 157:
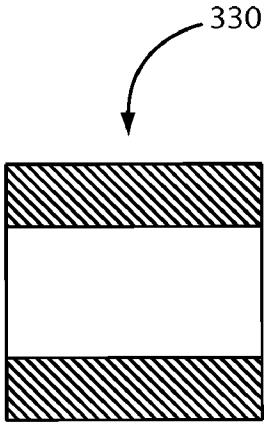
Figure 155:
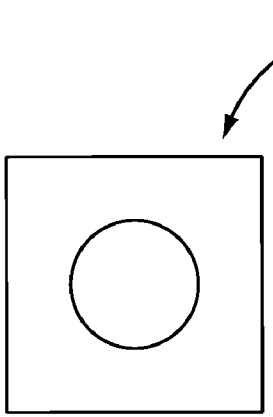
Figure 158:
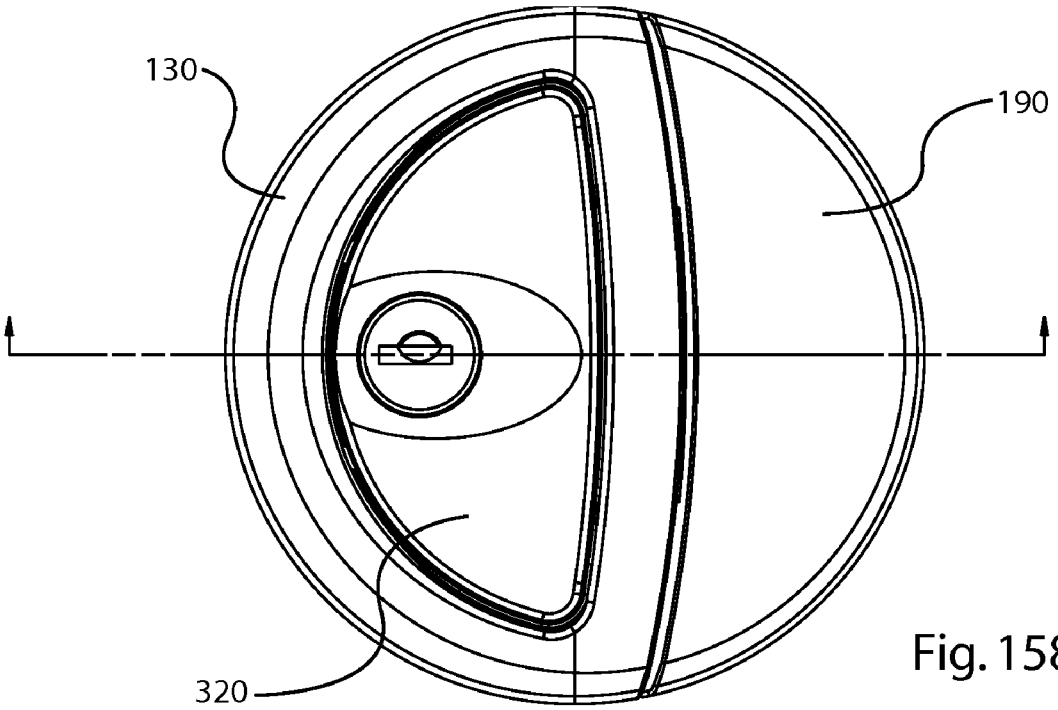
FIG. 158 is a top plan view of a latch according to the present invention shown with the handle folded down and showing the cut line along which the cross section of FIG. 159 was taken.
Figure 159:
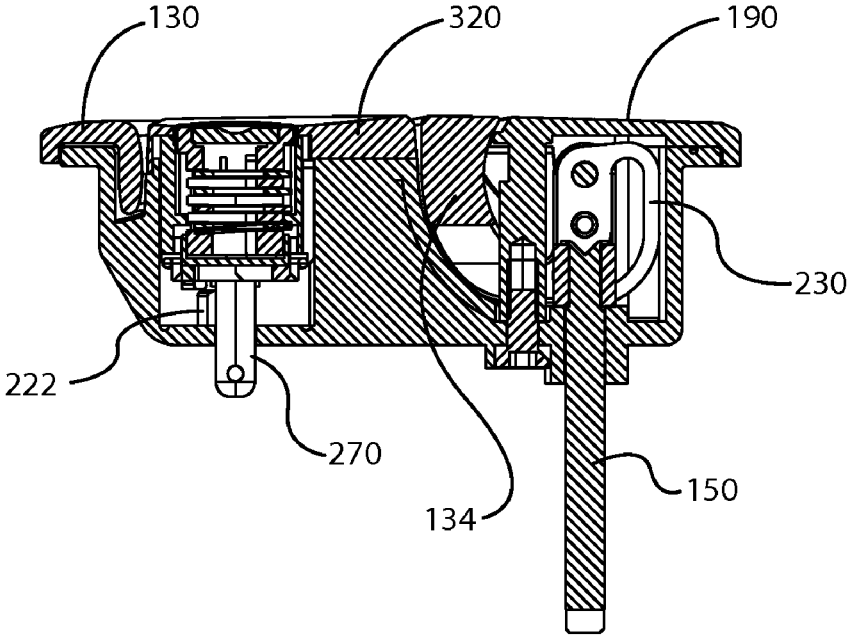
FIG. 159 is a cross sectional view that illustrates the attachment between the bushing and the actuation rod and the interaction of the lock plug extension with the handle housing.
Figure 160:
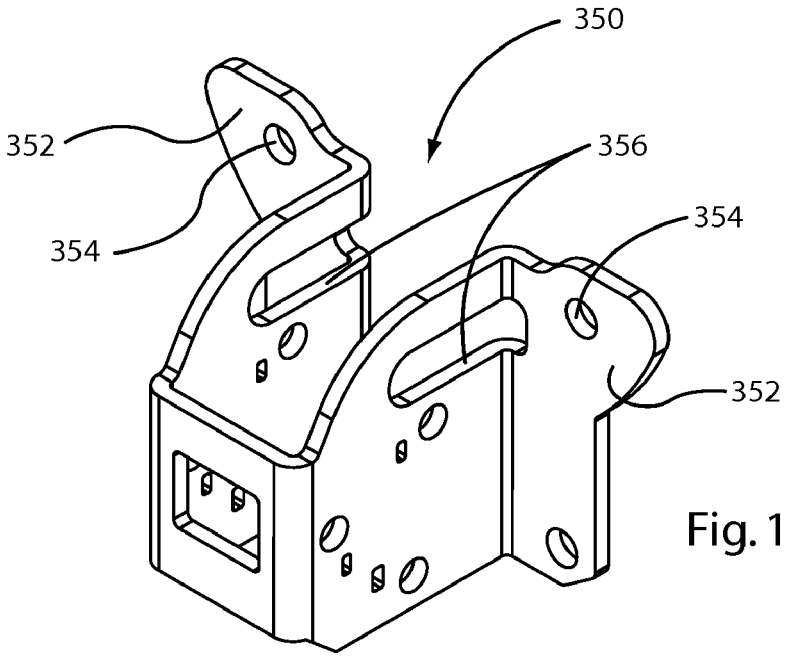
FIGS. 160-166 are views of the bracket that forms part of the pawl housing that also houses the pawl catch and the gear train for providing the pull-up action on moving the handle to the folded-down position.
Figure 161:
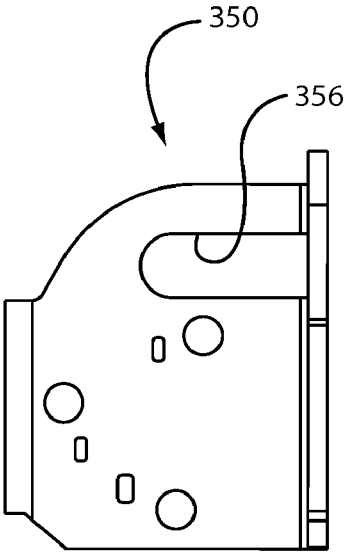
Figure 162:
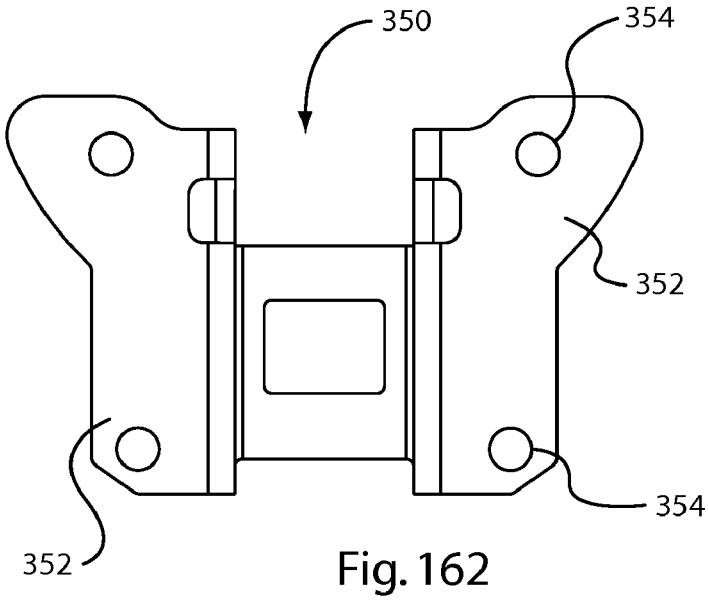
Figures 163, 164, 165, 166:
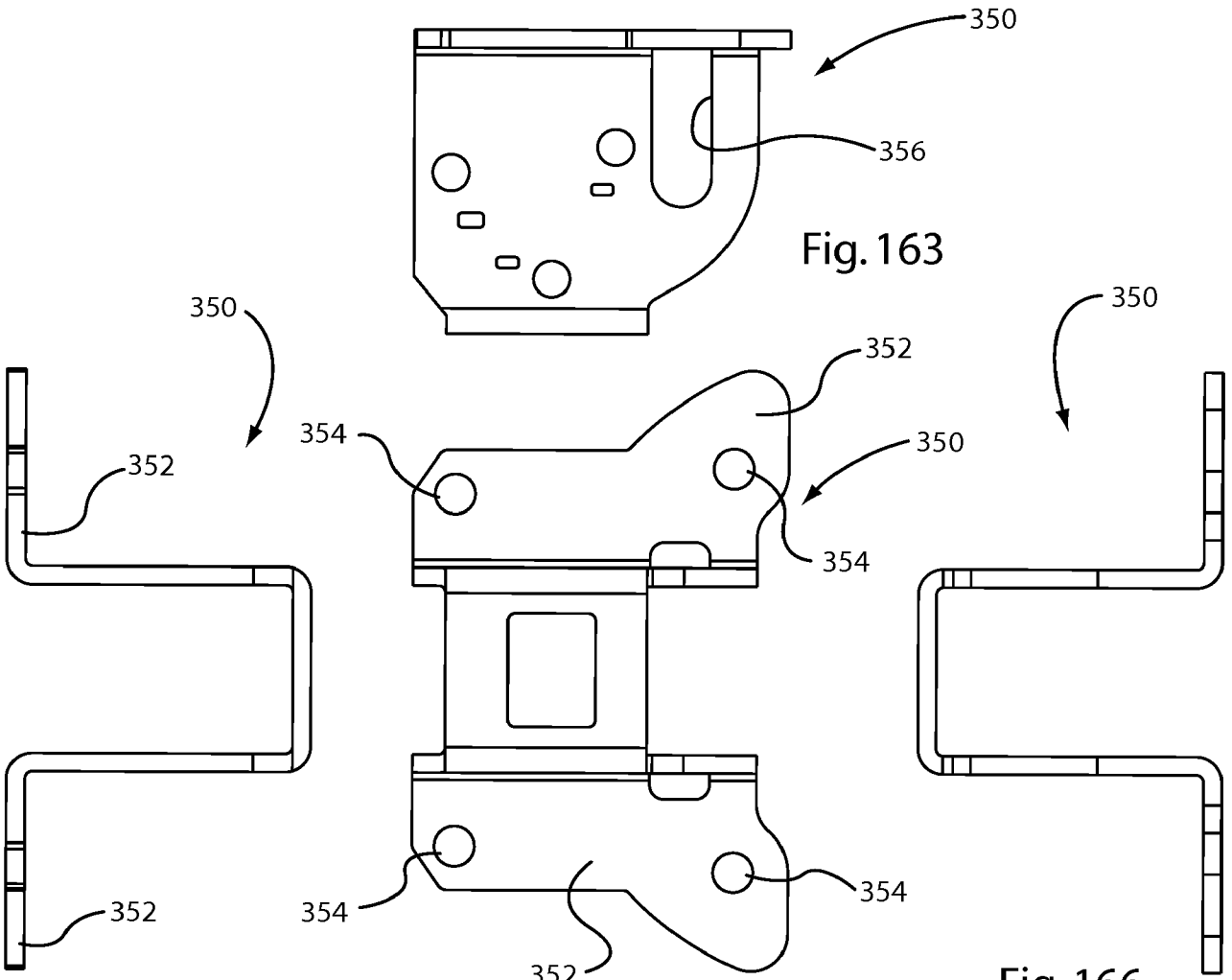
Figure 167:
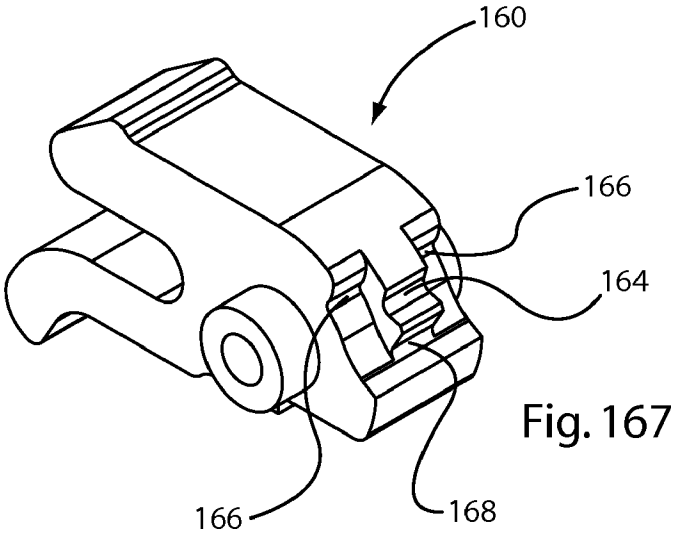
FIGS. 167-173 are views of the pawl of the latch according to the present invention.
Figure 169:
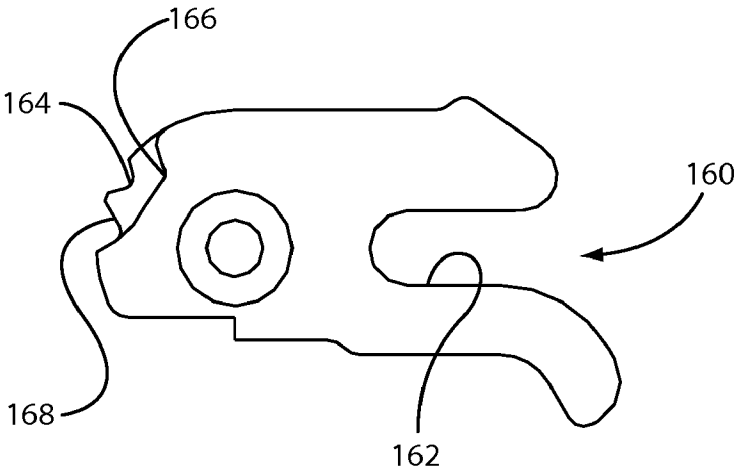
Figure 168:
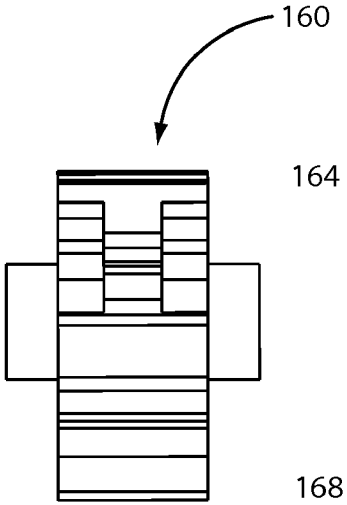
Figure 170:
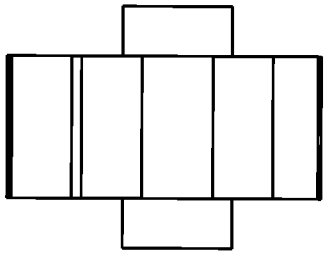
Figure 173:
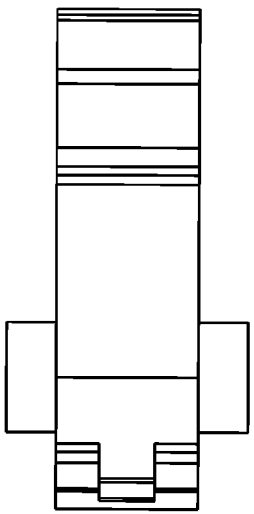
Figure 172:
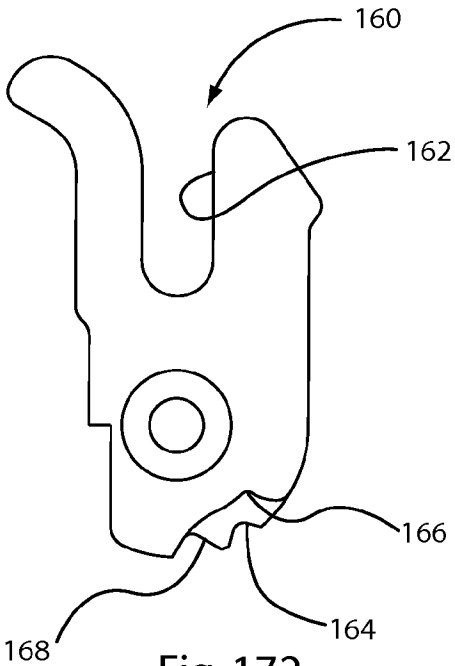
Figure 171:
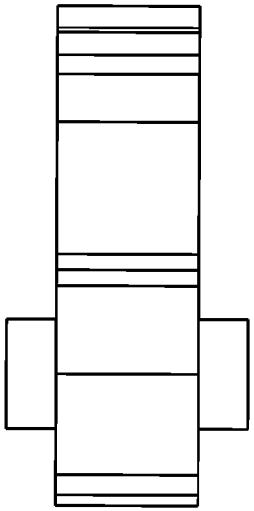
Figure 174:
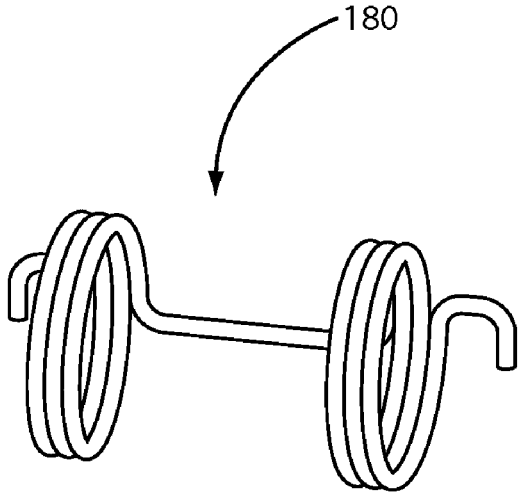
FIGS. 174-180 are views of the pawl spring that biases the pawl to the open or unlatched position.
Figure 175:
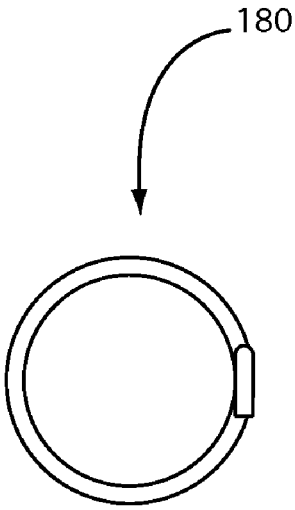
Figure 176:
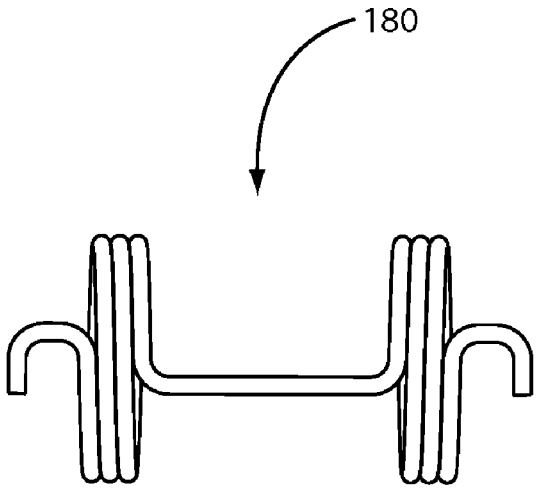
Figure 177:
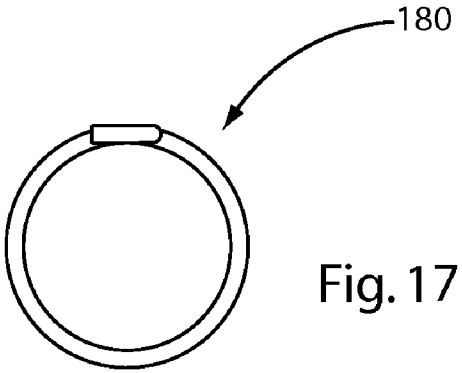
Figure 178:
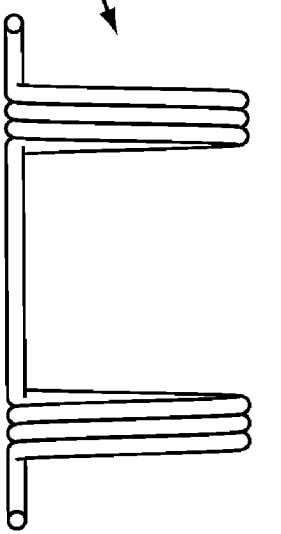
Figure 179:
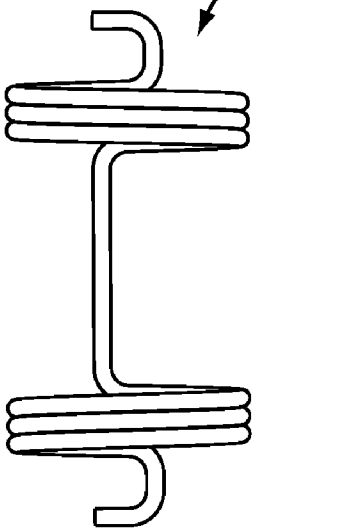
Figure 180:
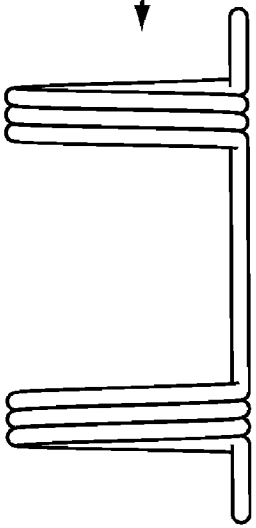
Figure 181:
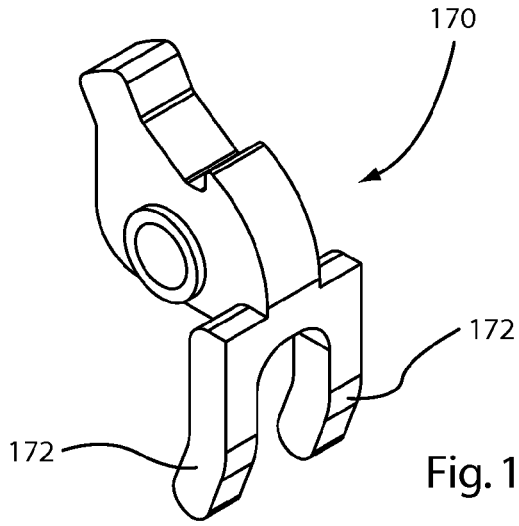
FIGS. 181-187 are views of the pawl catch of the latch according to the present invention.
Figure 182:
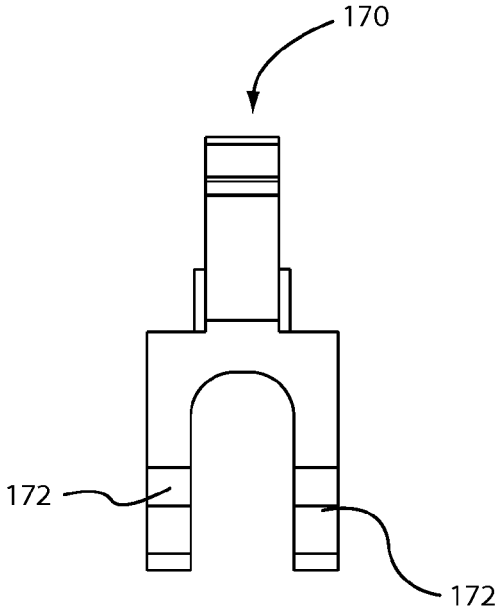
Figure 183:
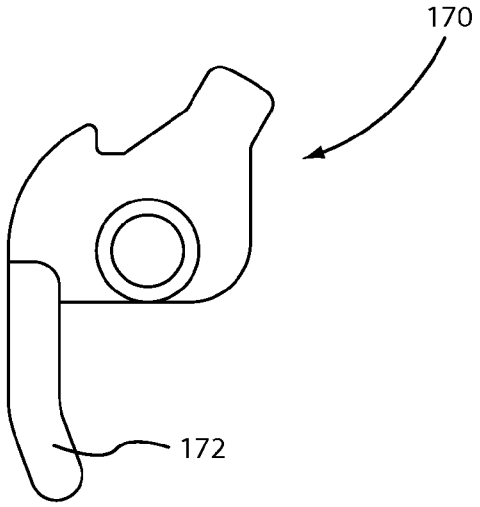
Figure 184:
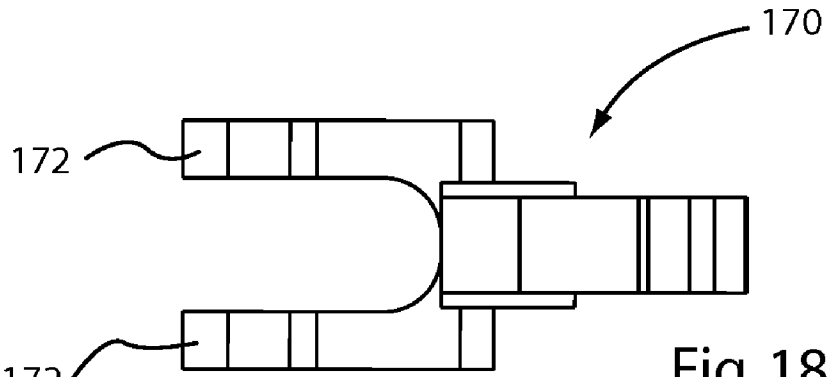
Figure 186:
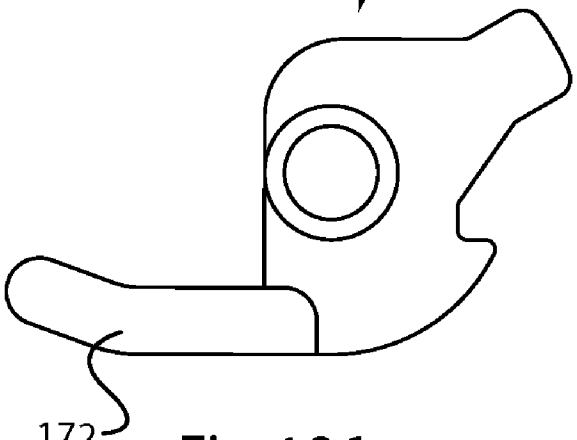
Figure 187:
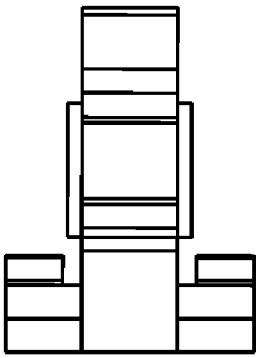
Figure 185:
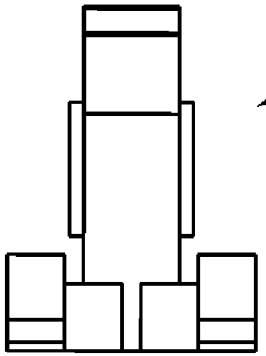
Figure 188:
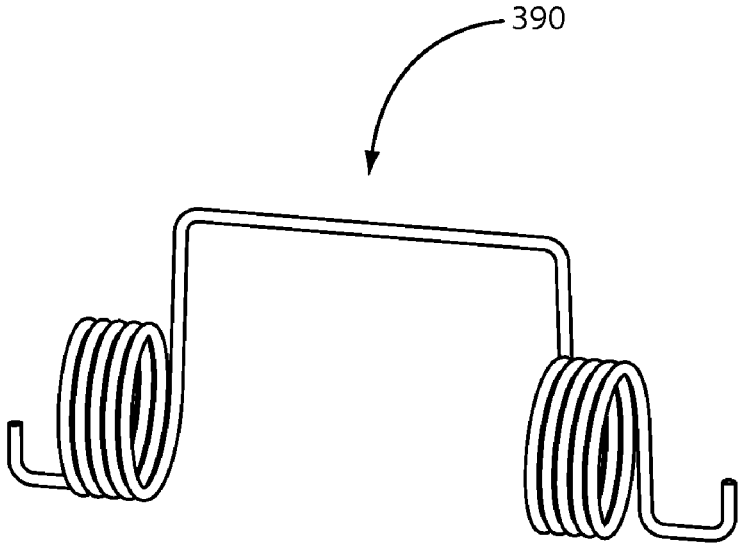
Figure 189:
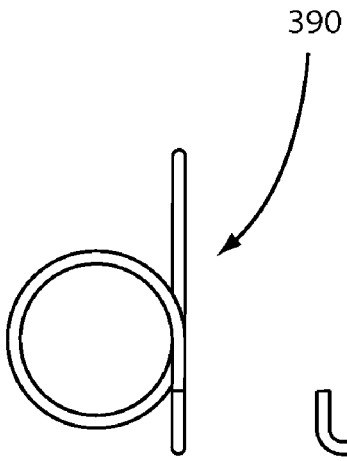
Figure 190:
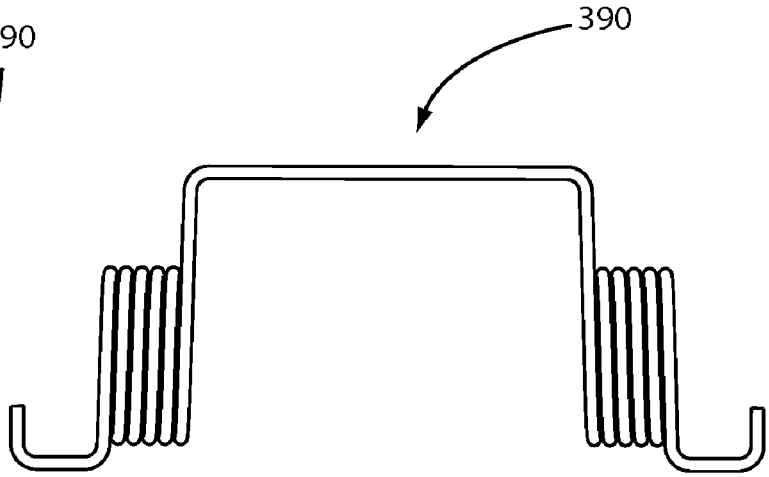
Figure 195:
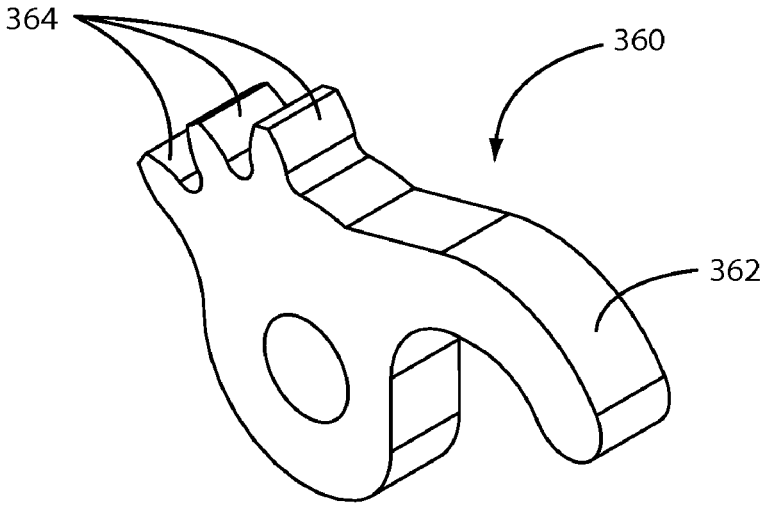
FIGS. 195-201 are views of the drive gear that is engaged by the adjustable pin as the handle is moved to the folded-down position.
Figure 196:
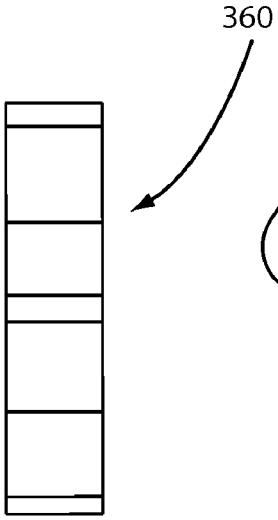
Figure 197:
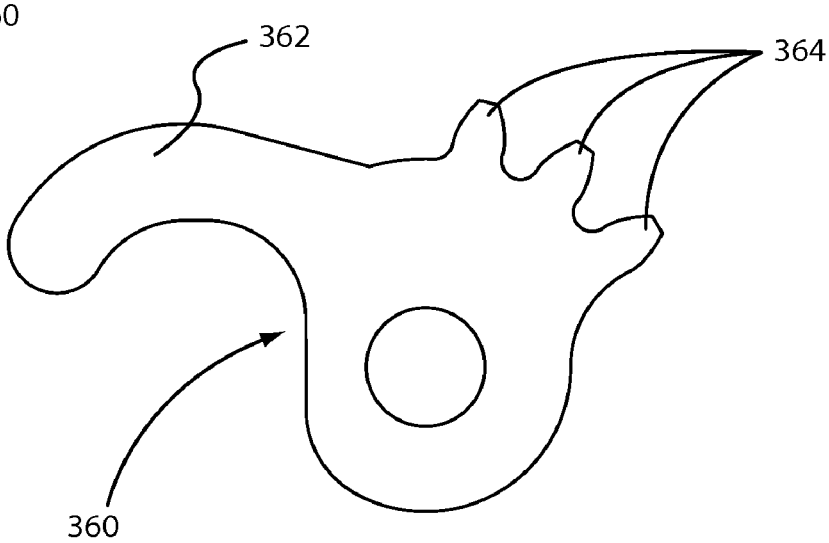
Figure 198:
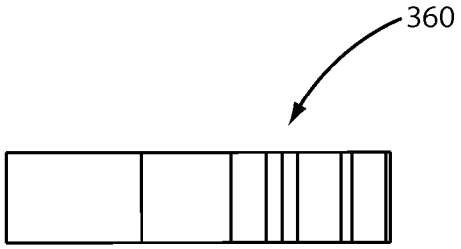
Figure 200:
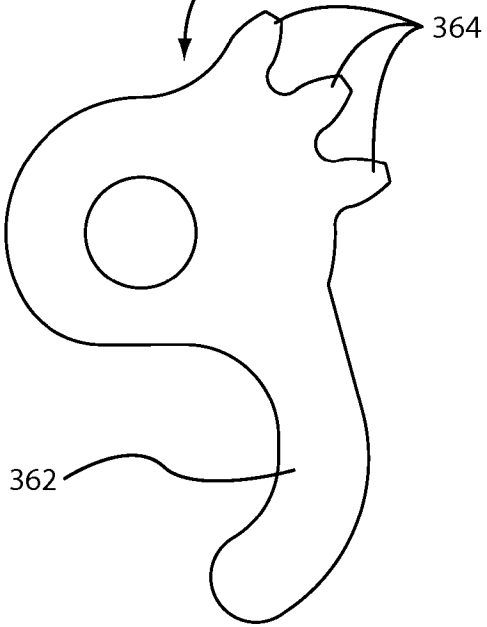
Figure 201:
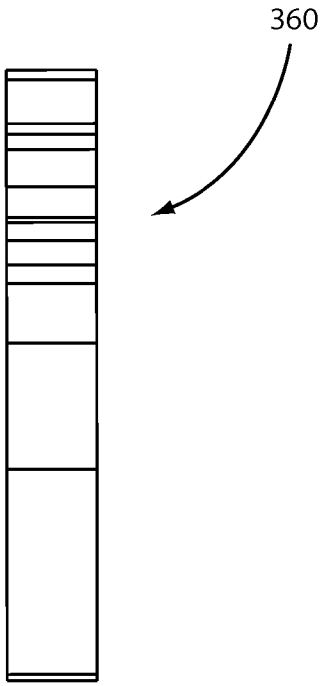
Figure 199:
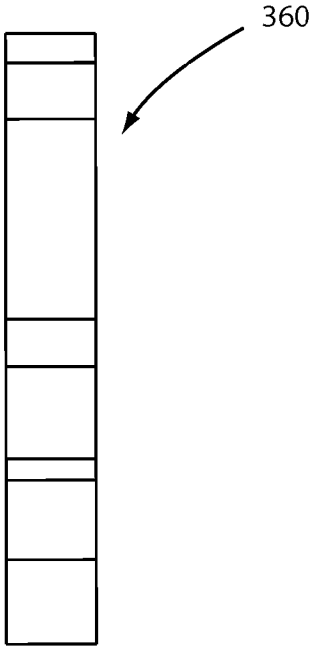
Figure 202:
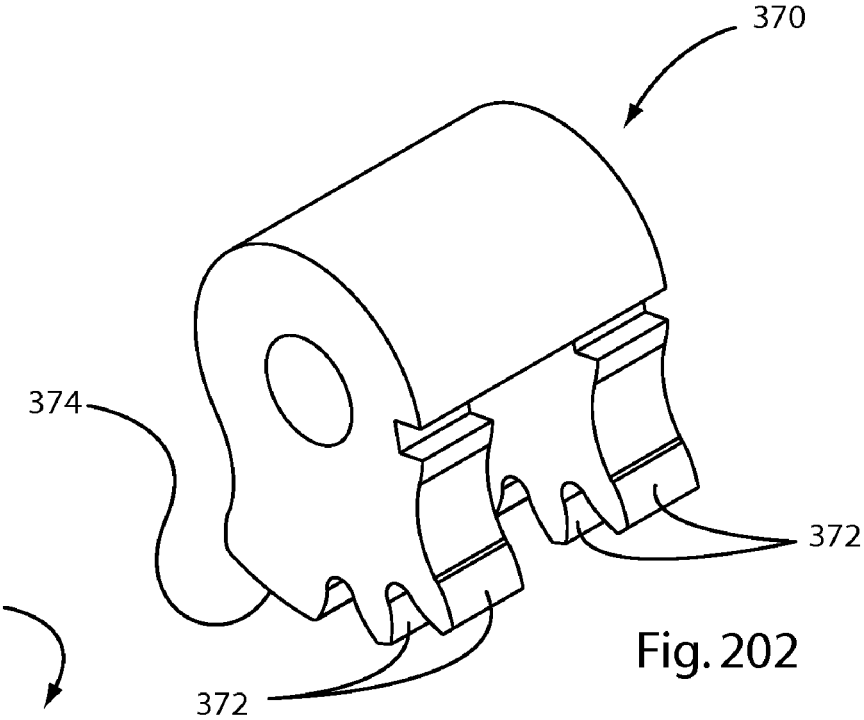
FIGS. 202-208 are views of the compression gear that is engaged by the drive gear and that engages the pawl to move the pawl to the pulled-up or fully-latched position as the handle is moved to the folded-down position.
Figure 203:
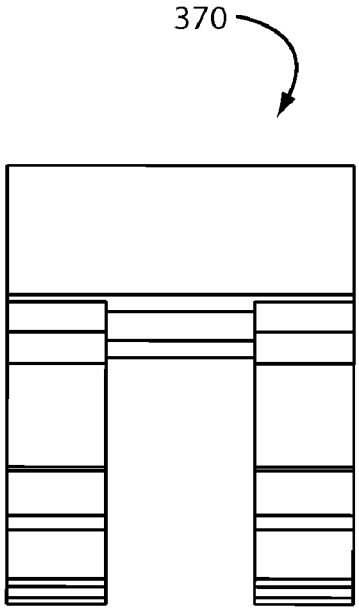
Figure 204:
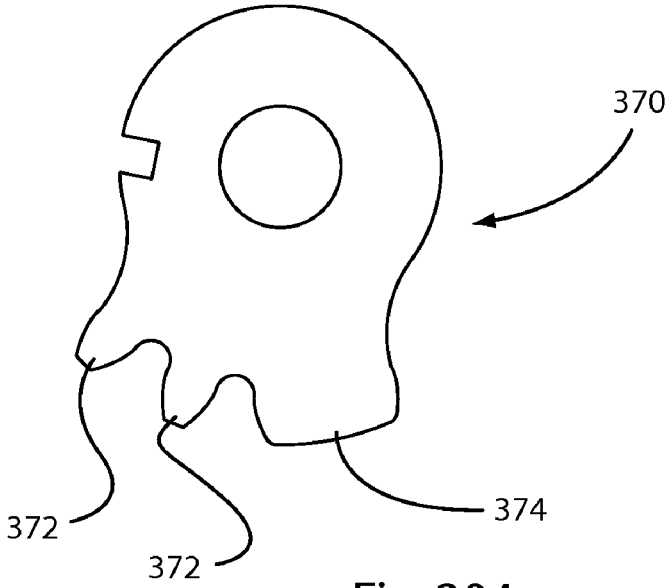
Figure 205:
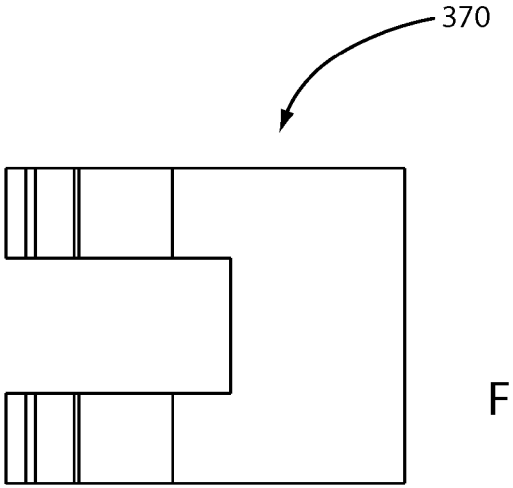
Figure 207:
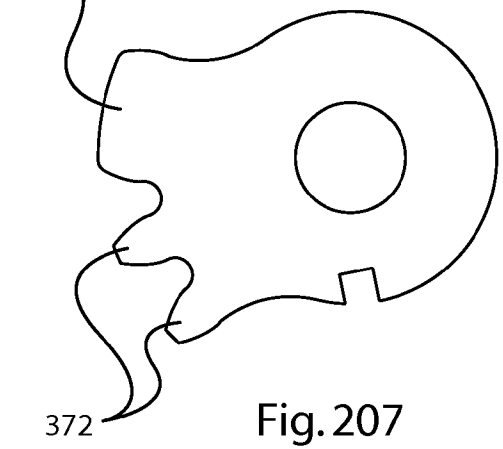
Figure 208:
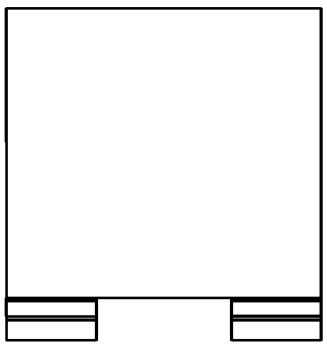
Figure 206:
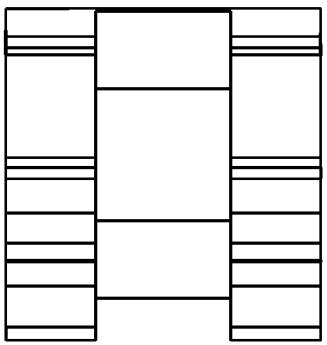
Figure 209:
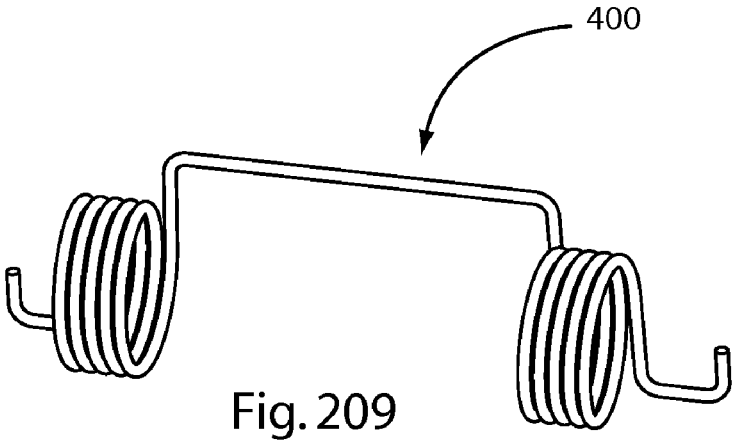
FIGS. 209-215 are views of the compression gear spring that biases the compression gear into engagement with the pawl.
Figure 210:
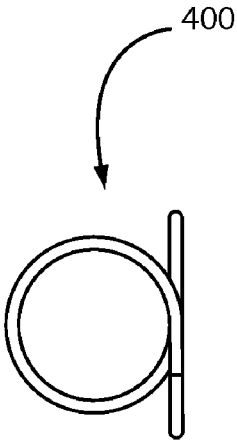
Figure 211:
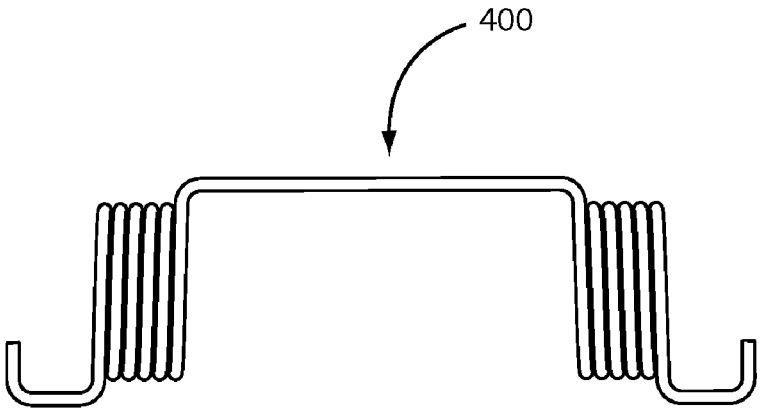
Figure 212:
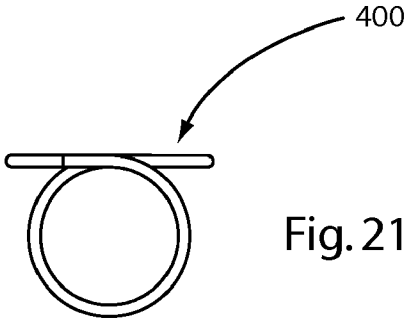
Figure 214:
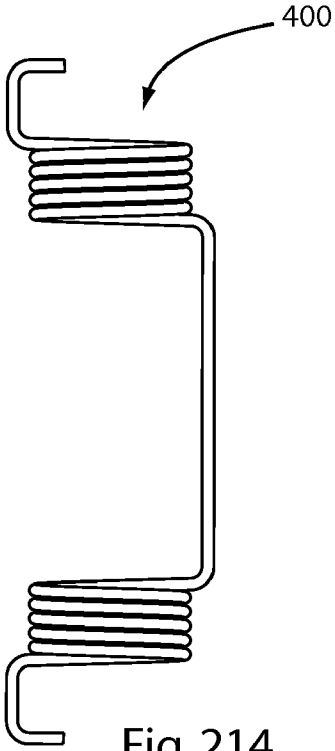
Figure 213:
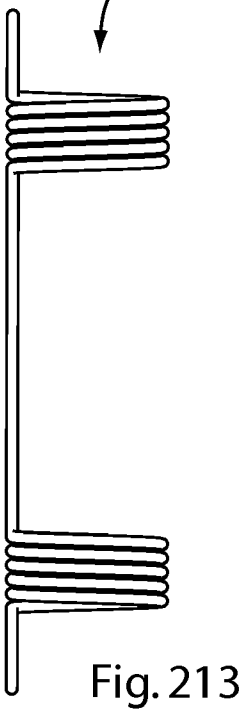
Figure 215:
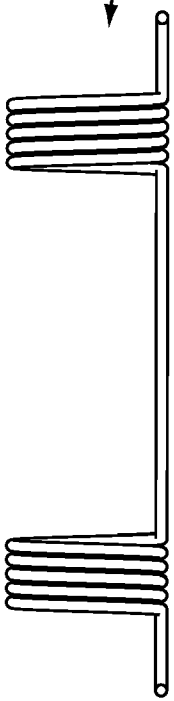
Figure 217:
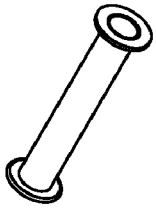
FIGS. 216-222 are views of an example of the rivet used to pivotally support the pawl, the pawl catch, the drive gear, and the compression gear relative to the bracket that forms part of the pawl housing.
Figure 221:
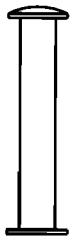
Figure 220:
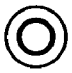
Figure 216:
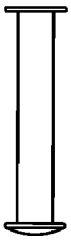
Figure 219:
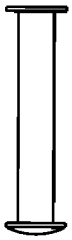
Figure 222:
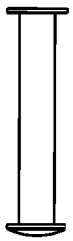
Figure 218:
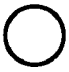
Figure 223:
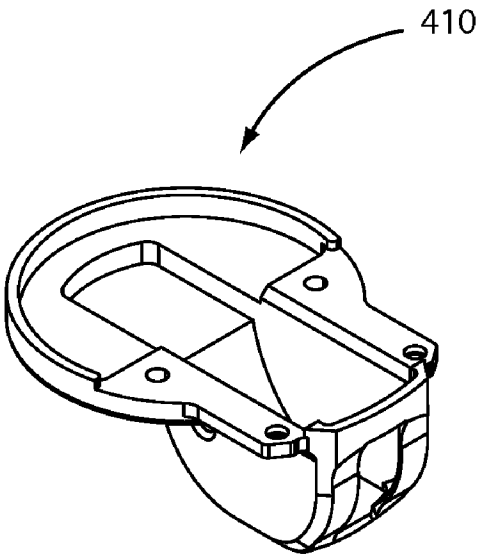
FIGS. 223-229 are views of the cover that forms part of the pawl housing that also houses the pawl catch and the gear train for providing the pull-up action on moving the handle to the folded-down position.
Figure 225:
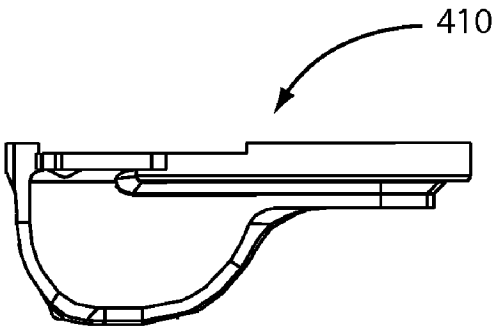
Figure 224:
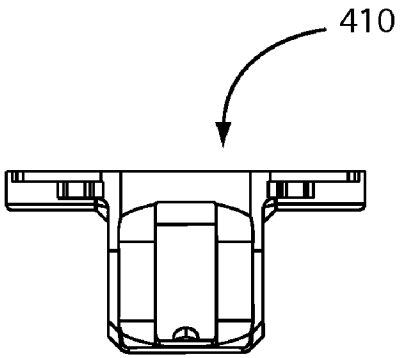
Figure 226:
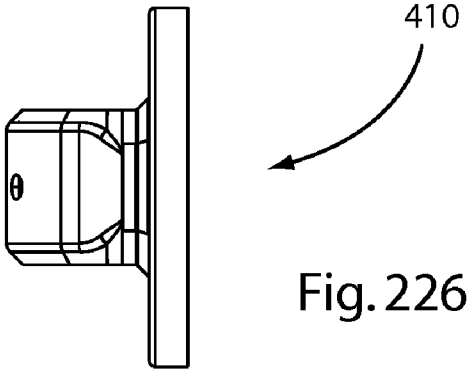
Figure 229:
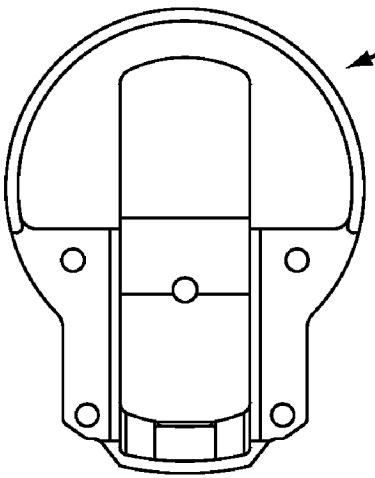
Figure 228:
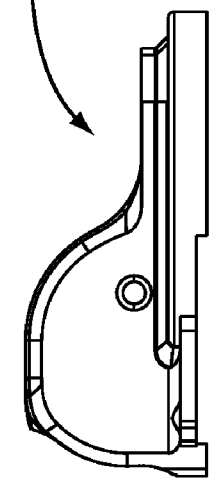
Figure 227:
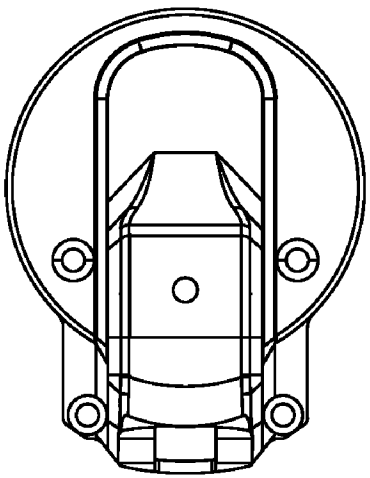
Figure 234:
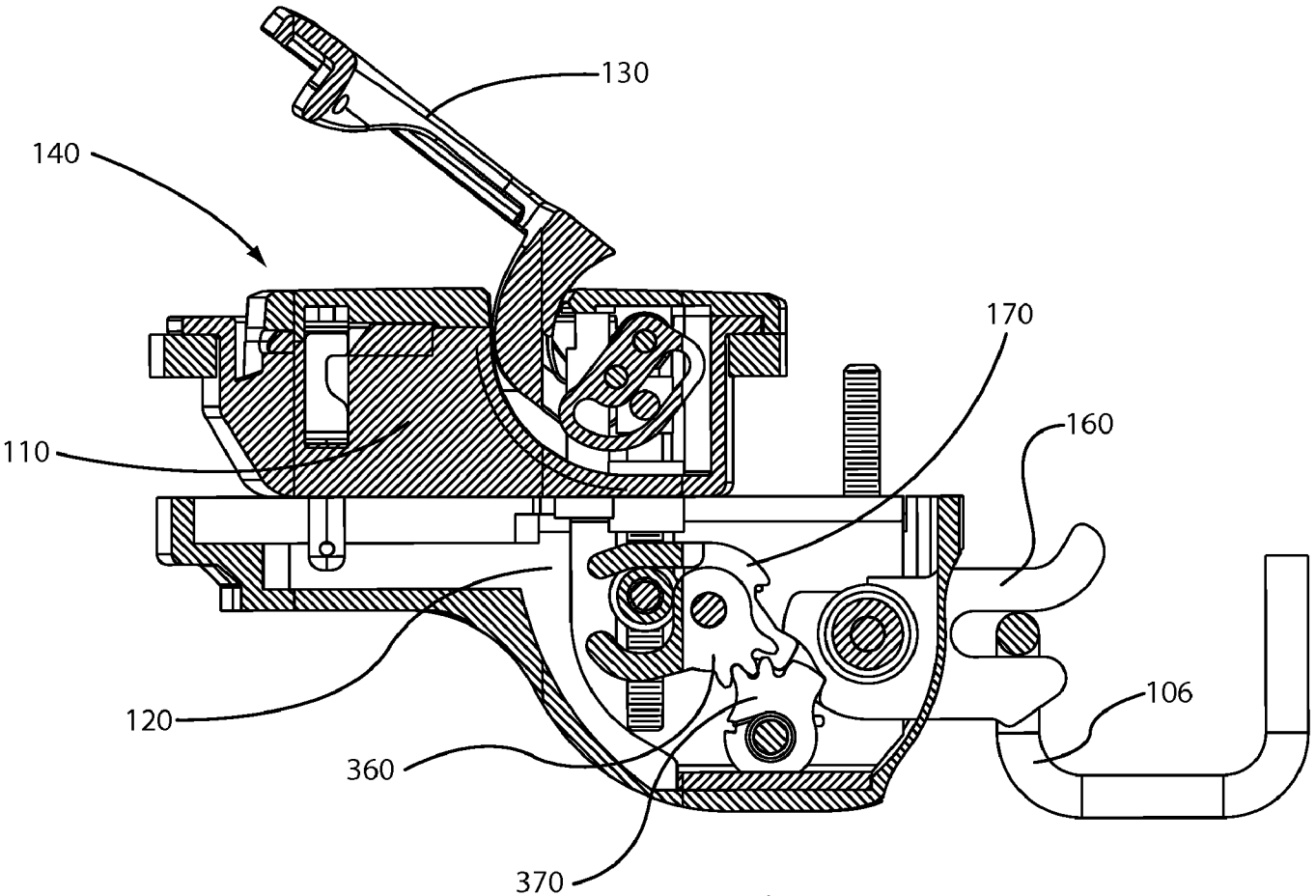

Referring to FIGS. 15-21, the handle 130 has a D-shaped grasping ring 132 and a bifurcated arm 134. The forks of the arm 134 have a first set of holes 136 that register with holes 192 in the outer portion 190 of the handle housing 110. A pivot pin 200 passes through the holes 192 and 136 to pivotally connect the handle 130 to the outer portion 190 of the handle housing 110. Thus, the handle 130 is pivotally connected to the handle housing 110. Each fork of the arm 134 is further bifurcated in the vicinity of the pivot pin 200. A torsion spring 210 is positioned between the forks of each fork of the arm 134 with the pin 200 passing through the coils of each torsion spring 210. The torsion springs 210 are used to bias the handle 130 of the latch 100 away from the folded-down position and toward an intermediate position illustrated in FIGS. 130 and 234. The outer portion 190 of the handle housing is then fixed to the inner portion 220 of the handle housing 110 using fasteners such as the screws illustrated or any other suitable means.

Referring to FIGS. 50-56 and 130, the handle 130 is also provided with handle cams 230. Each handle cam 230 has a cam slot 232, a first hole 234, and a second hole 236. The handle cams 230 are provided intermediate the forks of the arm 134 and are spaced apart from each other. The holes 234 of the cams 230 register with the holes 136 of the arm 134 and the pin 200 also passes through the holes 234. The holes 236 of the cams 230 register with the holes 138 in the forks of the arm 134 and each cam 230 is pinned to a respective fork of the arm 134 at this location, which is at spaced separation from the pin 200. Accordingly, there can be no relative movement between the cams 230 and the handle 130 and the cams 230 and the handle 130 move as a unit.

Referring to FIGS. 57-107, the latch 100 also includes a lock plug 240, a lock plug holder 250, a lock plug extension 260, a handle release actuator 270, a coil spring 280, and two spring biased bolts 290 and 300. Together, the lock plug 240, the lock plug holder 250, the lock plug extension 260, the handle release actuator 270, the coil spring 280, and the spring biased bolts 290 and 300 form the mechanism 140 for securing the handle 130 in the folded-down position.

The bolts 290 and 300 engage holes 131 and 133 in the handle 130, respectively, to secure the handle 130 in the folded-down position. Each of the bolts 290, 300 is provided with a bolt spring 310 to bias the bolts 290, 300 toward engagement with the handle 130. The coil spring 280 biases the handle release actuator 270 out of engagement with the bolts 290, 300.

When the handle release actuator 270 is pressed into the inner portion 220 of the handle housing 110, the tips of the L-shaped projections 272 act on the sloping surfaces 292, 302, respectively, to retract the bolts 290, 300 out of engagement with the handle 130 in order to release the handle 130 from the folded-down position. When the handle release actuator 270 is released, the coil spring 280 forces the handle release actuator 270 out of engagement with the bolts 290, 300, thus allowing the bolts 290, 300 to return to their extended positions where they may once again engage and secure the handle 130 in the folded-down position when the handle 130 is returned to the folded-down position. The open top of the assembly including the handle release actuator 270 and the lock plug holder 250 can simply be provided with a cap to provide a push button release for the handle 130. For some applications where unauthorized opening of the latch 100 should be prevented, the latch 100 can be provided with the key-operated lock plug 240, the lock plug holder 250, and the lock plug extension 260. The lock plug holder 250 is received inside the handle release actuator 270 and cannot move relative to the handle release actuator 270. The lock plug 240 and the lock plug extension 260 are received by the lock plug holder 250. The lock plug extension 260 is capable of rotating relative to the lock plug holder 250 and the handle release actuator 270, responsive to the rotation of the lock plug 240 relative to the lock plug holder 250 and the handle release actuator 270. The lock plug holder 250 and the handle release actuator 270 cannot rotate relative to the handle housing 110, but they can only move rectilinearly relative to the handle housing 110. The lock plug 240 can be selectively rotated relative to the lock plug holder 250 and the handle release actuator 270 between a locked position and an unlocked position using a key. The lock plug extension 260 has downward projecting tabs 262 that extend through arc-shaped slots 274 in the bottom of the handle release actuator 270. When the lock plug 240 is in the locked position, the downward projecting tabs 262 register with tabs 222 projecting upward from the bottom of the inner housing portion 220 with the downward projecting tabs 262 and the tabs 222 being in such close proximity that downward movement of the lock plug and the handle release actuator 270 are essentially prevented and the handle 130 cannot be released. When the lock plug 240 is in the unlocked position, the downward projecting tabs 262 are out of alignment with tabs 222. Accordingly, the lock plug 240 and the handle release actuator 270 can be depressed to release the handle 130 from the folded-down position.

Referring to FIGS. 108-114, the handle housing 110 can be provided with a removable face plate 320, which allows stylistic changes to be made to the latch without having to retool completely to manufacture a stylistically different latch. The faceplate 320 can be fastened to the inner housing portion 220 using fastener such as screws or the like. Any other suitable fastening means may also be used.

Referring to FIGS. 151-157, are views of the bushing 330 that links the actuating rod 150 to the one or more handle cams 230. The bushing 330 has lateral projections 332 that engage the slots 232 of the cams 230. The actuation rod 150 has a reduced diameter end portion 152 that that extends through the bushing 330. The tip of the reduced diameter end portion 152 is flared outward to axially fix the bushing along the actuation rod 150, while allowing for relative rotation between the bushing 330 and the actuation rod 150. The actuation rod 150 has a threaded portion 154 that extends through the bottom of the inner housing portion 220 and through the door 102 and into the pawl housing 120. The portion of the actuation rod 150 that is positioned in the pawl housing 120 is provided with and adjustable pin 340. The adjustable pin 340 has a central threaded opening 342 that extends through the pin 340 perpendicular to the longitudinal axis of the pin 340. The threaded portion of the actuation rod 150 is in threaded engagement with the opening 342.

The pawl housing 120 includes a bracket 350 that forms part of the pawl housing 120. The bracket 350 rotationally supports the pawl 160, the pawl catch 170, the drive gear 360, and the compression gear 370. The bracket 350 has flanges 352 that abut the door 102 on the inner side of the door 102. The flanges 352 are provided with clearance holes 354 for fasteners used to mount the latch 100 to the door 102. The bracket 350 also has a pair of rectilinear coextensive slots 356 that extend perpendicular to the inner surface of the door 102 and parallel to the longitudinal axis of the actuation rod 150. End portions 344 of the pin 340 ride in the slots 356 such that the pin 340 is essentially limited to rectilinear motion relative to the bracket 350.

The actuation rod 150 has a slot 156 at one end to allow a screwdriver to be used to turn the actuation rod 150. As the actuation rod 150 is turned the threaded engagement between the actuation rod and the pin 340 causes the pin 340 to move axially along the actuation rod 150. Thus the axial position of the pin 340 along the actuation rod 150 can be adjusted to suit doors of different thickness. The pin 340 also has a threaded bore 346 that is coaxial with its longitudinal axis and communicates with the opening 342. The bore 346 allows a set screw 380 to be jammed against the actuation rod 150 to reversibly secure the adjustable pin 340 at a desired position along the length of the actuation rod 150.

As the handle 130 is moved toward the raised position, the cams 230 are pulled away from the pawl housing 120 and accordingly, the actuation rod 150 is pulled outward relative to the pawl housing 120. As the handle 130 is moved toward the folded-down position, the cams 230 are moved closer to the pawl housing 120 and accordingly, the actuation rod 150 is pushed inward relative to the pawl housing 120.

Figure 246:
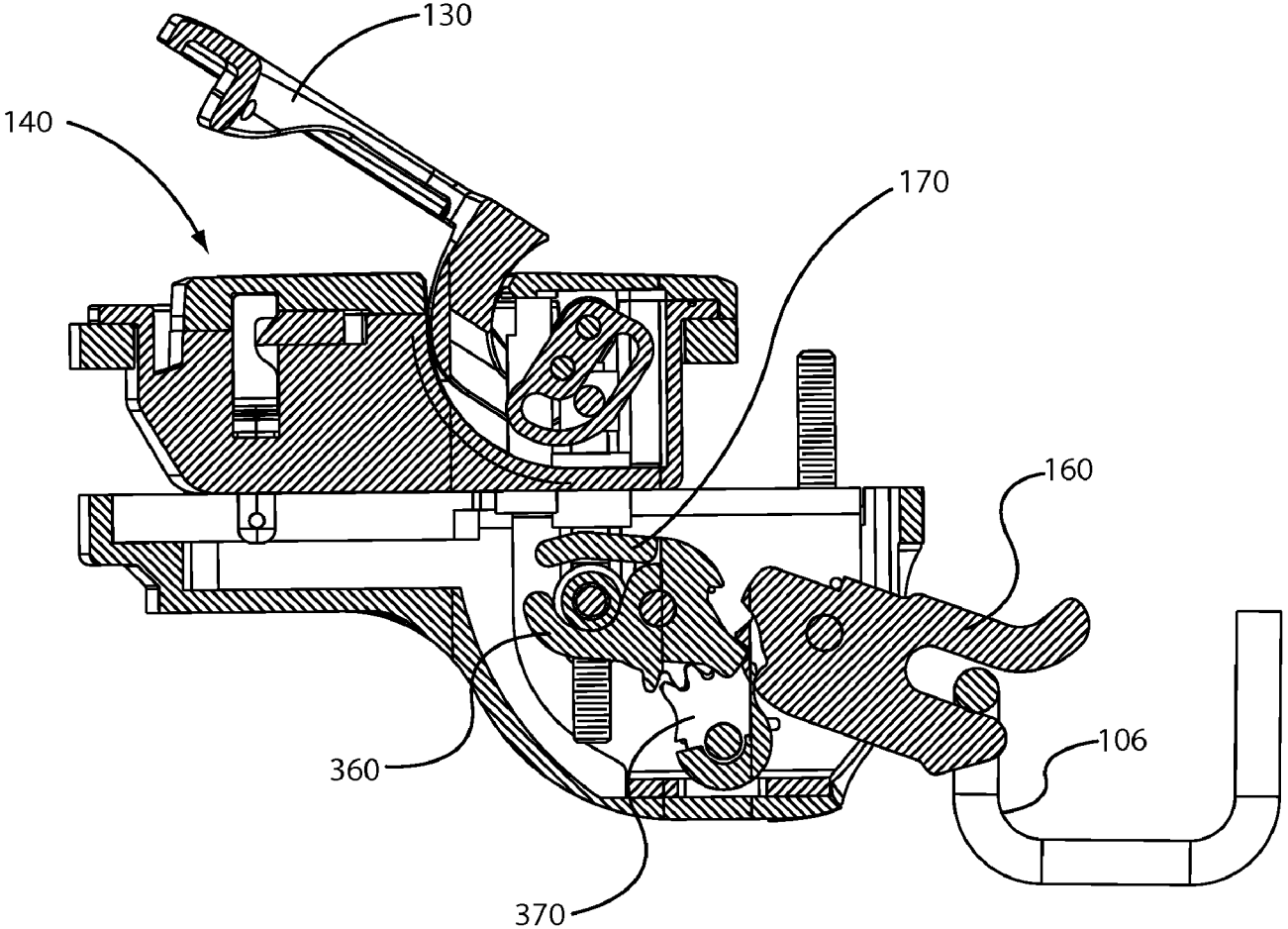
Figure 247:
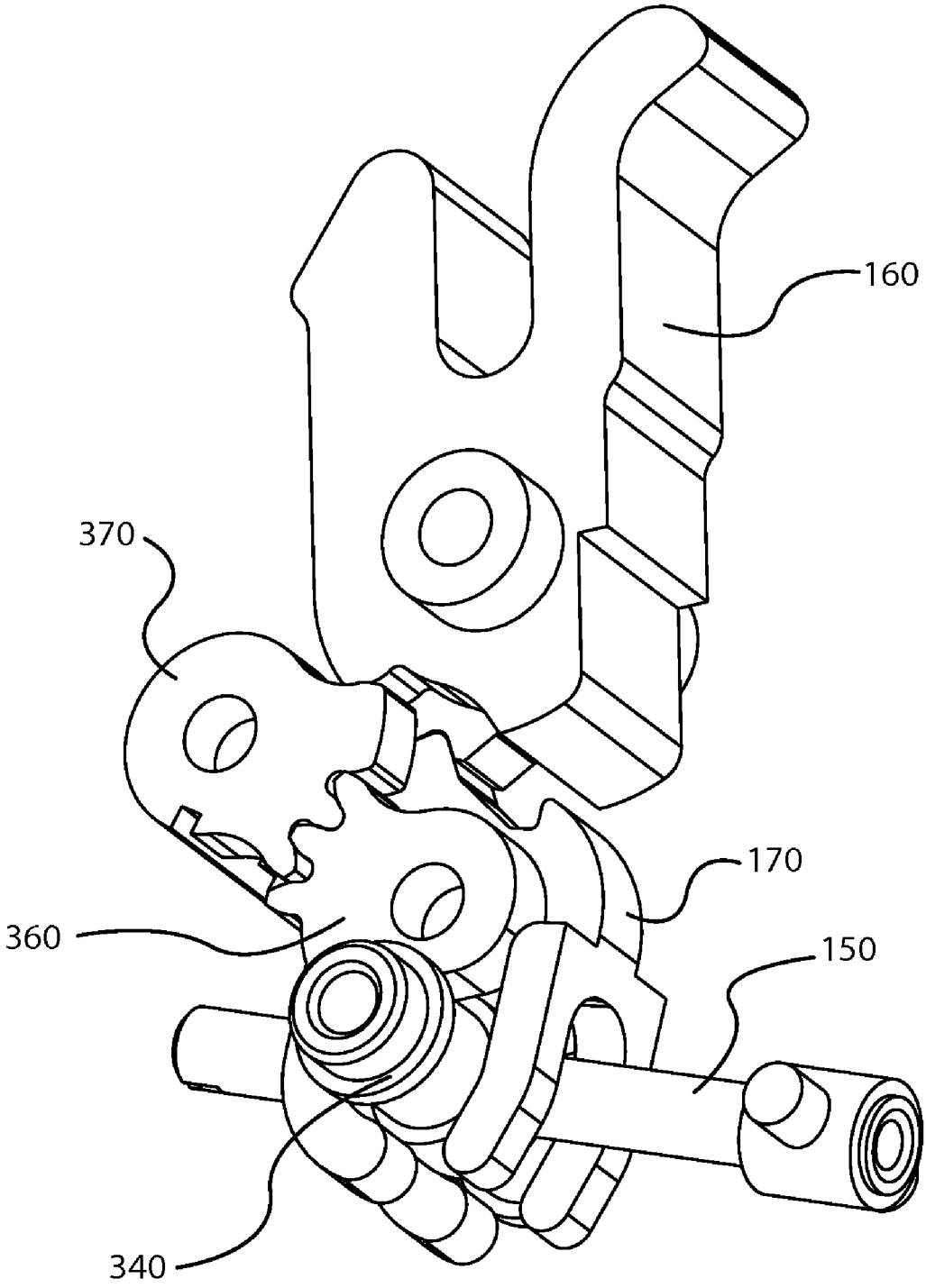

The pawl catch 170 has one or more claws 172 located intermediate the pin 340 and the handle housing 110. As the handle 130 is raised, the pin 340 engages the claw 172 and rotates the pawl catch 170 out of engagement with the pawl 160 so that the pawl is released and allowed to rotate to the unlatched position. The pawl catch spring 390 biases the pawl catch 170 into engagement with the pawl 160. The drive gear 360 has a claw 362 positioned such that the pin 340 is located intermediate the claw 362 and the handle housing 110. The drive gear 360 has teeth 364 that are in mesh with teeth 372 of the compression gear 370. As the handle 130 is moved toward the folded-down position, the pin 340 engages the claw 362 and rotates the drive gear 360, which is in mesh with the compression gear 370. This in turn forces the compression gear 370, and in particular the pawl-engaging portion 374 of the compression gear 370, into engagement with the pawl 160. If the pawl 160 is at the intermediate position between the latched and unlatched positions as shown in FIGS. 247 and 246, or closer to the fully latched position, then the engagement of the compression gear 370 with the pawl 160 tends to rotate the pawl 160 toward the fully latched position as the handle 130 is moved to the folded-down position, Thus providing the pull-up or compression action. The compression gear spring 400 biases the compression gear 370 into engagement with the pawl 160.

The pawl catch 170 and the drive gear 360 are supported on a common pivot axis but their movements are independent of each other. In the illustrated embodiment two drive gears 360 are provided.

The cover 410 protects the pawl mechanism from objects located on the interior side of the door and forms part of the pawl housing 120. Fasteners such as screws are placed through the holes in the cover 410 and holes in the flanges of the bracket 350 and engaged to the handle housing to mount the latch 100 to the door 102. Additional fasteners can be placed through holes in the cover 410 and engaged directly to the door 102 for added strength. The mounting fasteners for the latch 100 are standard hardware items supplied by the end user and are not intended to be an element of the claimed invention.

Figure 230:
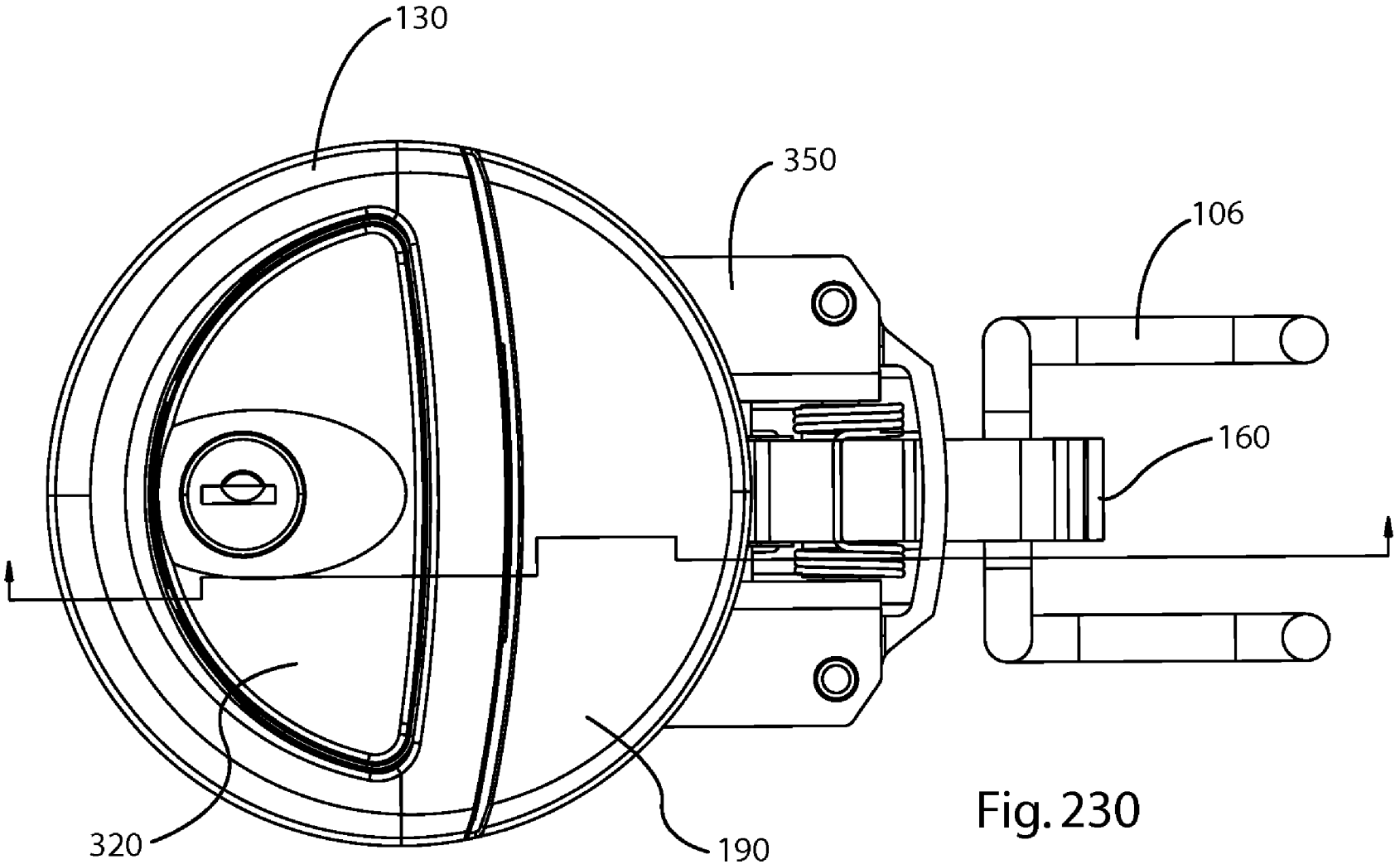
FIGS. 230-250 illustrate the operation of the latch according to the present invention.
Figure 231:
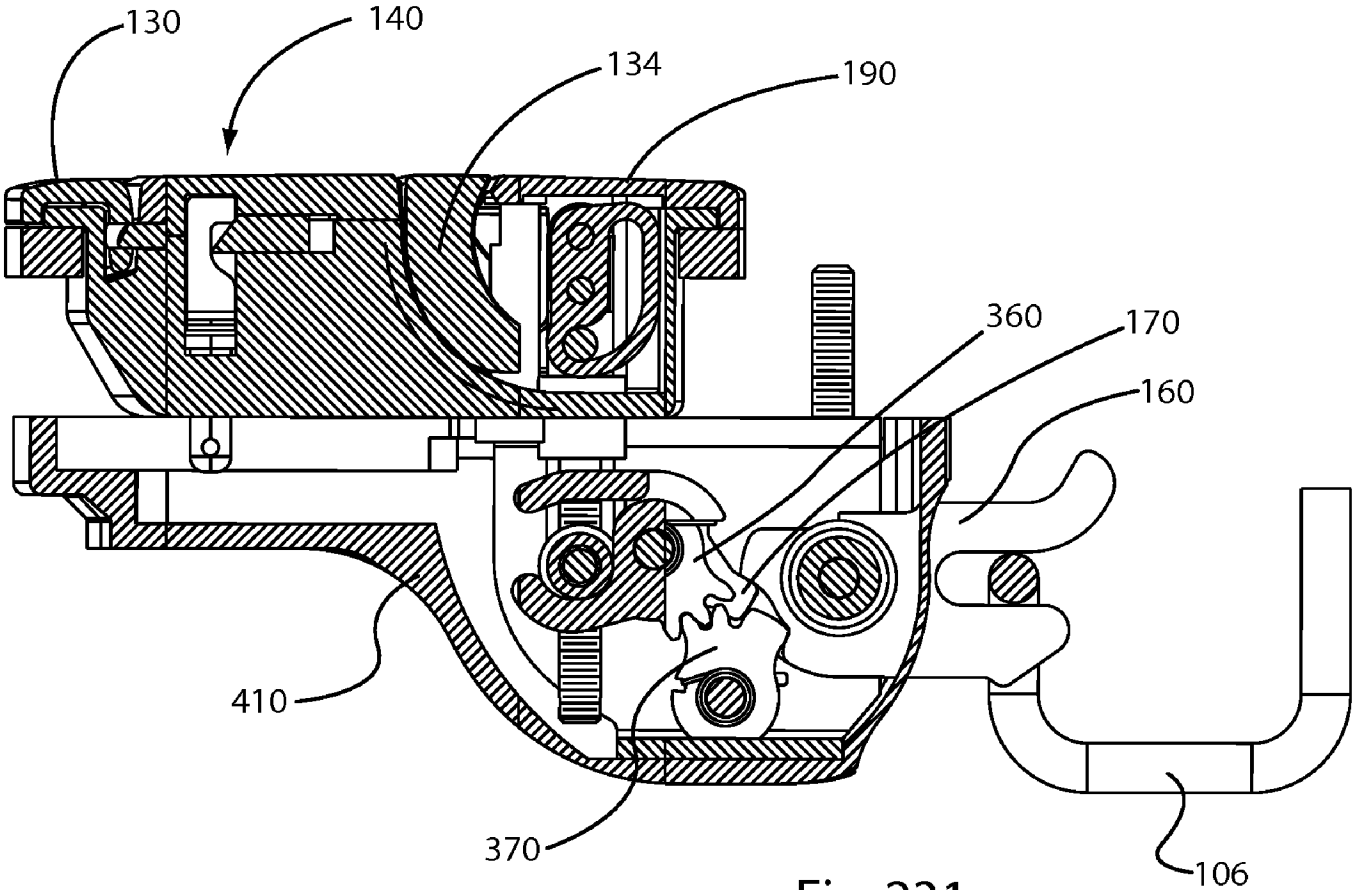
Figure 232:
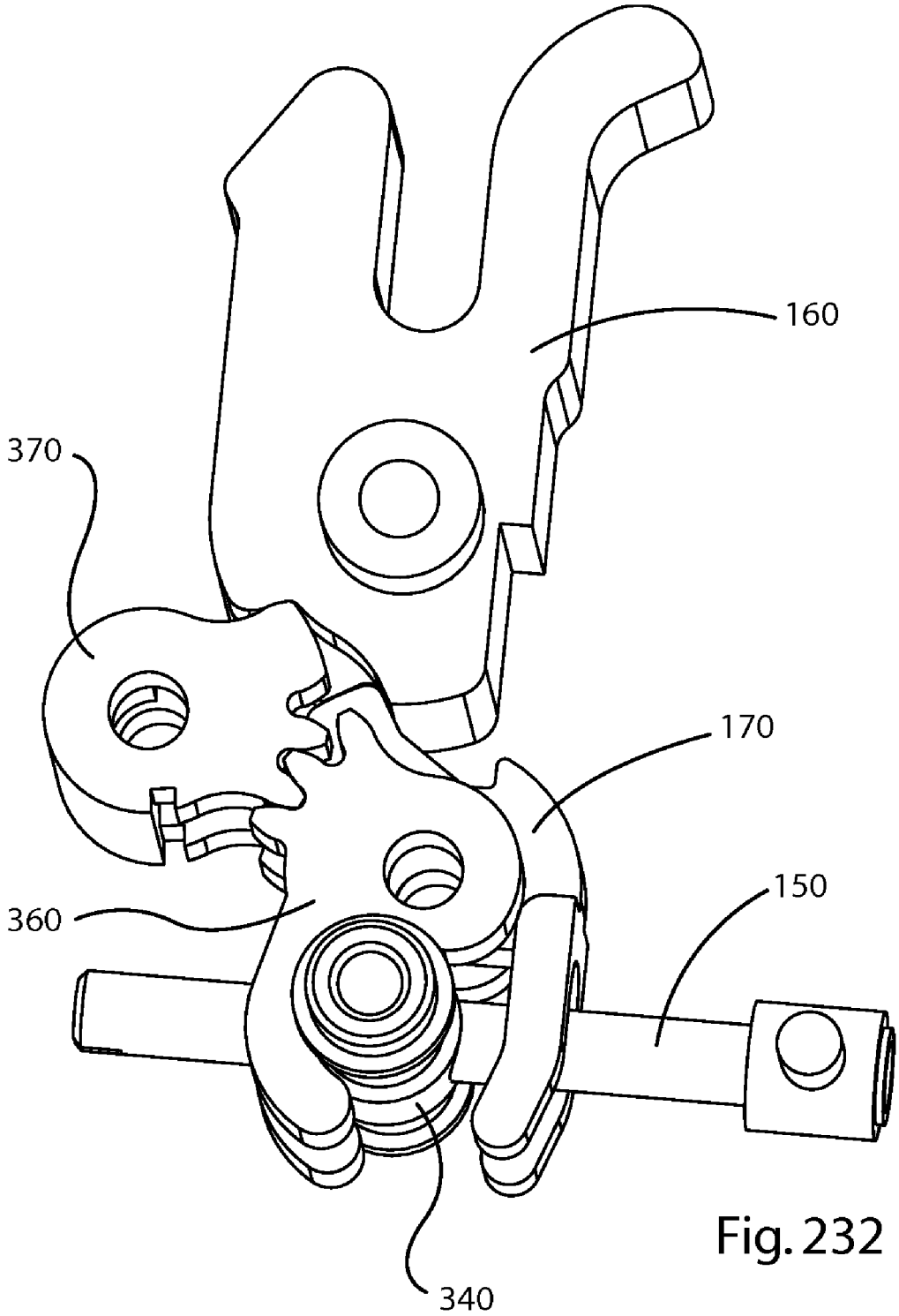
Figure 233:
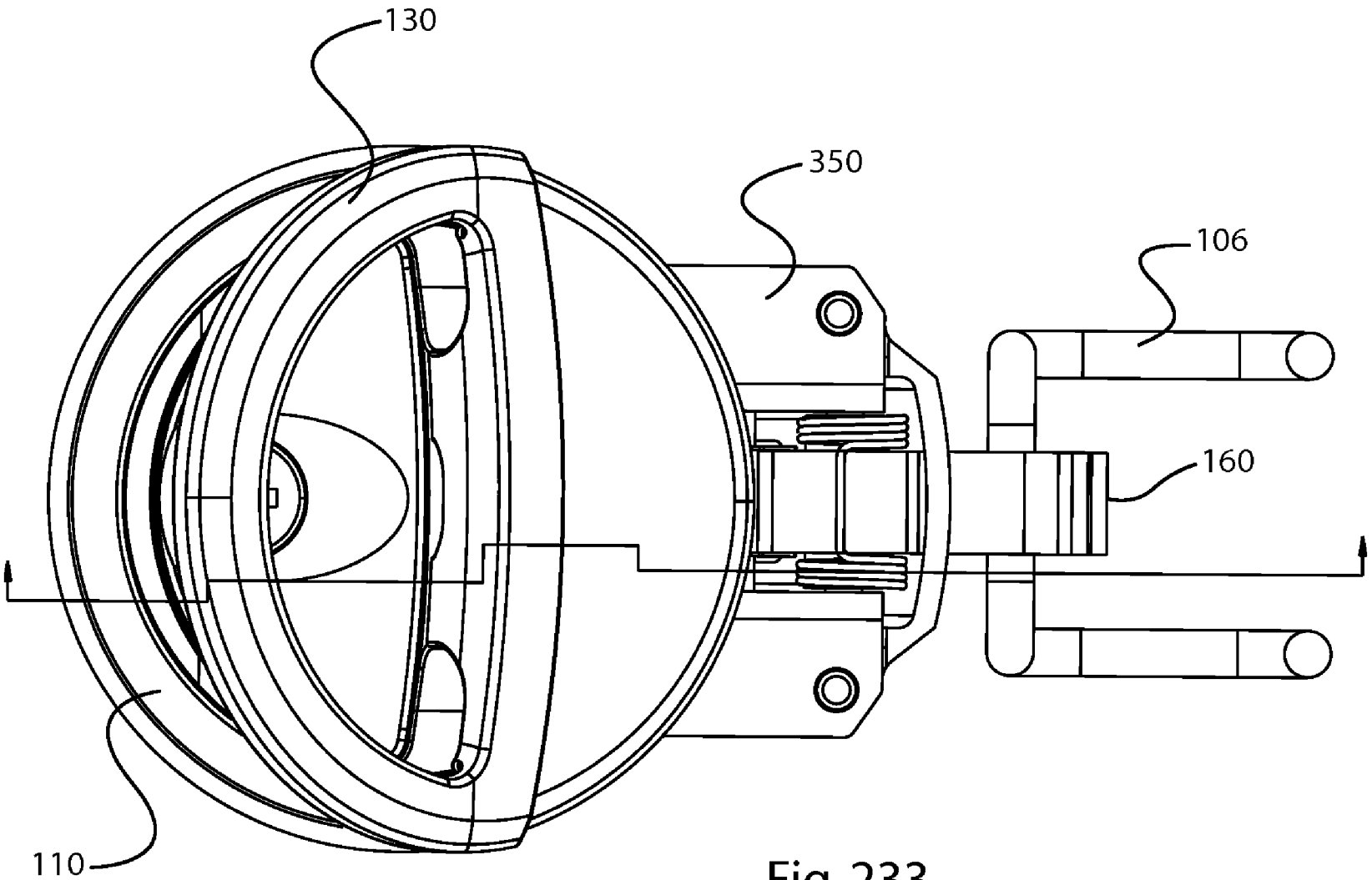
Figure 235:
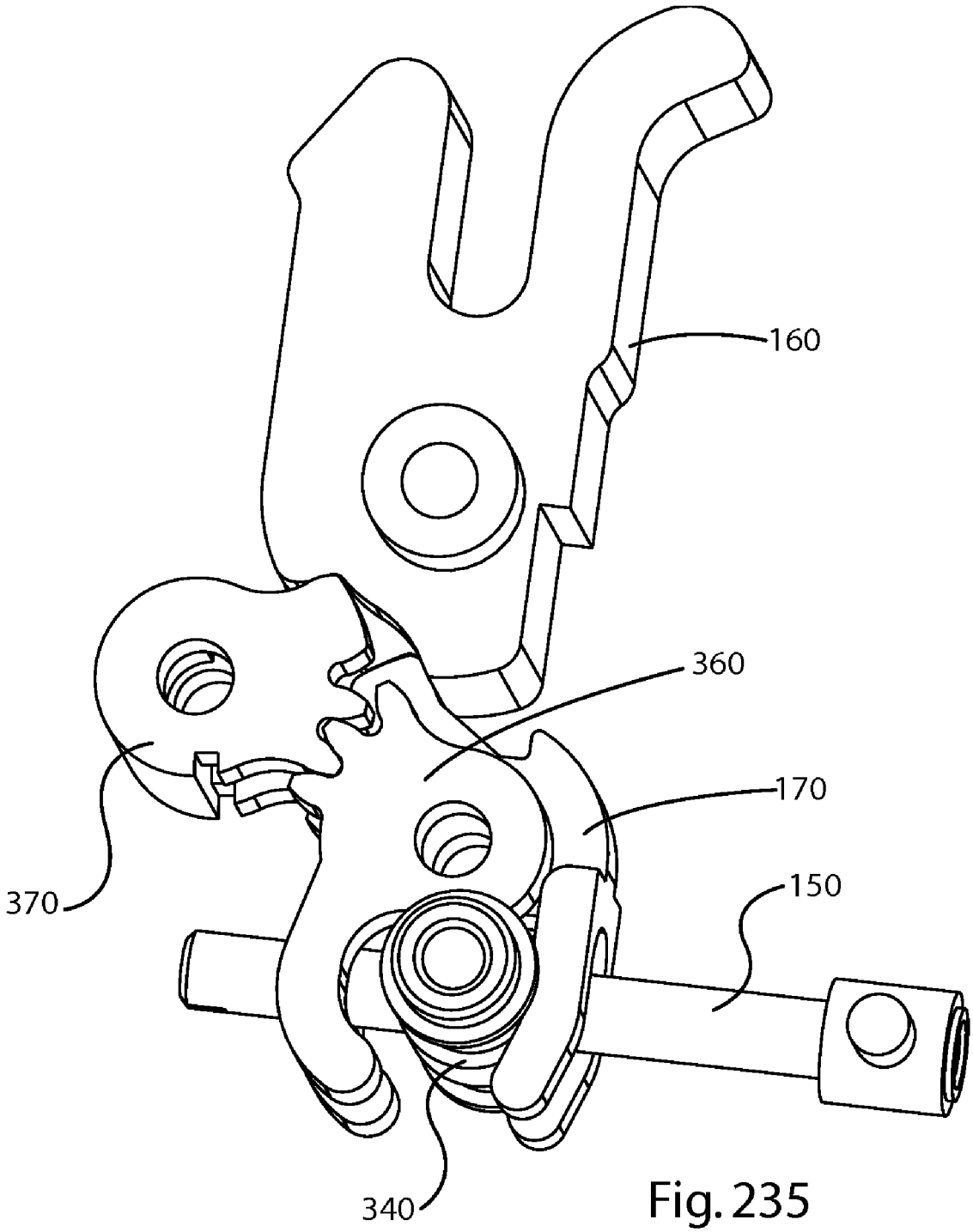

Referring to FIGS. 230-250, the operation of the latch 100 will be explained. FIGS. 230-232 show the latched in the fully latched condition with the handle 130 folded down and the pawl 160 in the fully latched position. Assuming the lock plug 240 to be unlocked, the lock plug can be pressed in to release the handle 130 to the intermediate position shown in FIGS. 233-235. Despite the handle release the pawl 160, the pawl catch 170, and the drive and compression gears are not affected.

Figure 236:
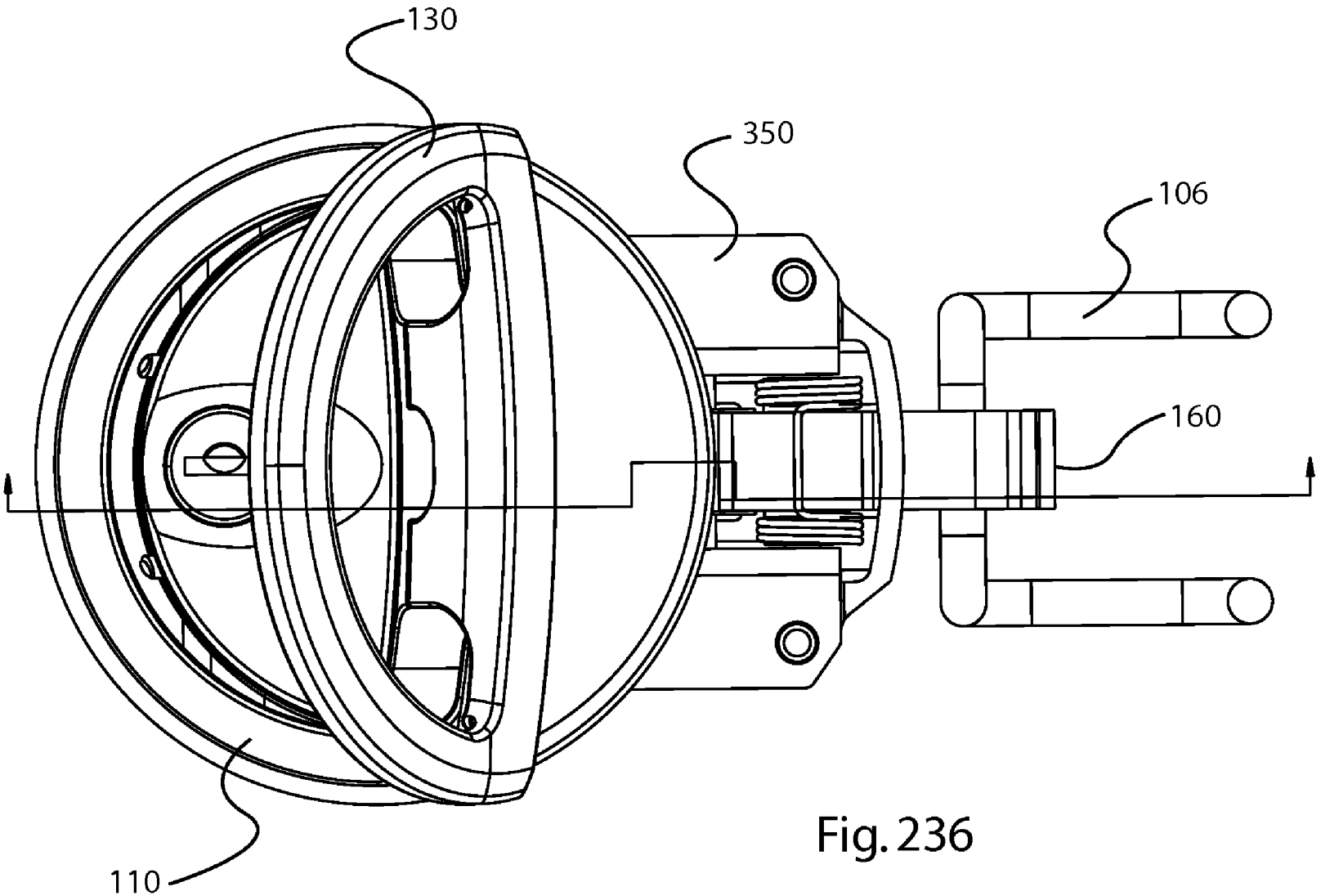
Figure 237:
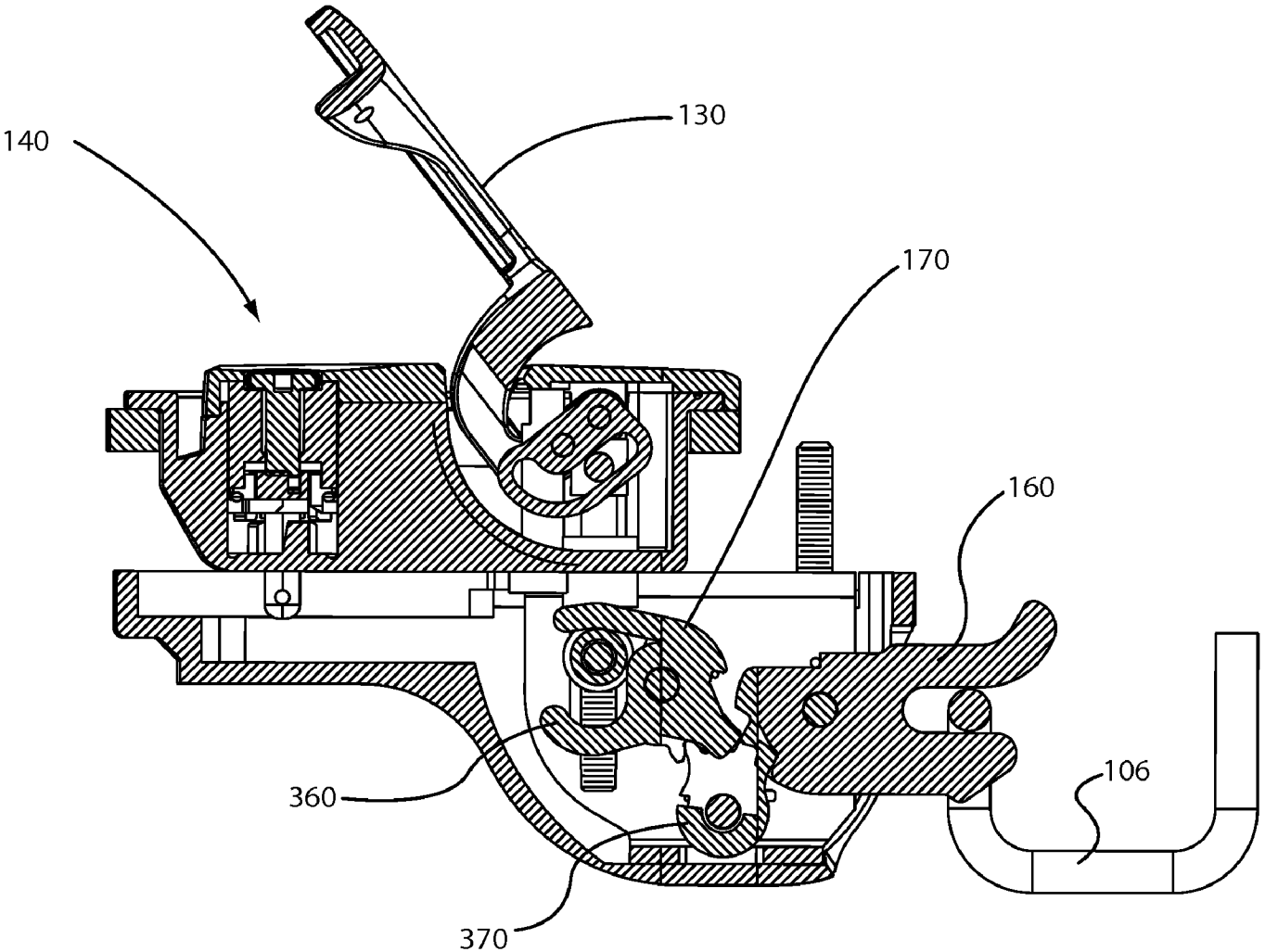
Figure 238:
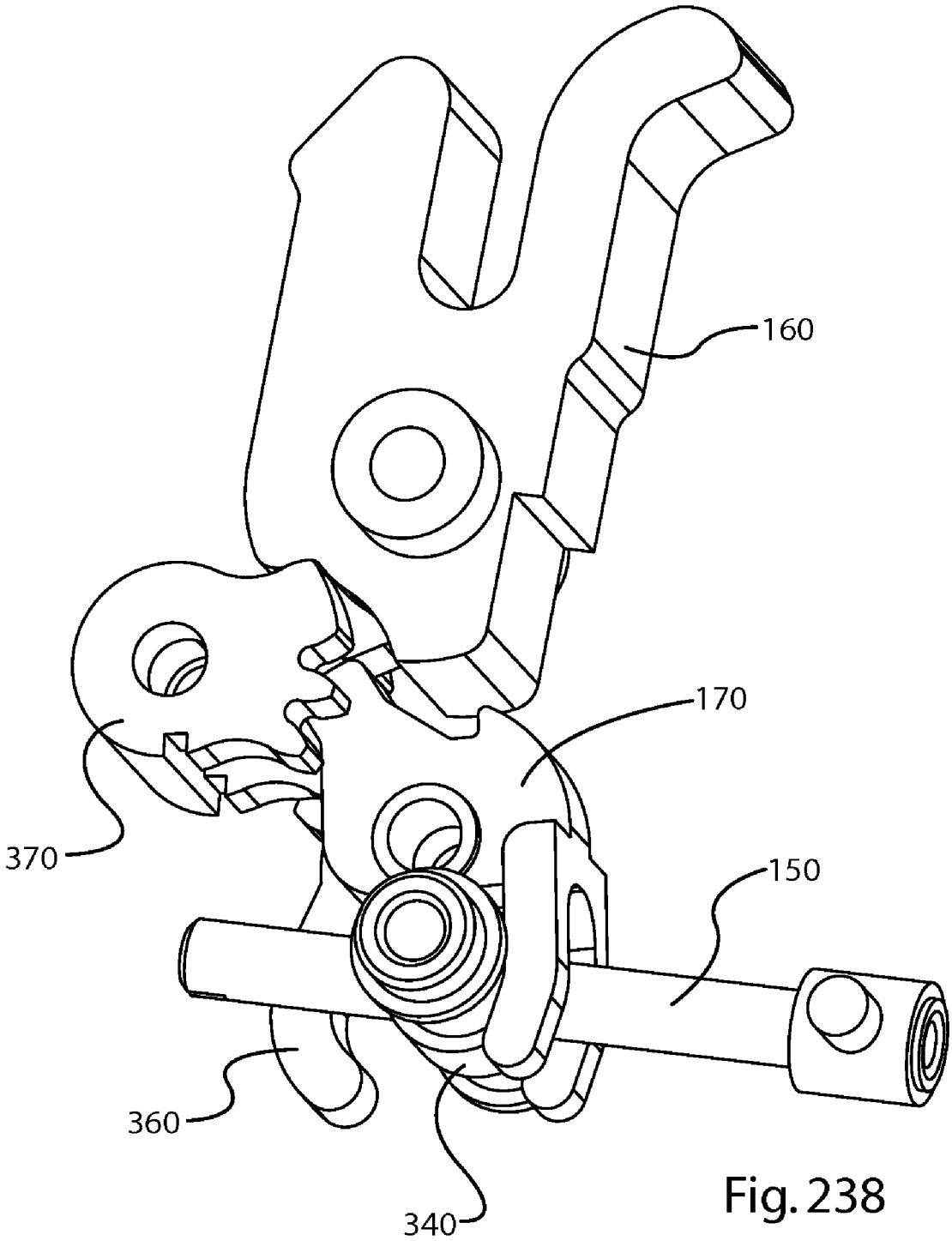
Figure 239:
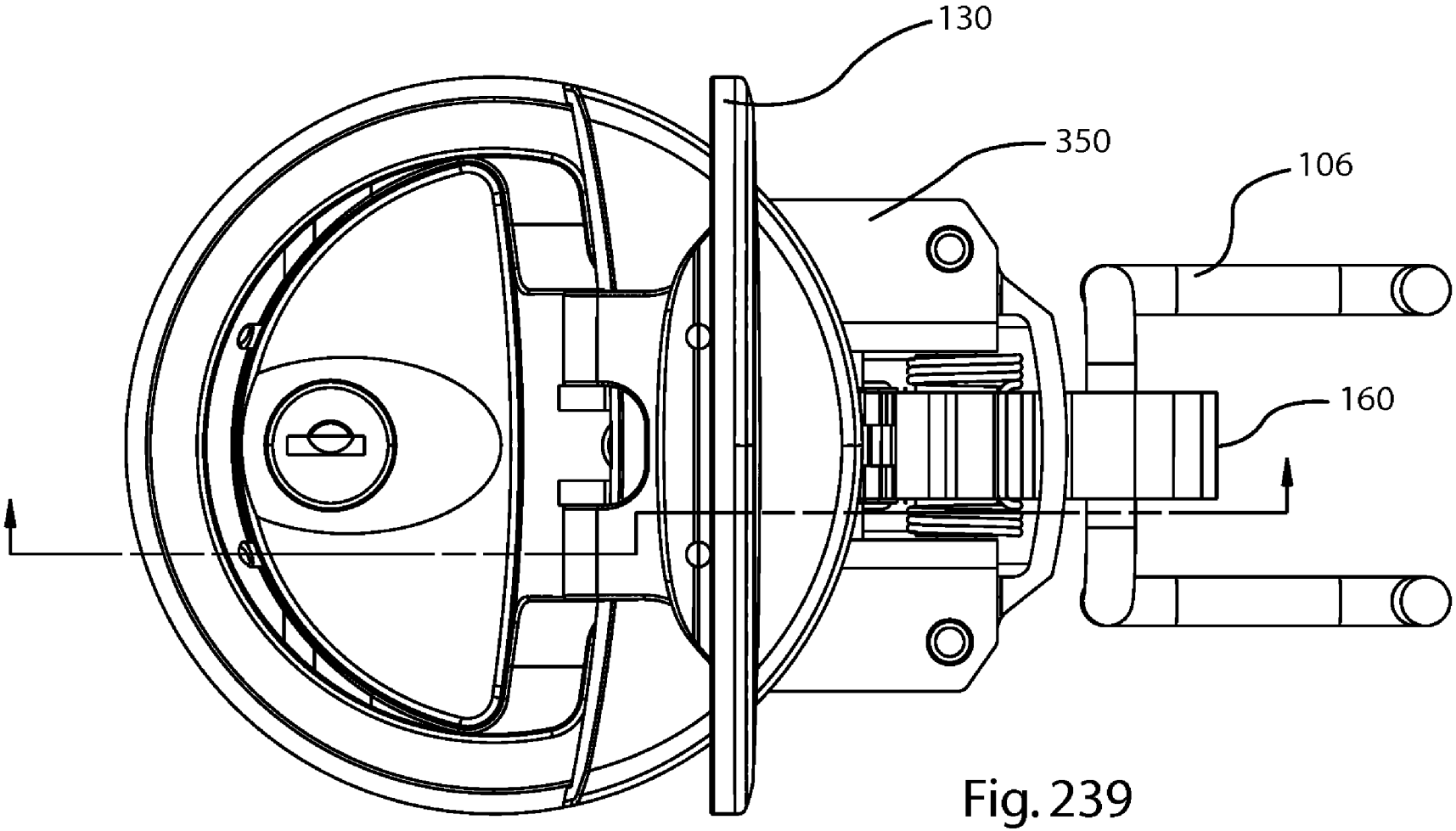
Figure 240:
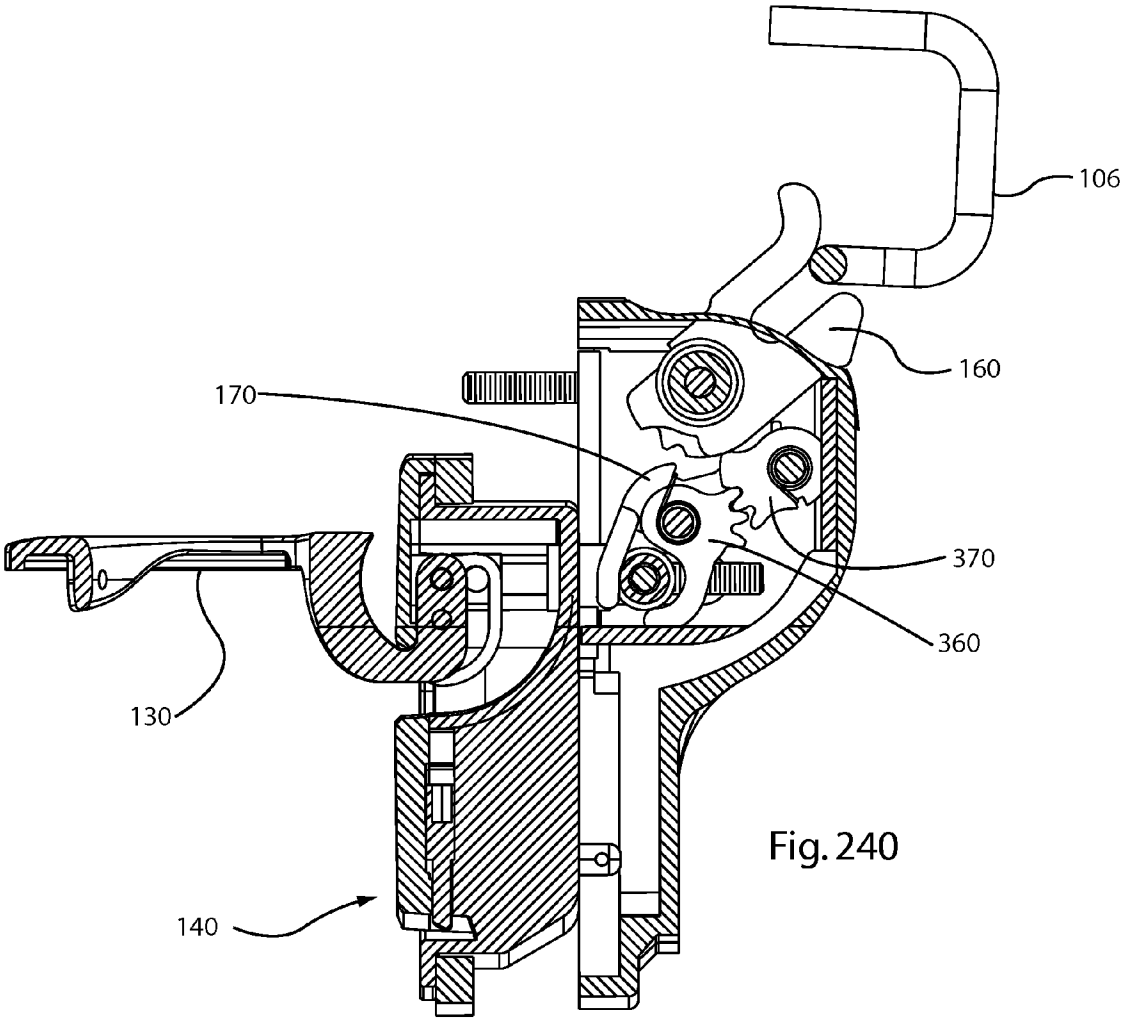
Figure 241:
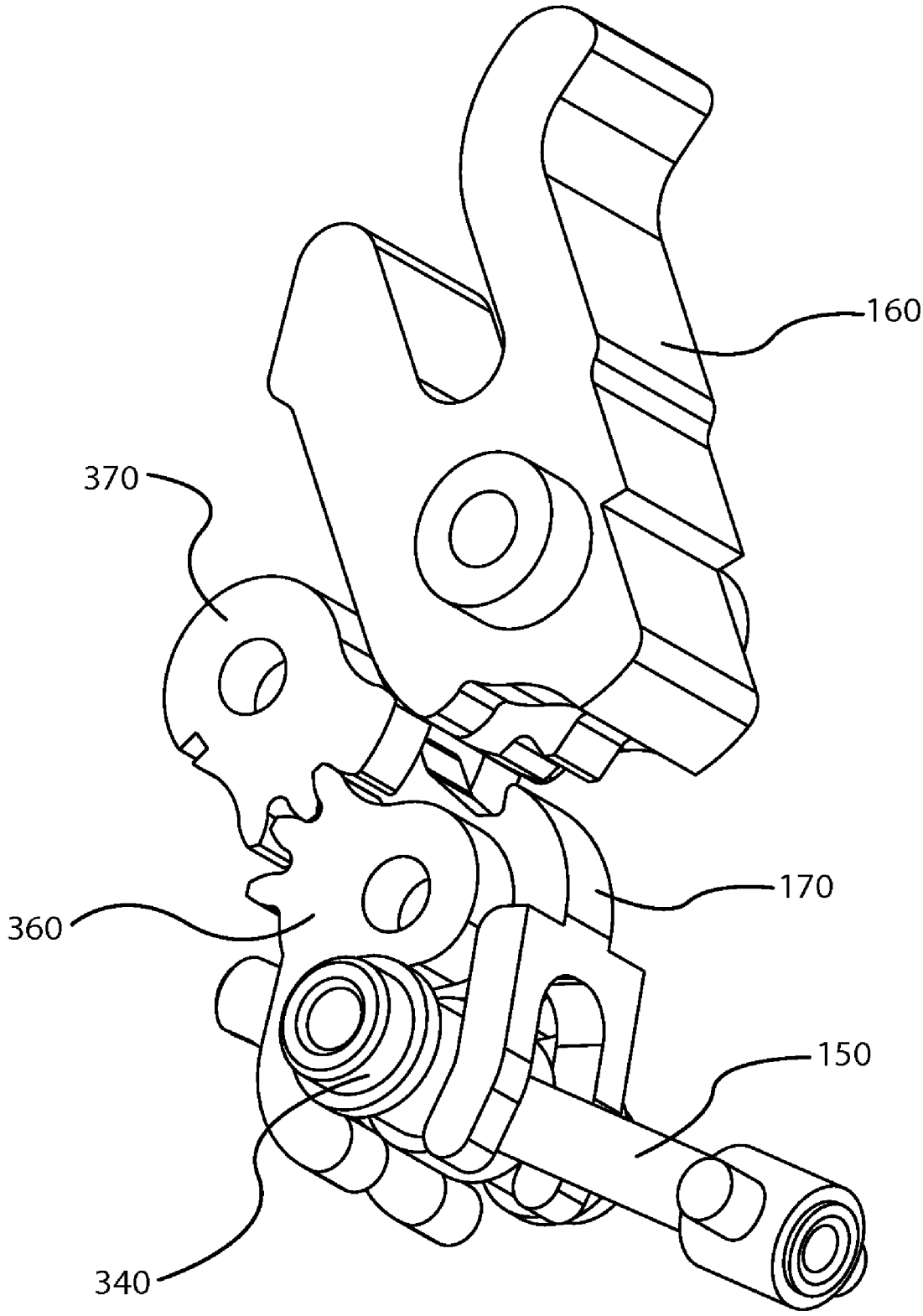

The user may now grasp the handle 130 and move it toward the fully raised position. As shown in FIGS. 236-238, the movement of the rod 150 brings the pawl catch 170 to the point of incipient release of the pawl 160. Further movement of the handle 130 to the fully open position causes the pawl 160 to be released and to move to the unlatched position as shown in FIGS. 239-241. The door 102 can now be opened. When the pawl is in the unlatched position, the location of the contact point between the compression gear and the pawl is such that the compression gear will clash with the pawl and prevent movement of the handle to the folded-down position.

Figure 242:
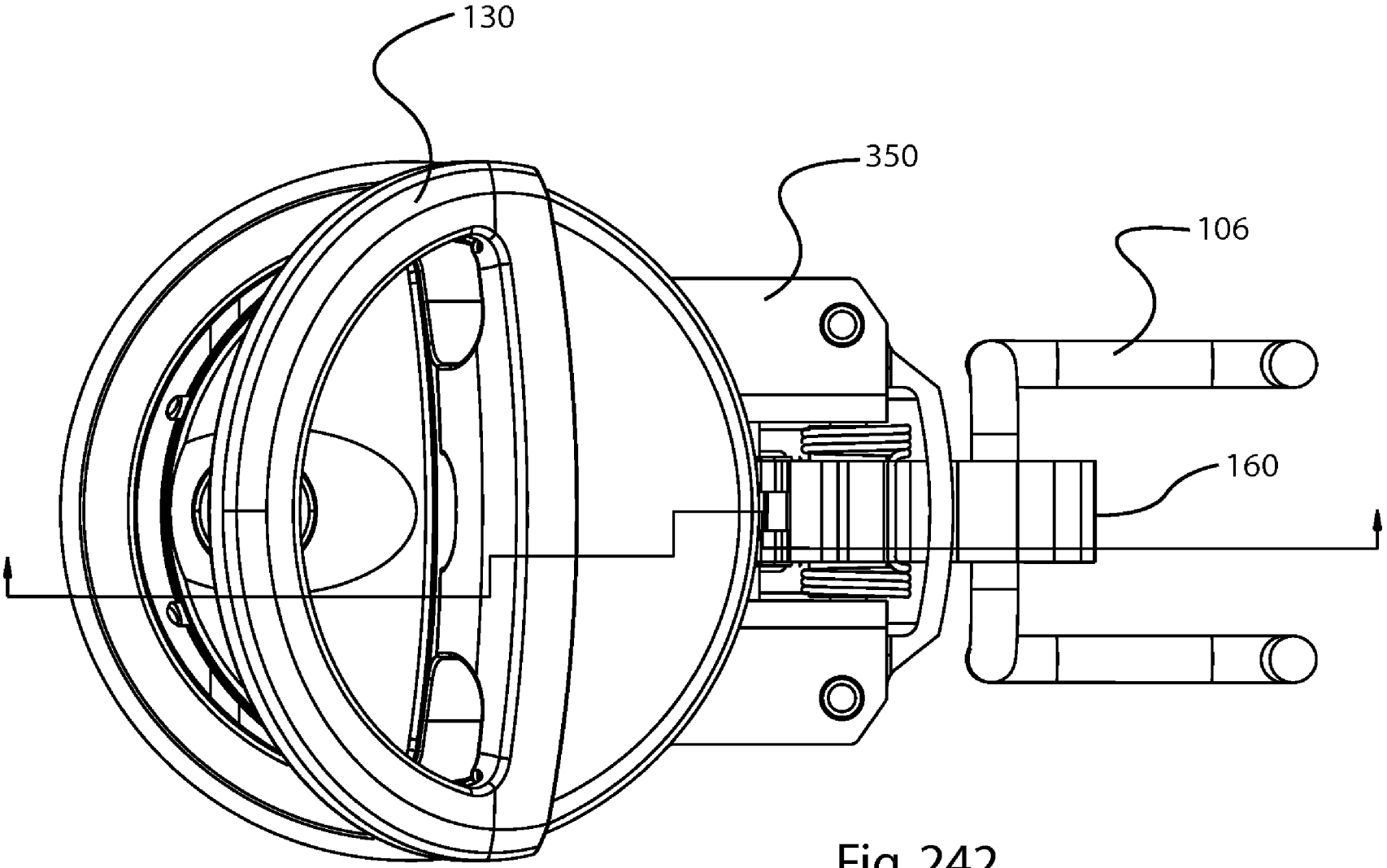
Figure 243:
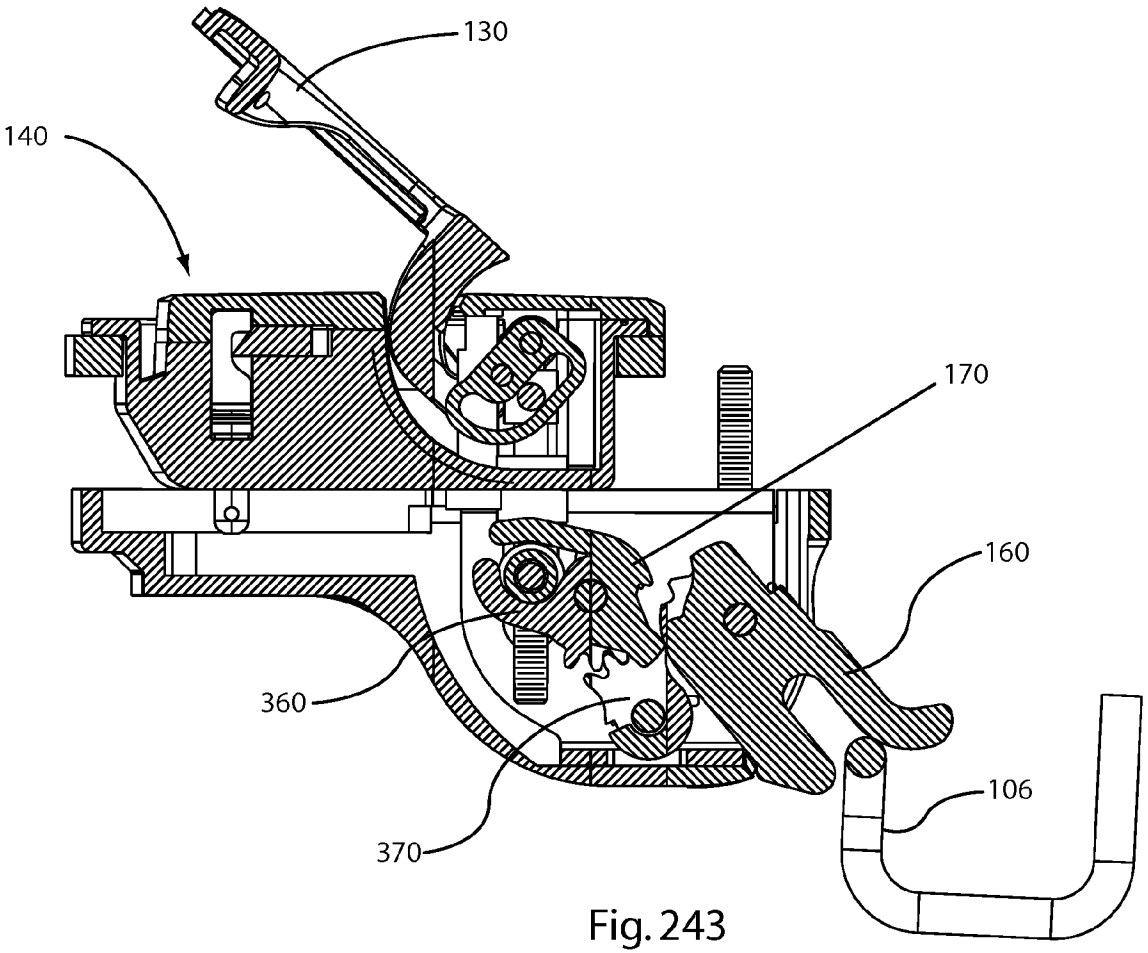
Figure 244:
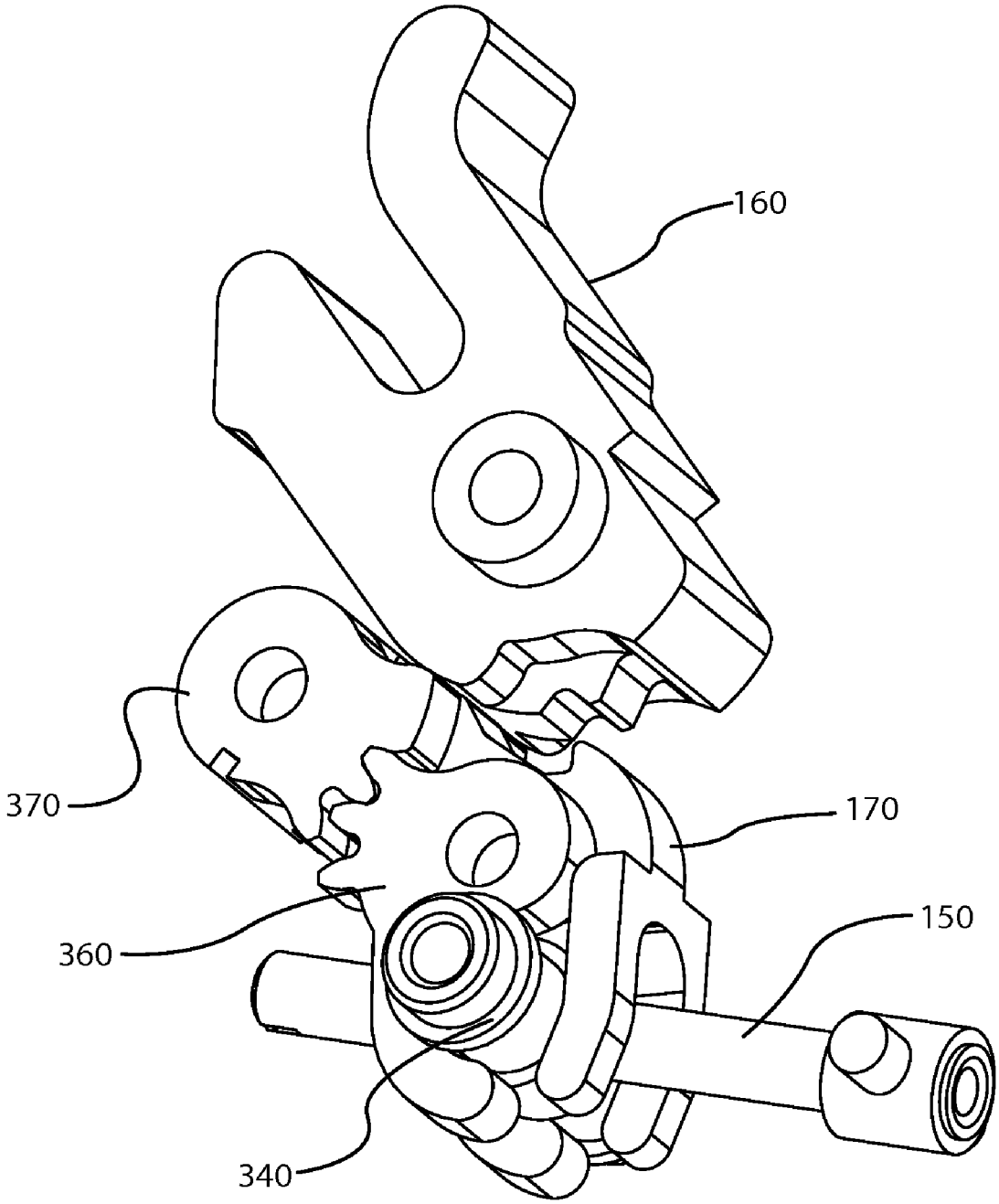
Figure 245:
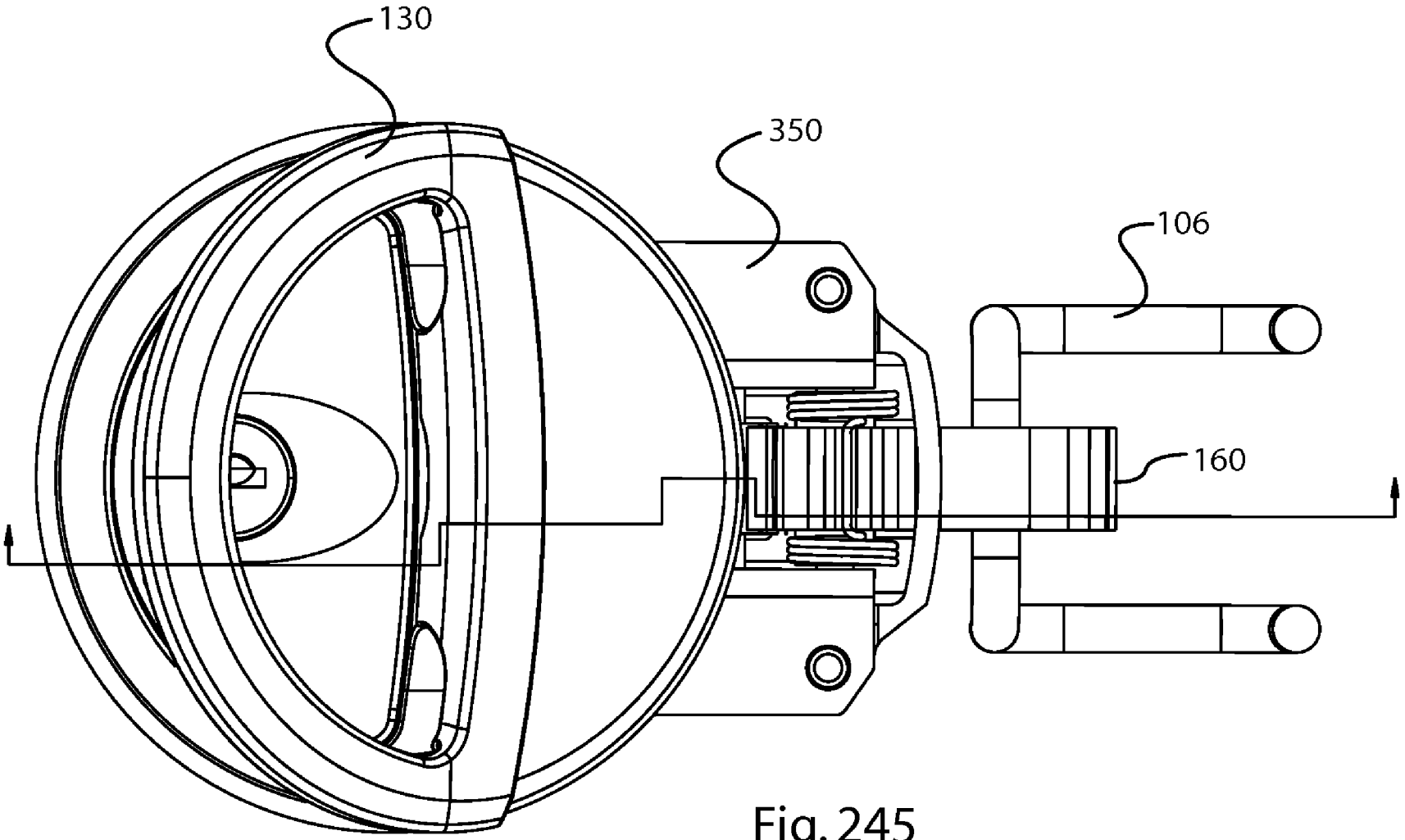
Figure 248:
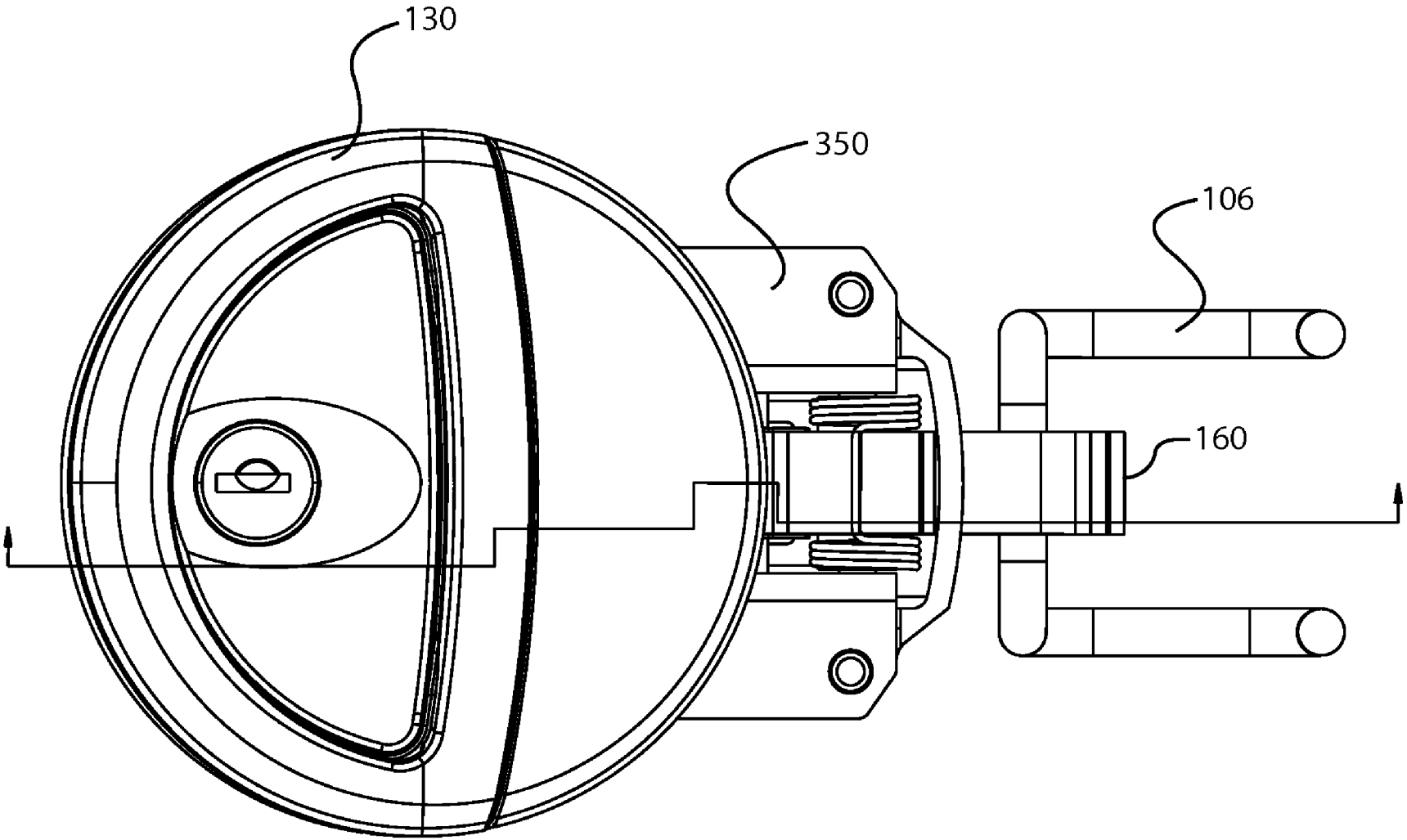
Figure 249:
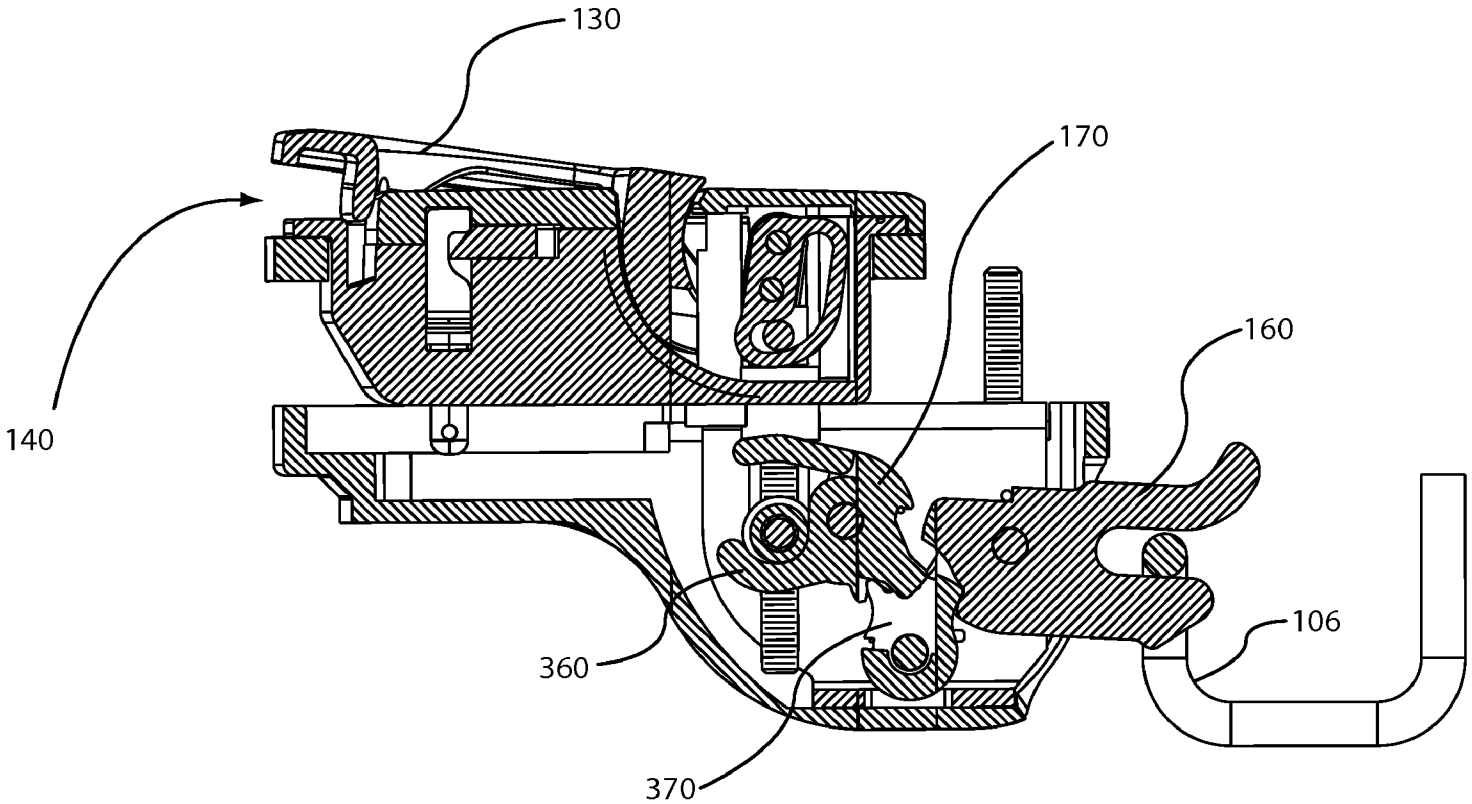

To close the latch, first the handle must be relaxed (see FIG. 243) to bias the pawl catch against the pawl. Beginning to close the door, brings the pawl 160 into contact with the keeper 106 as shown in FIGS. 242-244. Further movement of the door toward the closed position brings the pawl 160 to the intermediate position where the pawl catch 170 engages the first notch 164 of the pawl 160 as shown in FIGS. 245-247. At this point the contact point between the compression gear and the pawl has shifted to the notches 166 such that as the user forces the handle 130 to the folded-down position, the compression gear causes the rotation of the pawl 160 to the fully latched position, as shown in FIGS. 248-250, where the pawl catch 170 engages the notch 168 of the pawl to secure the pawl in the fully latched position and thus also providing the "pull-up" or "compression" action. In the illustrative embodiment, the intermediate position of the pawl is designed to be at about 20 degrees from fully latched position of the pawl.

As the handle 130 returns to it original folded-down state, the bolts 290, 300 are forced out of the way and then are allowed to reengage the holes 131, 133 in the handle 130 when the holes line up with the bolts, thus securing the handle in the folded-down position.

It is to be understood that the present invention is not limited to the embodiments disclosed above, but includes any and all embodiments within the scope of the appended claims.

The invention claimed is:

1. A latch for releasably securing a first member relative to a second member having a keeper, the latch comprising:

a handle pivotally supported relative to the first member and capable of rotational movement between a closed position, an intermediate position and an open position;

a rotary pawl supported relative to the first member and capable of rotational movement between a latched position, an intermediate position and an unlatched position;

a pawl catch adapted to selectively secure said pawl in either said latched position or said intermediate position of said pawl;

an actuating member operatively connected to said handle such that said actuating member is movable in response to at least movement of said handle from said intermediate position of said handle to said open position of said handle and movement of said handle from said intermediate position of said handle to said closed position of said handle, said actuating member being adapted to selectively engage said pawl catch to release said pawl; and a gear train operatively connected to said actuating member and to said pawl such that, when said pawl is secured in said intermediate position of said pawl by said pawl catch, said pawl moves from said intermediate position of said pawl to said latched position to provide compression between the first member and the second member due to movement of said actuating member in response to said handle being moved from said intermediate position of said handle to said closed position, wherein when said pawl is in said unlatched position, it is adapted to receive the keeper such that the pawl will move from the unlatched position toward the intermediate position as the first member is moved toward the closed position.

2. The latch according to claim 1, wherein said pawl is biased toward said unlatched position.

3. The latch according to claim 2, wherein said pawl catch is biased toward engagement with said pawl.

4. The latch according to claim 3, wherein said pawl catch is adapted to selectively catch and hold said pawl in said latched position and in said intermediate position of said pawl.

5. The latch according to claim 4, wherein said pawl catch is disengaged from said pawl to allow said pawl to rotate to said unlatched position.

6. The latch according to claim 5, wherein said actuating member is held in a position where it is disengaged from the pawl catch when said handle is secured in said closed position.

7. The latch according to claim 6, wherein said actuating member can be brought into engagement with said pawl catch in order to disengage said pawl catch from said pawl by moving said handle to said open position when said pawl is initially in one of said latched position and said intermediate position of said pawl.

8. The latch according to claim 7, wherein said handle has a cam that engages said actuating member and pulls said actuating member into engagement with said pawl catch as said handle is moved toward said open position.

9. The latch according to claim 8, wherein said pawl catch has at least one claw that is engaged by said actuating member to release said pawl, thereby allowing the first member to be opened relative to the second member.

10. The latch according to claim 9, wherein said handle is carried by a first housing, and said pawl, said pawl catch and said gear train are carried by a second housing, said first and second housings being adapted to be secured to the first member using at least one fastener.

11. The latch according to claim 1, wherein said handle has a D-shaped grasping ring and said handle is spring biased away from said closed position when said handle is in said closed position, wherein the latch further comprises a mechanism for securing said handle in said closed position, and wherein said mechanism comprises:

a handle release actuator; and at least one spring biased bolt, wherein said at least one bolt engages said handle to retain said handle in the closed position, and wherein said at least one bolt is retracted to be disengaged from said handle in response to said handle release actuator being pressed in order to release said handle from said closed position.

12. The latch according to claim 1, wherein said gear train comprises:

a drive gear having at least a first set of gear teeth; and a compression gear having at least a second set of gear teeth that are in mesh with said first set of gear teeth such that, as said handle is moved from said intermediate position of said handle toward said closed position, said drive gear rotates in response to movement of said actuating member, which in turn forces said compression gear to rotate and move said pawl from said intermediate position of said pawl toward said latched position.

13. A latch for releasably securing a first member in a closed position relative to a second member having a keeper, the latch comprising:

a first housing;

a second housing;

a handle pivotally supported by said first housing, said handle being at least capable of rotational movement between a closed position, an intermediate position and an open position;

a mechanism for securing said handle in said closed position, said mechanism being supported by said first housing;

an actuation rod having a longitudinal axis, said first housing supporting said actuation rod for substantially rectilinear movement along said longitudinal axis of said actuation rod, said actuation rod moving rectilinearly in response to at least movement of said handle from said intermediate position of said handle to said open position of said handle and movement of said handle from said intermediate position of said handle to said closed position of said handle;

a pawl rotationally supported by said second housing, said pawl being capable of rotational movement between a latched position, an intermediate position and an unlatched position;

a pawl catch pivotally supported by said second housing, said pawl catch being adapted to selectively secure said pawl in said latched position and in said intermediate position of said pawl; and a gear train supported by said second housing, wherein when said pawl is in said unlatched position, it is adapted to receive the keeper such that the pawl will move from the unlatched position toward the intermediate position as the first member is moved toward the closed position, wherein said gear train acts to move said pawl from said intermediate position of said pawl to said latched position due to movement of said actuation rod upon moving said handle to said closed position.

14. The latch according to claim 13, wherein said handle has a D-shaped grasping ring and said handle is spring biased toward said intermediate position of said handle when said handle is in said closed position, and wherein said mechanism comprises:

a handle release actuator; and at least one spring biased bolt, wherein said at least one bolt engages said handle to retain said handle in the closed position, and wherein said at least one bolt is retracted to be disengaged from said handle in response to said handle release actuator being pressed in order to release said handle from said closed position.

15. The latch according to claim 13, wherein said gear train comprises:

a drive gear having at least a first set of gear teeth; and a compression gear having at least a second set of gear teeth that are in mesh with said first set of gear teeth such that, as said handle is moved from said intermediate position of said handle toward said closed position, said drive gear rotates in response to movement of said actuation rod, which in turn forces said compression gear to rotate and move said pawl from said intermediate position of said pawl toward said latched position.

16. The latch according to claim 14, wherein said actuation rod is provided with a pin that moves with said actuation rod and that is adapted to engage said pawl catch, and wherein said pin of said actuation rod can be brought into engagement with said pawl catch in order to disengage said pawl catch from said pawl by moving said handle from said intermediate position of said handle to said open position when said pawl is initially in said latched position.

17. The latch according to claim 16, wherein said handle has a cam that engages said actuation rod and pulls said actuation rod so as to bring said pin of said actuation rod into engagement with said pawl catch as said handle is moved toward said open position.

18. A latch for releasably securing a first member relative to a second member having a keeper, the latch comprising:

a handle pivotally supported relative to the first member and capable of rotational movement between a closed position, an intermediate position and an open position;

a rotary pawl supported relative to the first member and capable of rotational movement between a latched position, an intermediate position and an unlatched position;

a pawl catch adapted to selectively secure said pawl in either said latched position or said intermediate position of said pawl;

an actuating member operatively connected to said handle such that said actuating member is movable in response to at least movement of said handle from said intermediate position of said handle to said open position of said handle and movement of said handle from said intermediate position of said handle to said closed position of said handle, said actuating member being adapted to selectively engage said pawl catch to release said pawl; and a gear train operatively connected to said handle and to said pawl such that, when said pawl is secured in said intermediate position of said pawl by said pawl catch, said pawl moves from said intermediate position of said pawl to said latched position to provide compression between the first member and the second member in response to said handle being moved from said intermediate position of said handle to said closed position, wherein when said pawl is in said unlatched position, it is adapted to receive the keeper such that the pawl will move from the unlatched position toward the intermediate position as the first member is moved toward the closed position.

19. The latch according to claim 18, wherein said actuating member is in the form of an actuation rod provided with a pin that moves with said actuation rod and that is adapted to engage said pawl catch, and wherein said pin of said actuating member can be brought into engagement with said pawl catch in order to disengage said pawl catch from said pawl by moving said handle from said intermediate position of said handle to said open position when said pawl is initially in one of said intermediate position of said pawl and said latched position.

20. The latch according to claim 18, wherein said handle acts on said gear train through said actuating member.

* * * * *